United States Patent [19]

Sasaki et al.

[11] Patent Number: 4,692,399

[45] Date of Patent: Sep. 8, 1987

[54] SILVER HALIDE PHOTOGRAPHIC LIGHT-SENSITIVE MATERIAL

[75] Inventors: Masao Sasaki; Takashi Kadowaki; Kaoru Onodera, all of Odawara, Japan

[73] Assignee: Konishiroku Photo Industry Co., Ltd., Tokyo, Japan

[21] Appl. No.: 880,781

[22] Filed: Jul. 1, 1986

[30] Foreign Application Priority Data

Jul. 5, 1985 [JP] Japan ..... 60-148026

[51] Int. Cl.[4] ..... G03C 1/46

[52] U.S. Cl. ..... 430/507; 430/512; 430/931

[58] Field of Search ..... 430/507, 512, 931

[56] References Cited

U.S. PATENT DOCUMENTS

| | | | |
|---|---|---|---|
| 4,456,681 | 6/1984 | Kadowaki et al. | 430/507 |
| 4,477,559 | 10/1984 | Iwamuro et al. | 430/507 |
| 4,540,656 | 9/1985 | Nishizima et al. | 430/507 |
| 4,587,208 | 5/1986 | Kadowaki et al. | 430/507 |

*Primary Examiner*—Jack P. Brammer

*Attorney, Agent, or Firm*—Jordan B. Bierman

[57] ABSTRACT

A silver halide photographic light-sensitive material is disclosed, which is excellent in light discoloration resistance and is more particularly capable of keeping its color balance and reproducing long life color images. The photographic material comprises a support, at least three light-sensitive silver halide emulsion layers containing a yellow, magenta, and cyan coupler, respectively, and at least one non-light-sensitive layer being provided at a further side of the emulsion layer being provided at the furthest position from the support. The non-light-sensitive layer contains at least three kinds of UV absorbers represented by the general formula [UV-I], provided that at least one of the UV absorbers is in a liquid state at 30° C. and at least two UV absorbers are in a solid state at the same temperature.

Formula [UV-1]

And the emulsion layer containing the yellow coupler contains a compound represented by the general formula [A]:

Formula [A]

19 Claims, No Drawings

SILVER HALIDE PHOTOGRAPHIC LIGHT-SENSITIVE MATERIAL

BACKGROUND OF THE INVENTION

This invention relates to a silver halide photographic light-sensitive material and more particularly to a silver halide photographic light-sensitive material capable of producing a dye image which is less in light discoloration and excellent in preservability.

Generally, a silver halide color photographic light-sensitive material comprises a support coated thereon with three kinds of silver halide color photographic emulsion layers so selectively sensitized as to have the sensitivity to blue-, green- and red-light, respectively. For example, a color negative type light-sensitive material is generally provided with a blue-sensitive emulsion layer, a green-sensitive emulsion layer and a red-sensitive emulsion layer coated in order from the side to be exposed to light; a bleachable yellow filter layer so interposed between the blue-sensitive emulsion layer and the green-sensitive emulsion layer as to absorb blue-light penetrating the blue-sensitive emulsion layer; the other interlayers interposed between the emulsion layers with the particular purposes, respectively; and a protective layer for the outermost layer of the light-sensitive material. Further, a color print type light-sensitive material is generally provided with a red-sensitive emulsion layer, a green-sensitive emulsion layer and a blue-sensitive emulsion layer coated in order from the side to be exposed to light; interlayers including a UV absorbing layer and others each with the particular purposes similar to those in the color negative type light-sensitive materials; a protective layer; and the like. It has been known that the above-mentioned emulsion layers may also be arranged differently from the above-mentioned layer arrangements, and further that two kinds of light-sensitive emulsion layers each having the light-sensitivity to the respective color-light in the substantially same light-sensitive region may also be used in place of using one each of the respective emulsion layers having a light-sensitive region different from each other. In the above-mentioned silver halide color photographic light-sensitive materials, the exposed silver halide grains thereof are developed by making use of such a color developing agent as an aromatic primary amine compound, so that an dye image may be formed through the reaction of the oxidation products produced from the color developing agent with a dye forming coupler. In the above-mentioned process, there normally uses such a cyan coupler as those of a phenol or naphthol type, such a magenta coupler as those of a 5-pyrazolone, pyrazolinobenzimidazole, pyrazolotriazole, indazolone or cyanoacetyl type, and such a yellow coupler as those of an acylacetamide or benzoylmethane type. The above-mentioned dye forming couplers are contained in a light-sensitive color photographic emulsion layer or a developer solution.

It is generally known that a dye image is faded or discolored under various storage conditions. For example, as a color print being displayed in the show window of a photo studio, there causes a discoloration when a dye image is stored with a long time exposure to light. This type of discoloration is called a light discoloration. And, as a color print being stored in an album, there causes a discoloration when being stored in high temperature and humidity conditions for a long time even though it is exposed to light for a relatively short time.

This type of discoloration is called a dark discoloration. If such a photographic products having a dye image as the above-mentioned color print is regarded as an image recording material, the preservability of an dye image is to be semipermanent on the photographic product, and it is, therefore, desired and being increasingly demanded year by year that the above-mentioned discoloration may be minimized in any preservation conditions.

With the purpose of improving a light discoloration in particular to meet the above-mentioned demands, there have been the proposals of layer arrangement techniques relating to a photographic layer containing a 2-(2'-hydroxyphenyl)benzotriazole type UV absorbing agent and the layers relating thereto, such as proposed in Japanese Patent O.P.I. Publication Nos. 209734/1983 and 211147/1983.

However, it has so far been known that the above-given 2-(2'-hydroxyphenyl)benzotriazole type UV absorbing agent conventionally shows an extraordinary crystallization property and the stability of the oil-in-water disoersion is very low in stability. As for the techniques for improving the above-mentioned defects, there have been proposed the techniques for mixing UV absorbing agents in Japanese Patent Examined Publication Nos. 5496/1973 and 41572/1973; Japanese Patent O.P.I. Publication Nos. 85425/1978 and 215378/1984; and the like, for example.

The above-mentioned techniques are effective in improving th crystallization property at any rate, however, they are still not fully satisfactory, because they are less effective against coalescence and flocculation of the dispersion on standing.

In contrast with the above, International Patent Publication No. 81-01473, European Patent Publication No. 57,160 and the like disclose such a UV absorbing agent as is liquid at an ordinary temperature. This type of UV absorbing agents are satisfactory in crystallization property, however, they have some defects such as that they are apt to suffer a loss in complicated manufacture, that the lotted components thereof may not be uniformed because of the hard refining, and that they are increased in cost.

Journal of Technical Disclosure No. 85-800 describes a technique for mixing a solid UV absorbing agent with a liquid UV absorbing agent at room temperature. From the results of our investigation thereof, it was found that the dispersed solution thereof was improved in stability. However, when this technique was applied to a silver halide photographic light-sensitive material having silver halide emulsion layers respectively containing a yellow coupler, a magenta coupler and a cyan coupler, this technique displayed a defect that the color balance of a dye image formed in the light-sensitive material was sharply shifted in light discoloration and especially in the latter part of the discoloration.

SUMMARY OF THE INVENTION

It is, accordingly, an object of the invention to provide a silver halide photographic light-sensitive material which is excellent in light discoloration resistance and is more particularly capable of keeping its color balance and reproducing long life color images.

As the results that the inventors studied to solve at the same time the above-mentioned defects, namely, the stability of a dispersed solution containing the above-mentioned UV absorbing agents and the color balance in light discoloration caused in a silver halide photographic light-sensitive material containing the above-mentioned dispersed solution, the inventors have found that the defects can be solved with a silver halide photographic light-sensitive material comprising a reflective support, and provided thereon, a light-sensitive silver halide emulsion layer containing a yellow coupler, a light-sensitive silver halide emulsion layer containing a magenta coupler, a light-sensitive silver halide emulsion layer containing a cyan coupler, and a non-light-sensitive layer being provided at a further side of the light-sensitive emulsion layer being provided at the furthest position from said support, wherein said non-light-sensitive layer contains at least three kinds of UV absorbers represented by the general formula [UV-1] in combination, Formula [UV-I]

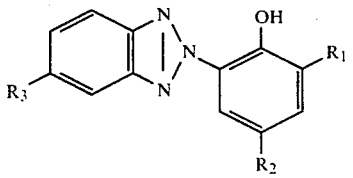

wherein $R_1$, $R_2$ and $R_3$ are independently selected from the group consisting of a hydrogen atom, a halogen atom, an alkyl group, an aryl group, an alkoxy group, an aryloxy group, an alkenyl group, a nitro group and a hydroxy group, provided that at least one of said UV absorbers is selected from a first class which is in a liquid state at 30° C. and at least two of said UV absorbers are selected from a second class which is in a solid state at the same temperature, that said first class UV absorber is contained in a proportion of not less than 30% by weight to the total amount of said UV absorbers and that at least one of said second class UV absorbers has the total number of carbon atoms of at least 8 in the groups represented by $R_1$ and $R_2$ of the general formula [UV-I] and is contained in a proportion of from 35% to 100% by weight to the total amount of said second class UV absorbers, and said emulsion layer containing the yellow coupler contains a compound represented by the general formula [A]:

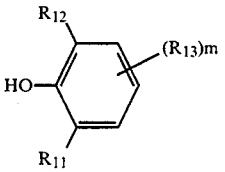

Formula [A]

wherein $R_{11}$ and $R_{12}$ are independently selected from an alkyl group, and $R_{13}$ is selected from the group consisting of an alkyl group, —NR'R" group, —SR' and —COOR" group, wherein R' is a monovalent organic group and R" is an hydrogen atom or a monovalent organic group and m is an integer 0 to 3.

DETAILED DESCRIPTION OF THE INVENTION

In the UV-absorbing agents represented by the aforegiven Formula [UV-1] which are used in the invention, the halogen atoms represented by $R_1$, $R_2$ and $R_3$ include, for example, a fluorine atom, a chlorine atom, a bromine atom and the like, and, inter alia, a chlorine atom is particularly preferable.

The alkyl groups and the alkoxy groups represented by $R_1$, $R_2$ and $R_3$ preferably include, for example, those each having 1 to 20 carbon atoms, and the alkenyl groups represented thereby preferably include, for example, those each having 2 to 20 carbon atoms, and every of which may be normal-chained or branch-chained.

The above-mentioned alkyl, alkenyl and alkoxy groups are allowed to have substituents, respectively. Such substituents include, for example, an aryl group, a cyano group, a halogen atom, a heterocyclic group, a cycloalkyl group, a cycloalkenyl group, a spiro compound residual group, a bridged hydrocarbon compound residual group; and besides, those substituting through a carbonyl group such as an acyl group, a carboxy group, a carbamoyl group, an alkoxycarbonyl group and an aryloxycarbonyl group; those substituting through a hetero atom; and more typically, those substituting through an oxygen atom such as hydroxy, alkoxy, aryloxy, heterocyclicoxy, siloxy, acyloxy, carbamoyloxy or like group; those substituting through a nitrogen atom such as a nitro, amino including dialkylamino and the like, sulfamoylamino, alkoxycarbonylamino, aryloxycarbonylamino, acylamino, sulfonamido, imido, ureido or like group; these substituting through a sulfur atom such as an alkylthio, arylthio, heterocyclic thio, sulfonyl, sulfinyl, sulfamoyl or like group; and those substituting through a phosphorus atom such as a phosphonyl or like group.

The typical examples of the above-mentioned substituents include a methyl group, an ethyl group, an isopropyl group, a t-butyl group, a sec-butyl group, an n-butyl group, an n-amyl group, a sec-amyl group, t-amyl group, an $\alpha,\alpha$-dimethylbenzyl group, an octyloxycarbonylethyl group, a methoxy group, an ethoxy group, an octyloxy group, an allyl group or the like.

The aryl groups and the aryloxy groups represented by $R_1$, $R_2$ and $R_3$ preferably include, for example, a phenyl group and a phenyloxy group in particular, and they are allowed to have such a substituent as an alkyl, alkoxy or like group. The typical examples thereof include a phenyl group, a 4-t-butylphenyl group, a 2,4-di-t-amylphenyl group or the like.

Among the groups represented by $R_1$ and $R_2$, a hydrogen atom, an alkyl group, an alkoxy group and an aryl group are preferable, and a hydrogen atom, an alkyl group and an alkoxy group are particularly preferable.

Among the groups represented by $R_3$, a hydrogen atom, a halogen atom, an alkyl group and an alkoxy group are preferable.

Such UV absorbing agents will now be described in detail.

The UV absorbing agents each comprise a combination of one being in liquid state and the other being in solid state each at 30° C. It does not care whether the liquid state UV absorbing agent is of a single component type or a mixture of various structural isomers.

About the mixture ratios of such UV absorbing agents; the UV absorbing agents being in liquid state at 30° C. are in an amount of not less than 30% by weight to all of the UV absorbing agents and preferably from not less than 30% to not more than 99% and further preferably from not less than 30% to not to not more than 95%; and meanwhile, about the UV absorbing agents being in the solid state at 30° C., the groups thereof represented by the $R_1$ and $R_2$ in the aforegiven Formula [UV-I] have not less than 8 carbon atoms in total may be in an amount of not less than 35% by weight to all of the solid state UV absorbing agents and preferably from not less than 35% up to 100% and further preferably from not less than 50% up to 100%.

Besides, in at least one of the UV absorbing agents being in solid state at 30° C., a total number of carbom atoms of the groups represented by $R_1$ and $R_2$ in the Formula [UV-I] may be not less than eight and it may be said that the upper limit of the carbon atom numbers is preferably up to about 12, depending upon the groups represented by $R_1$ and $R_2$ and further upon those represented by $R_3$. A total amount of the UV absorbing agents added may generally be within the range of from 0.1 to 300% by weight to the binder of the non-light-sensitive layer containing the UV absorbing agents and preferably from 1 to 200% and more preferably from 5 to 100%.

The binders which may be used in the non-light-sensitive layer containing the UV absorbing agents are preferably the hydrophilic ones including, for example, a gelatin and the derivatives thereof such as an acetylated gelatin and a phthalated gelatin; albumin; collodion; and the like. Among them, gelatin is preferable.

For the purpose of containing a UV absorbing agent into a non-light-sensitive layer, there may be applied with various processes such as the so-called alkaline solution dispersion process, a solid state dispersion process, a latex dispersion process, an oil-in-water type emulsification-dispersion process or the like, and a suitable process may be selected therefrom according to the chemical structure and the like of a UV absorbing agent used. Among the processes, the latex dispersion process and the oil-in-water type dispersion process are particularly effective. These processes have so far been well-known and inter alia the latex dispersion process and the effects thereof are described in, for example, Japanese Patent Application Nos. 74538/1974, 59943/1976 and 32552/1979; and Research Disclosure No. 14850, August, 1976, pp. 77~79.

The suitable latices include, for example, a homopolymer, a copolymer and a terpolymer comprising such a monomer as styrene, ethyl acrylate, n-butyl acrylate, n-butyl methacrylate, 2-acetacetoxyethyl methacrylate, 2-(methacryloyloxy)ethyltrimethylammonium metasulfate, 3-(methacryloyloxy)propane-1-sodium sulfonate, N-isopropyl acrylamide, N-[2-(2-methyl-4-oxopentyl)-]acrylamide, 2-acrylamido-2-methylpropane sulfonic acid and the like.

In the oil-in-water type emulsification-dispersion process, there may be applied with a conventionally known process of dispersing such a hydrophobic additive as a coupler, in which, for example, a highly boiling organic solvent having a boiling point of not lower than 175° C. is dissolved, together with a low boiling solvent if required, and the resulting solution is finely dispersed in such a hydrophilic binder as a gelating solution by making use of a surface active agent, and the resulting dispersed matter is added in the layer aimed at.

The typical examples of the 2-(2'-hydroxyphenyl)-benzotriazole UV absorbing agents being in the liquid state at 30° C. are given below:

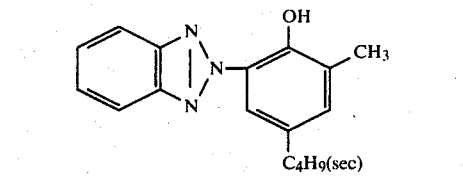

UV-1L

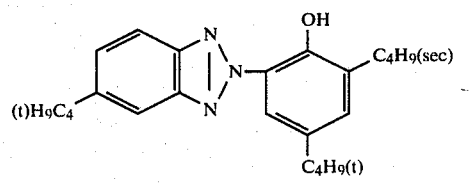

UV-2L

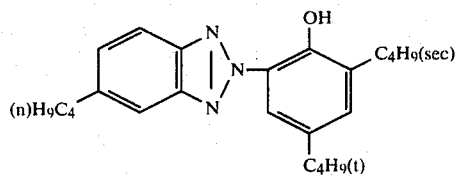

UV-3L

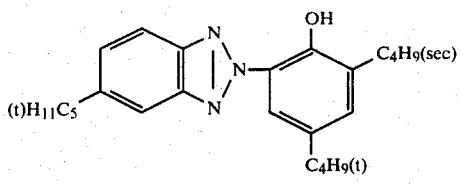

UV-4L

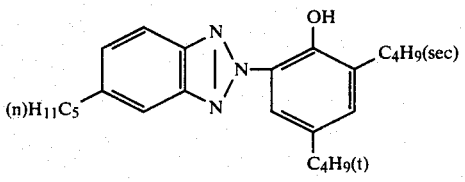

UV-5L

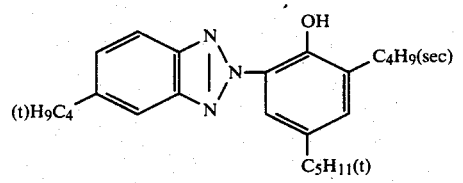

UV-6L

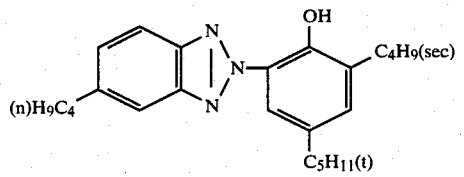

UV-7L

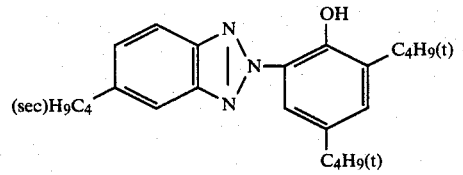

UV-8L

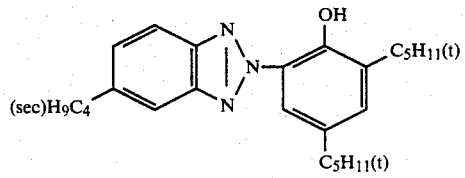

UV-9L

-continued
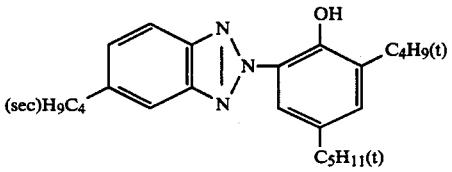
UV-10L
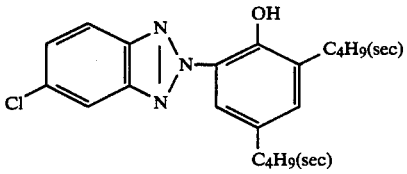
UV-11L
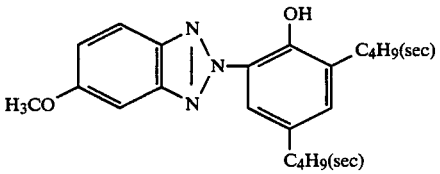
UV-12L
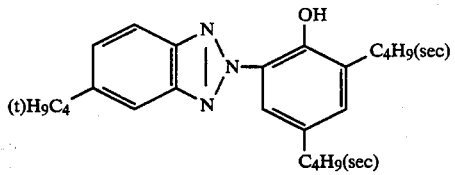
UV-13L
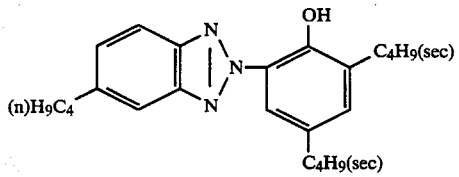
UV-14L
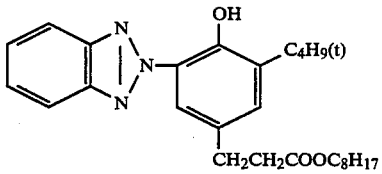
UV-15L
Next, the typical examples of the above-mentioned 2-(2'-hydroxyphenyl)benzotriazole type UV absorbing agents in the solid state at 30° C. will now be given;
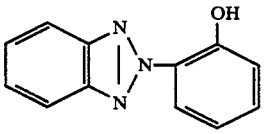
UV-1S
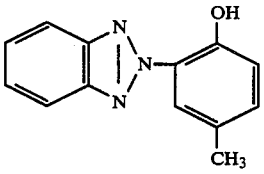
UV-2S
-continued
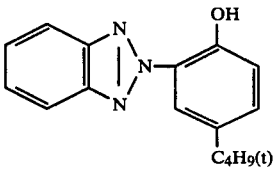
UV-3S
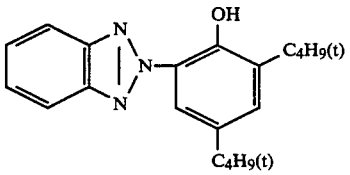
UV-4S
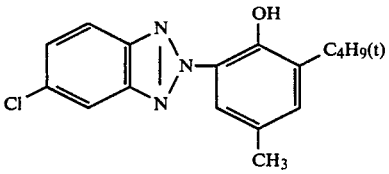
UV-5S
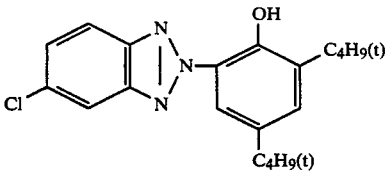
UV-6S
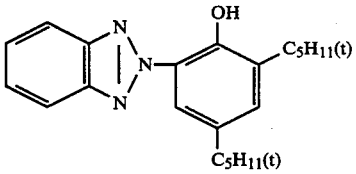
UV-7S
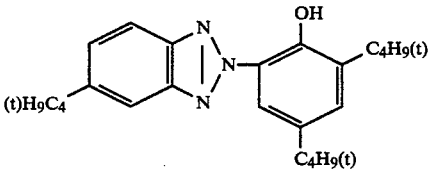
UV-8S
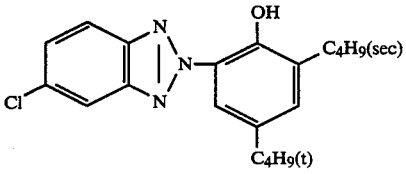
UV-9S
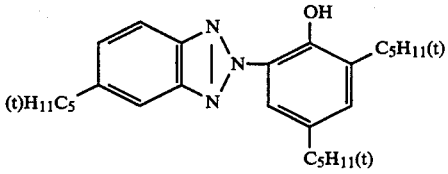
UV-10S
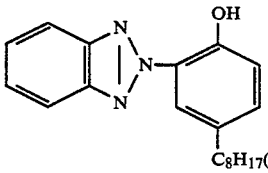
UV-11S -continued

UV-12S

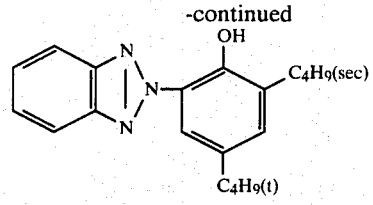

UV-13S

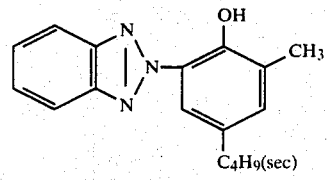

UV-14S

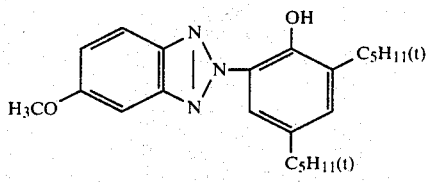

UV-15S

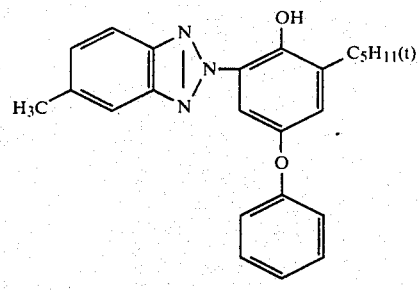

UV-16S

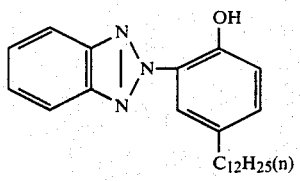

UV-17S

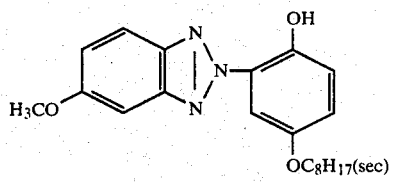

UV-18S

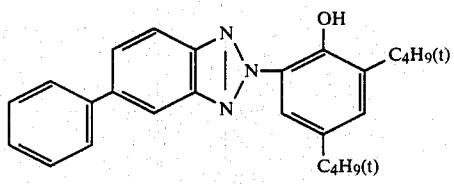

UV-19S

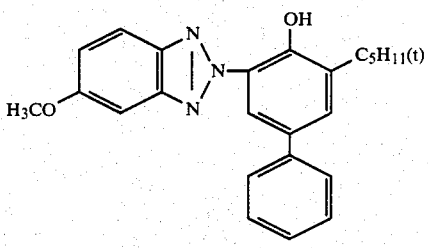

The above-mentioned liquid or solid state benzotriazole compounds are described in, for example, Japanese Patent Examined Publication Nos. 10466/1961, 26187/1967, 5496/1973 and 41572/1973; U.S. Pat. Nos. 3,754,919 and 4,220,711; International Publication No. 81-01473; European Patent Publication No. 57160; and the like.

Also, the so-called matting agents which are finely grained powder may be added into the above-mentioned non-light-sensitive layers. If this is the case, it is preferred that two of such non-light-sensitive layers are to be provided and the outermost layer thereof is to be added with such matting agents and the other layer thereof is to be contained with the UV absorbing agents represented by the aforementioned Formula [UV-I].

The addition of such matting agents are effective to prevent a haze occurrence in a long time preservation.

The term, haze, mentioned herein means a phenomenon that, when preserving a photographic light-sensitive material for a long time under a severe light, heat or humid condition, some material may cause a a lack of gloss on its surface and, for example, the visual density may be lowered in a shadow area or the misty picture may come out so as also to lower the visual sharpness.

Such matting agents include, for example, a crystalline or non-crystalline silica, titanium dioxide, magnesium oxide, calcium carbonate, barium sulfate, alumina-magnesium silicate, an acrylic acid-ethylacrylate copolymer, an acrylic acid-methylmethacrylate copolymer, an itaconic acid-styrene copolymer, a maleic acid-methylmethacrylate copolymer, a maleic acid-styrene copolymer, an acrylic acid-phenylacrylate copolymer, a polymethyl methacrylate, an acrylic acid-methacrylic acid-ethylmethacrylate copolymer, a polystyrene, a starch, a cellulose acetate propionate and the like, and besides, the compounds such as described in U.S. Pat. Nos. 1,221,980 and 2,992,101; and the like. They may be used independently or in combination.

The grain size of the above-mentioned matting agent may be preferably from 1 to 10 μm in terms of an average diameter and more preferably from 2 to 7 μm.

Such matting agents are to be dispersively incorporated into non-light-sensitive layers, and such matting agent can be incorporated thereinto in such a manner that a hydrophilic binder containing, if necessary, a nonionic, cationic or anionic surface active agent is added therein with other additives if necessary, and the resulting mixture is dispersed in an emulsification dispersion method utilizing shearing stress by making use of a hi-speed rotary mixer, a homogenizer, a ultrasonic homogenizer, a ball mill or the like, and the resulting dispersed matter is coated on a light-sensitive material in any methods being used in the photographic fields.

The matting agent is to be incorporated in the outermost layer of the non-light-sensitive layers preferably in an amount of from 0.5 to 50 mg per sq.m, and more preferably from 1 to 20 mg per sq.m.

A content of the matting agent is preferably from 0.1 to 2% by weight to a hydrophilic binder used.

The layer arrangement of the silver halide photographic light-sensitive materials relating to the invention is that at least one non-light-sensitive layer is arranged to the opposite side of the farthest silver halide emulsion layer to the support, and there is no special limitation to the layer arrangement order of the silver halide emulsion layers respectively containing a yellow, magenta and cyan couplers. It is, however, generally preferable to arrange a blue-sensitive silver halide emulsion layer containing the yellow coupler, a green-sensitive silver halide emulsion layer containing the magenta coupler and a red-sensitive silver halide emulsion layer containing the cyan coupler, in the order from the reflection type support.

Next, the compounds represented by the Formula [A] which are to be contained in the silver halide emulsion layer containing a yellow coupler will now be described below:

General Formula [A]

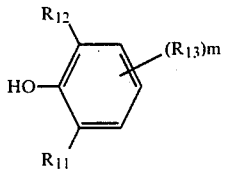

[Wherein, $R_{11}$ and $R_{12}$ represent an alkyl group, respectively; $R_{13}$ represents an alkyl group, a —NR'R" group, a —SR' group in which R' represents a monovalent organic group, or a —COOR" group in which R" represents a hydrogen atom or a monovalent organic group; and m is an integer of from 0 to 3.]

The preferable alkyl groups each represented by $R_{11}$ and $R_{12}$ in the Formula [A] include, for example, an alkyl group having from 1 to 12 carbon atoms, and the more preferable ones include, for example, an alkyl group branched in its α position having from 3 to 8 carbon atoms; and the particularly preferable groups each represented by $R_{11}$ and $R_{12}$ include, for example, a t-butyl group or a t-pentyl group.

The alkyl groups represented by $R_{13}$ are those normal chained or branch chained including, for example, a methyl group, an ethyl group, a propyl group, a butyl group, a pentyl group, an actyl group, a nonyl group, a dodecyl group, an octadecyl group, and the like.

In the case that the above-mentioned alkyl groups each have a substituent, such substituents include, for example, a halogen atom, a hydroxyl group, a nitro group, a cyano group, such an aryl group as a phenyl group, a hydroxyphenyl group, a 3,5-di-t-butyl-4-hydroxyphenyl group, a 3,5-di-t-pentyl-4-hydroxyphenyl group and the like, such as amino group as a dimethylamino group, a diethylamino group, a 1,3,5-triazinylamino group and the like, such an alkyloxycarbonyl group as a methoxycarbonyl group, an ethoxycarbonyl group, a propyloxycarbonyl group, a buthoxycarbonyl group, a pentyloxycarbonyl group, an octyloxycarbonyl group, a nonyloxycarbonyl group, a dodecyloxycarbonyl group, an octadecyloxycarbonyl group and the like, such an aryloxycarbonyl group as a phenyloxycarbonyl group and the like, such a carbamoyl group as an alkylcarbamoyl group, e.g., a methylcarbamoyl group, an ethylcarbamoyl group, a propylcarbamoyl group, a butylcarbamoyl group, a heptylcarbamoyl group and the like, an arylcarbamoyl group, e.g., a phenylcarbamoyl group and the like, a cycloalkylcarbamoyl group, e.g., a cyclohexylcarbamoyl group and the like, and such a heterocyclic group as an isocyanuryl group, 1,3,5-triazinyl group and the like.

The amino groups represented by $R_{13}$ include, for example, such an alkylamino group as a dimethylamino group, a diethylamino group, a methylethylamino group and the like, such an arylamino group as a phenylamino group, a hydroxylphenylamino group and the like, such a cycloalkylamino group as a cyclohexyl group and the like, such a heterocyclic amino group as a 1,3,5-triazinylamino group, an isocyanuryl group and the like.

The monovalent organic groups represented by R' and R" include, for example, such an alkyl group as a methyl group, an ethyl group, a propyl group, a butyl group, an amyl group, a decyl group, a dodecyl group, a hexadecyl group, an actadecyl group and the like, such an aryl group as a phenyl group, a naphthyl group and the like, such a cycloalkyl group as a cyclohexyl group and the like, ans such a heterocyclic group as a 1,3,5-triazinyl group, an isocyanuryl group and the like.

In the case that the above-mentioned organic groups have a substituent, such substituents include, for example, such a halogen atom as a fluorine atom, a chlorine atom, a bromine atom and the like, a hydroxyl group, a nitro group, a cyano group, an amino group, such an alkyl group as a methyl group, an ethyl group, an i-propyl group, a t-butyl group, a t-amyl group and the like, such an aryl group as a phenyl group, a tolyl group and the like, such an alkenyl group as an alyl group and the like, such an alkylarbonyloxy group as a methylcarbonyloxy group, an ethylcarbonyloxy group, a benzylcarbonyloxy group and the like, such an arylcarbonyloxy group as a benzoyloxy group and the like.

In this invention, the preferable compounds represented by the aforegiven Formula [A] include, for example, those represented by the following Formulas [A'], [A"] and [A'"]:

General Formula [A']

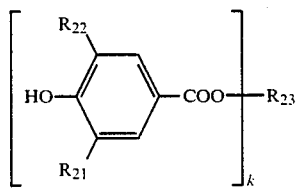

[wherein, $R_{21}$ and $R_{22}$ represent a normal chained or branch chained alkyl group having 3 to 8 carbon atoms and more particularly a t-butyl group and a t-pentyl group; $R_{23}$ represents a k valent organic group; and k is an integer of from 1 to 6.]

The k valent organic groups represented by $R_{23}$ include, for example, such an alkyl group as a methyl group, an ethyl group, a propyl group, a butyl group, a pentyl group, an octyl group, a hexadecyl group, a methoxyethyl group, a chloromethyl group, a 1,2-dibromethyl group, a 2-chloroethyl group, a benzyl group, a phenethyl group and the like, such an alkenyl group as an allyl group, a propenyl group, a butenyl group and the like, such a polyvalent unsaturated hydrocarbon group as a glyceryl group, a diglyceryl group, a pentaerythritol group, a dipentaerythritol group and the like, such an alicyclic hydrocarbon group as a cyclopropyl group, a cyclohexyl group, a cyclohexenyl group and the like, such an aryl group as a phenyl group, a p-octylphenyl group, a 2,4-dimethylphenyl group, a 2,4-di-t-butylphenyl group, a 2,4-di-t-phenylphenyl group, a p-chlorophenyl group, a 2,4-dibromophenyl group, a naphthyl group and the like, such an arylene group as a 1,2-, 1,3- or 1,4-phenylene group, a 3,5-dimethyl-1,4-phenylene group, a 2-t-butyl-1,4-phenylene group, a 2-chloro-1,4-phenylene group, a naphthalene group and the like, a 1,3,5-trisubstituted benzene group and the like.

$R_{23}$ also includes, besides the above-mentioned groups, a k valent organic group coupled to anyone of the above-mentioned groups through an —O—, —S— or —$SO_2$ group.

The further preferable groups represented by $R_{23}$ include, for example, a 2,4-di-t-butylphenyl group, a 2,4-di-t-pentylphenyl group, a p-octylphenyl group, a p-dodecylphenyl group, a 3,5-di-t-butyl-4-hydroxylphenyl group, and a 3,5-di-t-pentyl-4-hydroxylphenyl group.

The preferable k is an integer of from 1 to 4.

General Formula [A'']

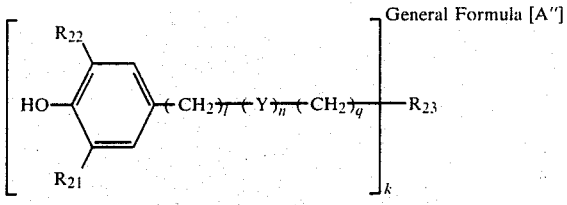

[wherein, $R_{21}$ through $R_{23}$ and k are the same as those represented in the Formula [A']; Y represents a divalent organic group; 1 is a positive integer; and n and q are zero or a positive integer.]

The divalent organic groups represented by Y include, for example, such an arylene group as a phenylene group, an oxycarbonyl group, a carbonyloxy group, a sulfonyl group, an amino group, a sulfonamido group, a sulfamoyl group, an acylamino group, a carbamoyl group and the like.

General Formula [A''']

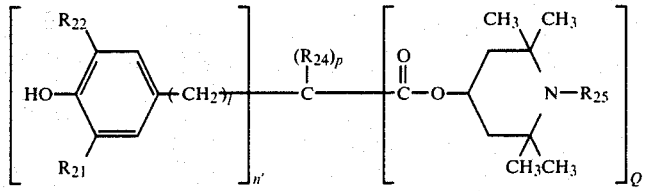

[wherein, $R_{21}$ and $R_{22}$ are synonymous with those represented in Formula [A']; 1 is synonymous with those represented in Formula [A'']; $R_{24}$ and $R_{25}$ represent a hydrogen atom, such an alkyl group as a methyl group, an ethyl group, a propyl group, a butyl group, a pentyl group, a benzyl group and the like, such an alkenyl group as a vinyl group, an allyl group, an isopropenyl group and the like, such an alkinyl group as an ethynyl group, a propenyl group and the like, and such an acyl group as a formyl group, an acetyl group, a propionyl group, a butyryl group, an acryloyl group, a propioloyl group, a methacryloyl group, a crotonoyl group and the like; n' and Q each are an integer of from 1 to 3, respectively; and p is an integer of from 0 to 2; provided that n'+Q+p is 4.]

The preferable groups represented by $R_{24}$ and $R_{25}$ include, for example, a methyl group, an ethyl group, a vinyl group, an allyl group, a propynyl group, a benzyl group, an acetyl group, a propionyl group, an acryloyl group, a methacryloyl group, and a crotonoyl group.

The typical examples of the compounds represented by the Formula (A) will be given below:

(A-1)

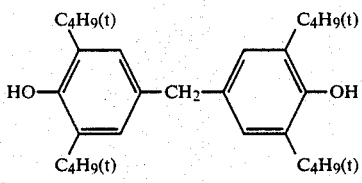

(A-2)

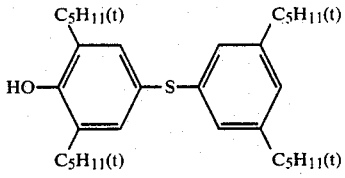

(A-3)

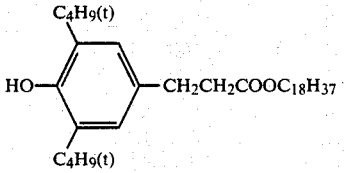

(A-4)

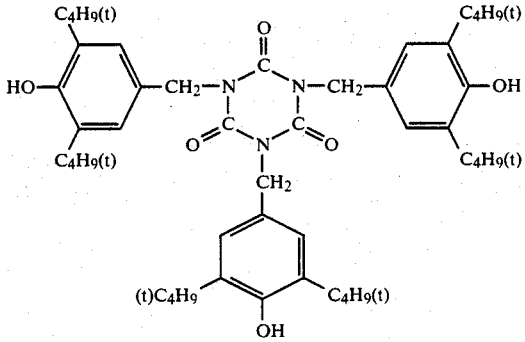

(A-5)

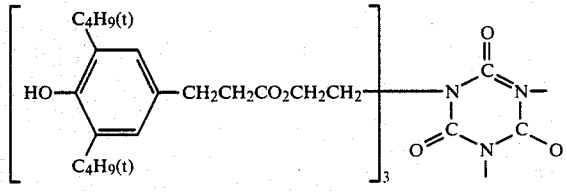

-continued
(A-6)
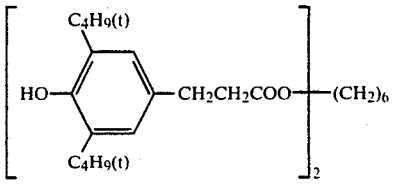
(A-7)
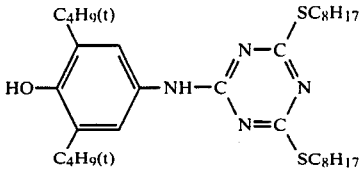
(A-8)
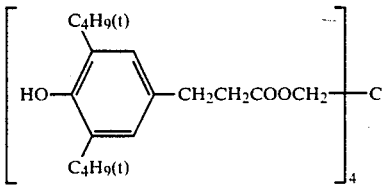
(A-9)
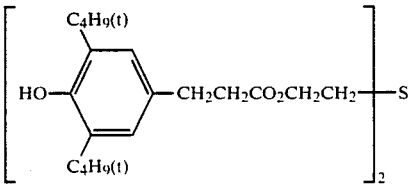
(A-10)
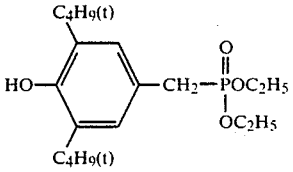
(A-11)
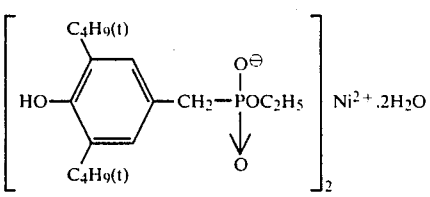
(A-12)
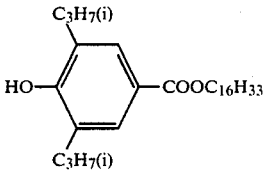
(A-13)
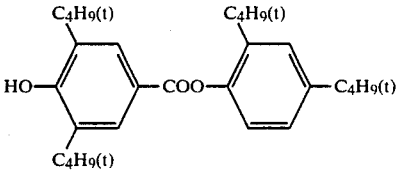
(A-14)
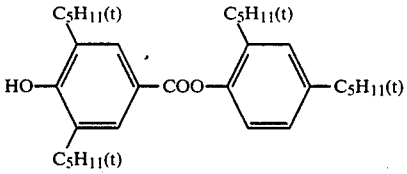
(A-15)
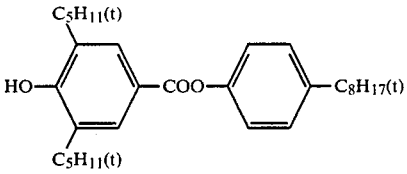
(A-16)
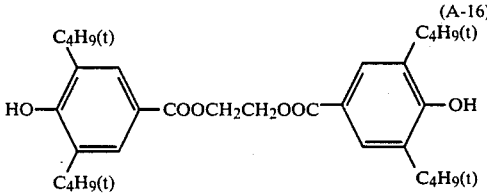
(A-17)
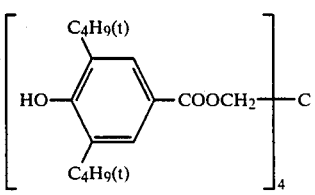
(A-18)
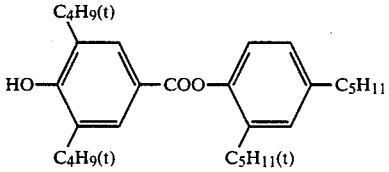
(A-19)
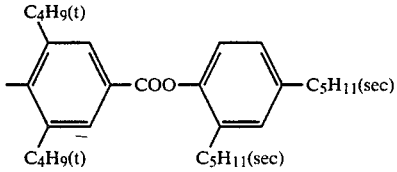
(A-20)
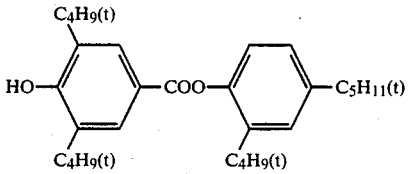
(A-21)
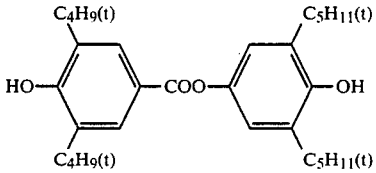

-continued
(A-22)
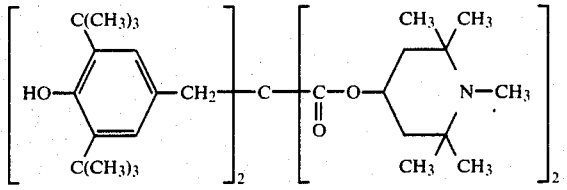
(A-23)
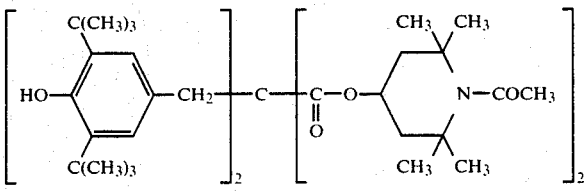
(A-24)
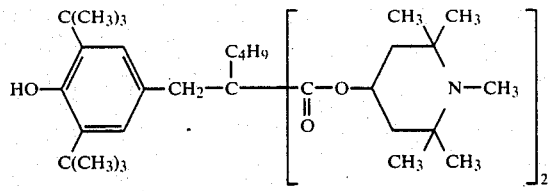
(A-25)
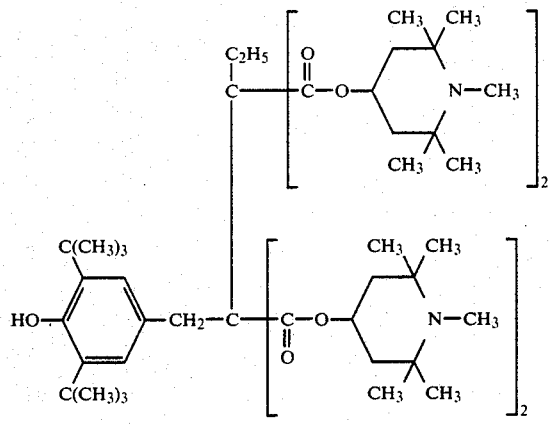
(A-26)
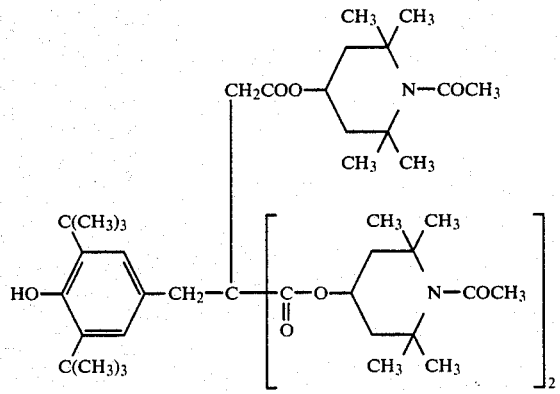

-continued (A-27)

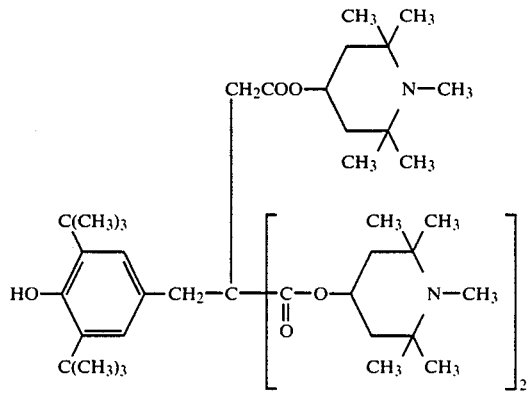

(A-28)

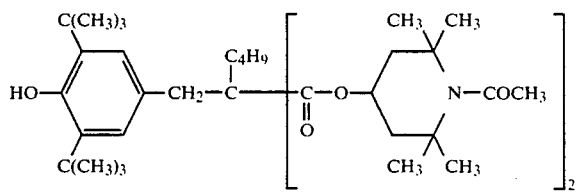

(A-29)

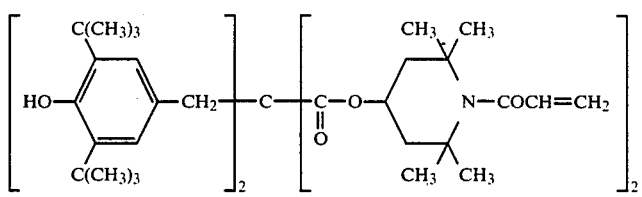

(A-30)

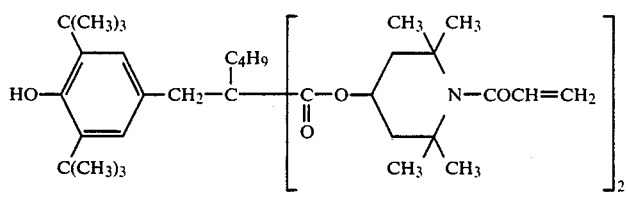

(A-31)

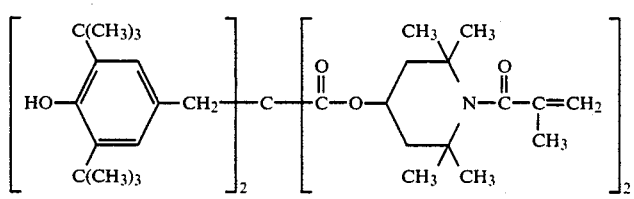

(A-32)

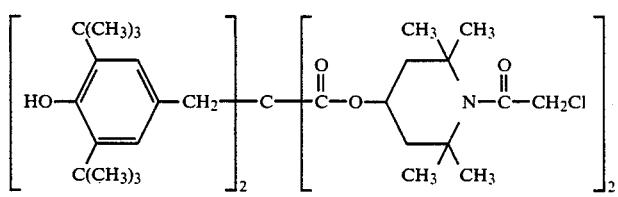

An amount of the compounds represented by the Formula [A] to be added is from 5 to 300 parts by weight and more preferably from 10 to 100 parts by weight to 100 parts by weight of the yellow couplers to be coated on.

How to add the compounds may be the same as that of the afore-mentioned UV absorbing agents.

Next, the yellow couplers will be described.

Various types of yellow couplers can be served as the yellow couplers relating to the invention for forming a dye image without limitation. However, the couplers represented by the following Formula [B] may be used as the yellow dye image forming couplers:

Formula [B]

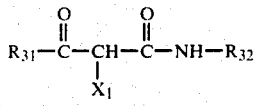

Wherein $R_{31}$ represents an alkyl or aryl group; $R_{32}$ represents an aryl group; and $X_1$ represents a hydrogen atom or a group capable of splitting off in the course of a color developing reaction. $R_{31}$ includes, for example, a normal chained or branched chained alkyl group such as a butyl group or a normal chained or branched chained aryl group such as a phenyl group, more preferably, the former group, and in particular a t-butyl group; and $R_{32}$ includes, for example, an aryl group and more preferably a phenyl group. Such alkyl groups and aryl groups represented by $R_{31}$ and $R_{32}$ include those having a substituent. It is preferable that the aryl groups represented by $R_{32}$ are substituted by a halogen atom, an alkyl group or the like. $X_1$ includes preferably the groups represented by the following Formula [C] or [D] and more preferably the groups represented by the following Formula [C'] of the Formula [C]:

Formula [C]

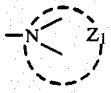

Wherein $Z_1$ represents a group of nonmetal atoms capable of forming a 4-membered to 7-membered ring.

Formula [D]

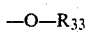

Wherein $R_{33}$ represents an aryl group, a heterocyclic group or an acyl group, and among them the aryl groups are preferred.

Formula [C']

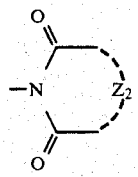

Wherein $Z_2$ represents a group of nonmetal atoms capable of forming, together with

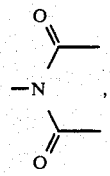

a 4-membered to 6-membered ring.

In the Formula [B], the preferable yellow couplers relating to the invention are represented by the following Formula [B']:

General Formula [B']

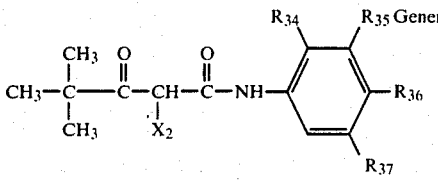

Wherein $R_{34}$ represents a hydrogen atom, a halogen atom or an alkoxy group and, among them, a halogen atom is preferred; $R_{35}$, $R_{36}$ and $R_{37}$ represent a hydrogen atom, a halogen atom, an alkyl group, an alkenyl group, an alkoxy group, an aryl group, a carboxy group, an alkoxycarbonyl group, a carbamyl group, a sulfon group, a sulfamyl group, an alkylsulfonamido group, an acylamido group, a ureido group or an amino group, respectively, and it is preferable that $R_{35}$ and $R_{36}$ are hydrogen atoms, respectively, and $R_{37}$ is an alkoxycarbonyl, acylamido or alkylsulfonamido group; and $X_2$ represents a group synonymous with those represented in the aforegiven Formula [B], preferably a group represented by the Formula [C] or [D], and more preferably a group represented by the aforegiven Formula [C'].

In the Formula [B], the other preferable yellow couplers relating to the invention, besides the above, are represented by the following Formula [B'']:

Formula [B'']

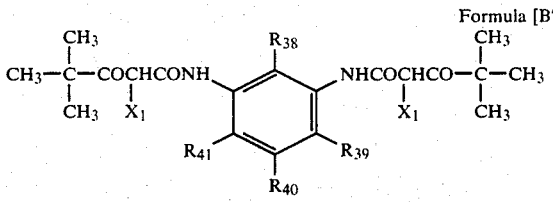

Wherein $R_{38}$ represents a group synonymous with those represented by $R_{34}$ in the aforegiven Formula [B']; $R_{39}$, $R_{40}$ and $R_{41}$ represent a hydrogen atom, a halogen atom, an alkyl group, an alkenyl group, an alkoxy group, an aryl group, a carboxyl group, an alkoxycarbonyl group, a carbamyl group, a sulfon group, a sulfamyl group, a sulfonamido group, an acylamido group, a ureido group or an amino group; and X represents a group synonymous with the groups represented in the Formula [B'].

Such yellow couplers may be added to any silver halide emulsion layers, however, more preferably to a blue-sensitive silver halide emulsion layer. An amount of the yellow couplers to be added is preferably from $2\times10^{-3}$ to $5\times10^{-1}$ mol and more preferably from $1\times10^{-2}$ to $5\times10^{-1}$ mol per mol of silver.

The typical examples of the yellow couplers relating to the invention will be given below. It is, however, to be understood that the invention shall not be limited thereto.

(Y-1)
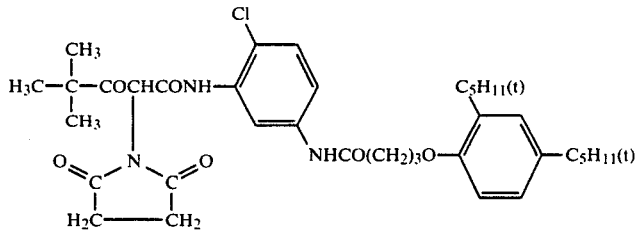
(Y-2)
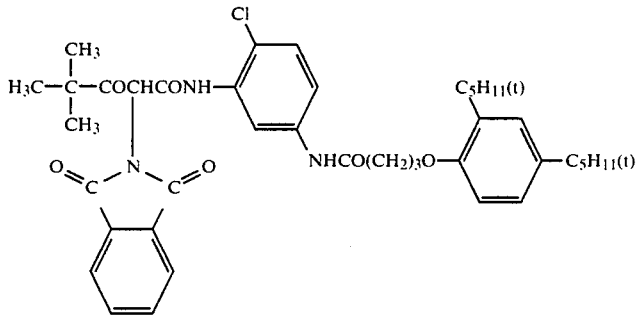
(Y-3)
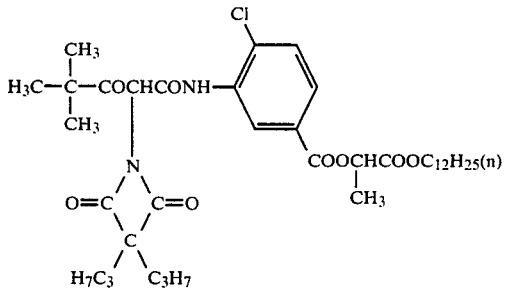
(Y-4)
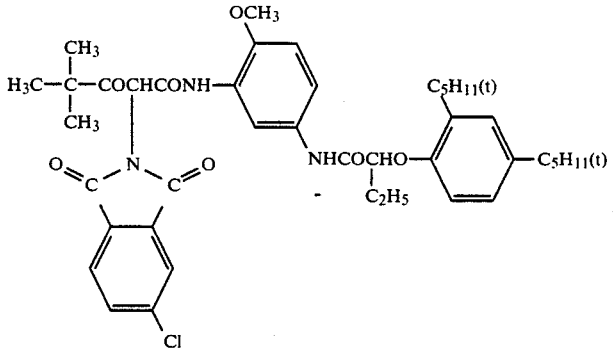
(Y-5)
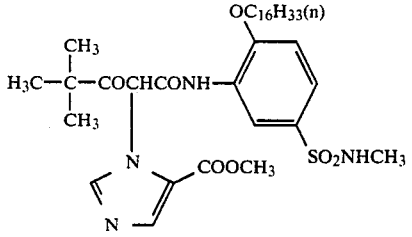

-continued
(Y-6)
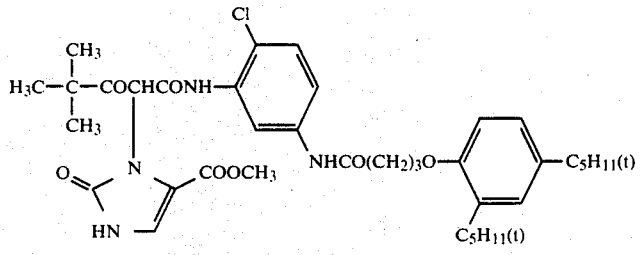
(Y-7)
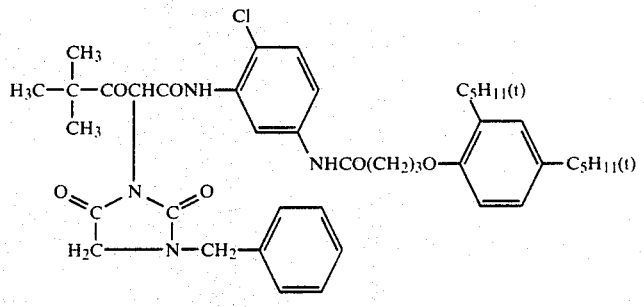
(Y-8)
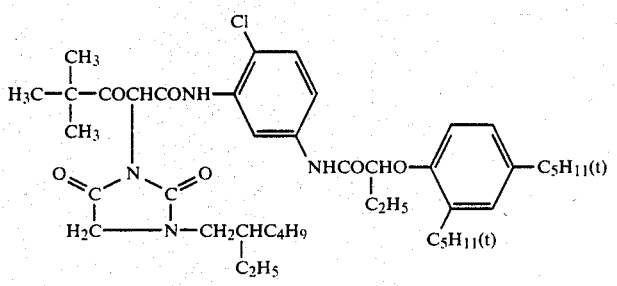
(Y-9)
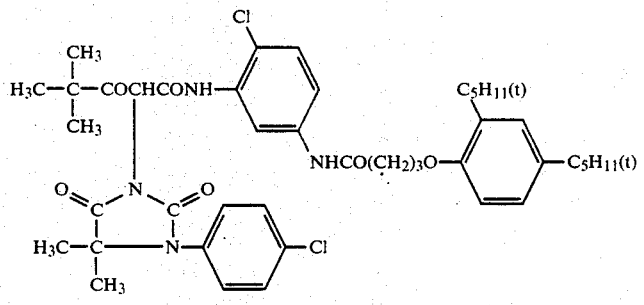
(Y-10)
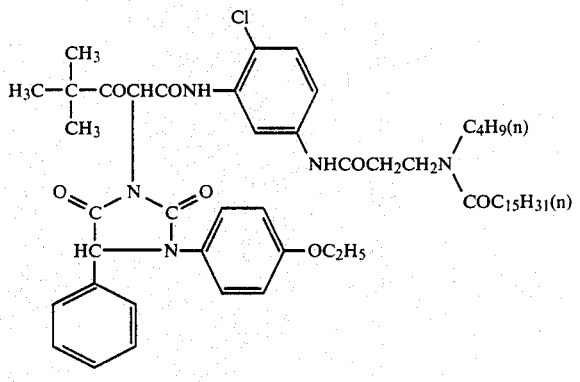

-continued
(Y-11)
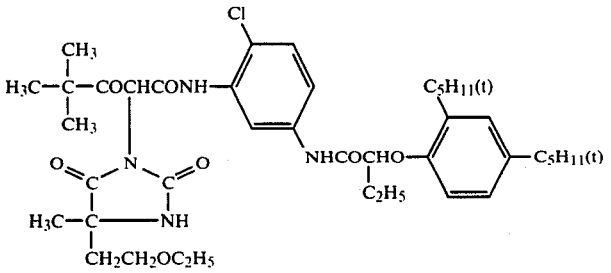
(Y-12)
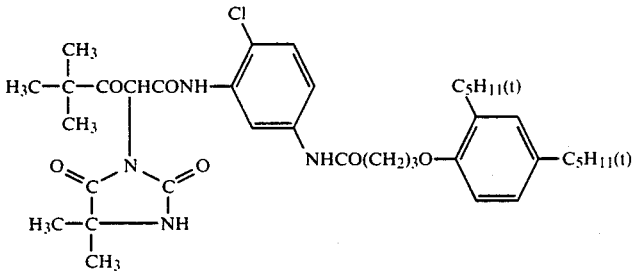
(Y-13)
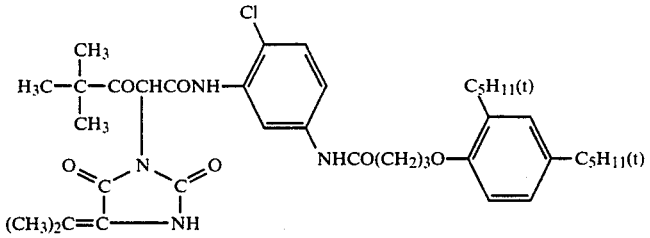
(Y-14)
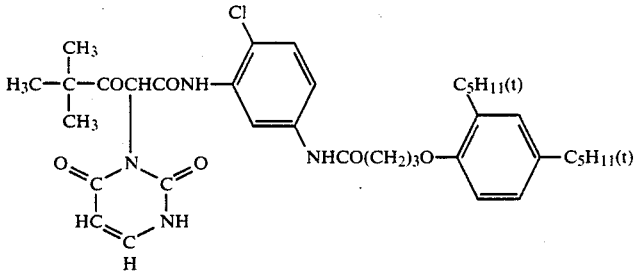
(Y-15)
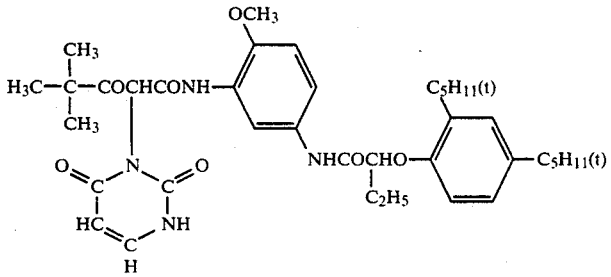
(Y-16)
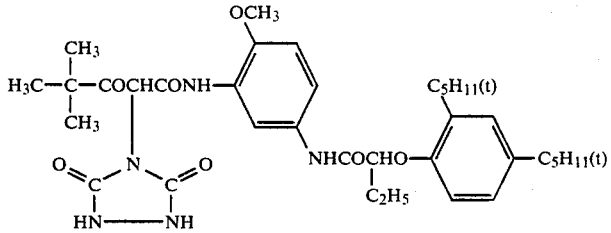

-continued
(Y-17)
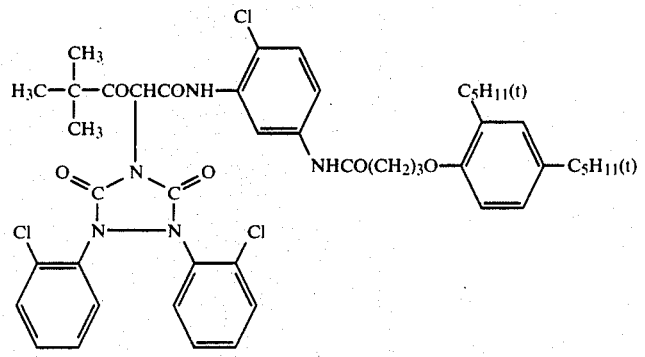
(Y-18)
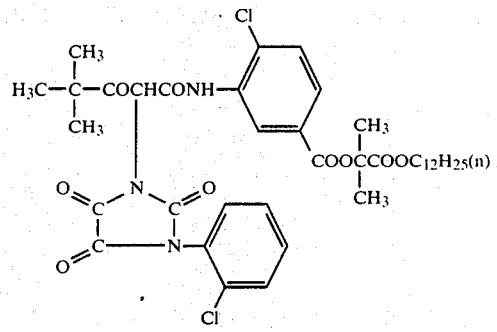
(Y-19)
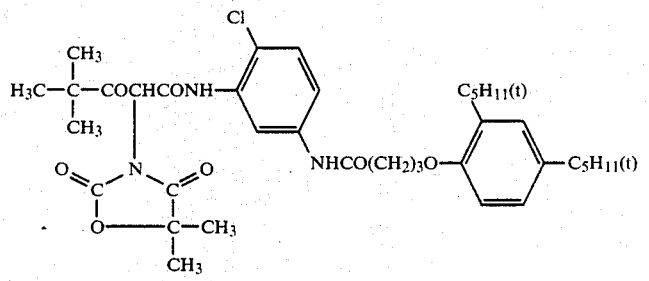
(Y-20)
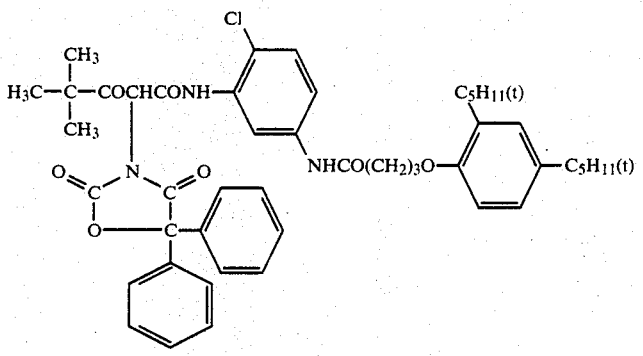
(Y-21)
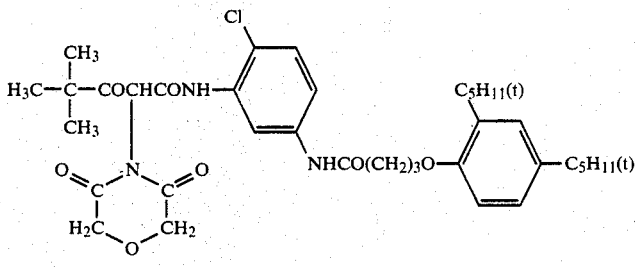

-continued
(Y-22)
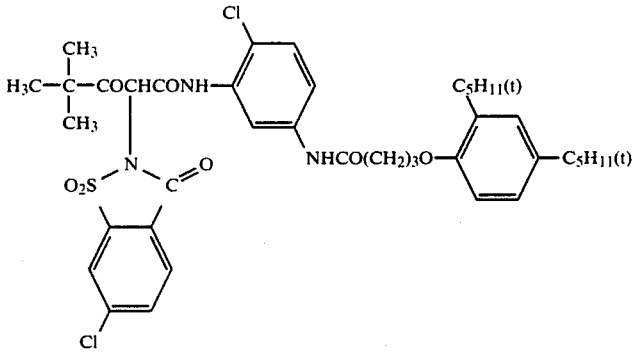
(Y-23)
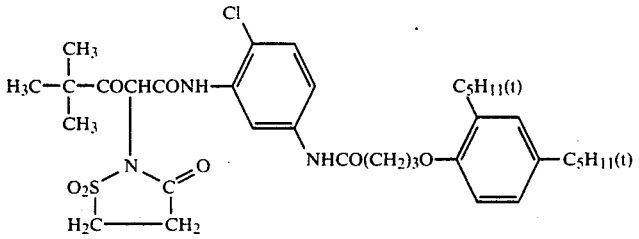
(Y-24)
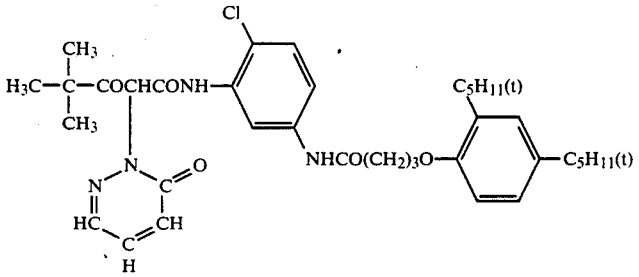
(Y-25)
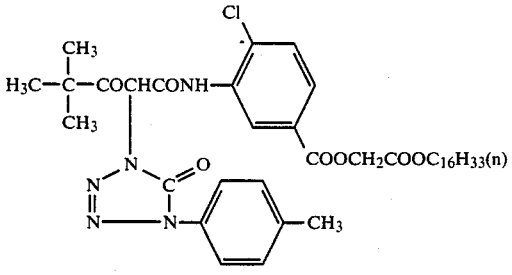
(Y-26)
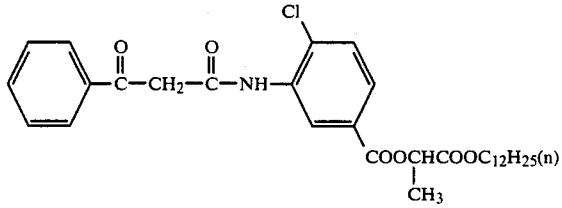
(Y-27)
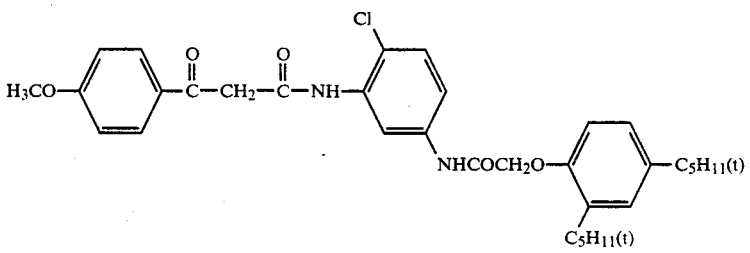

-continued
(Y-28)
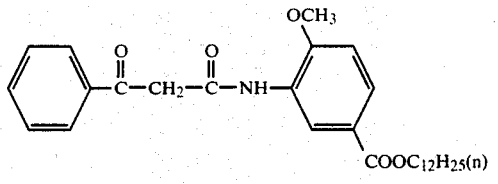
(Y-29)
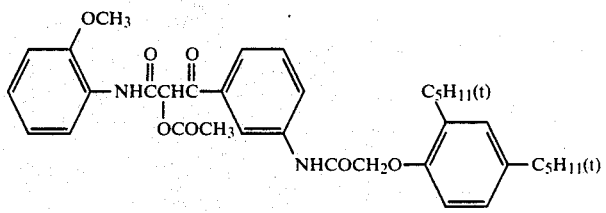
(Y-30)
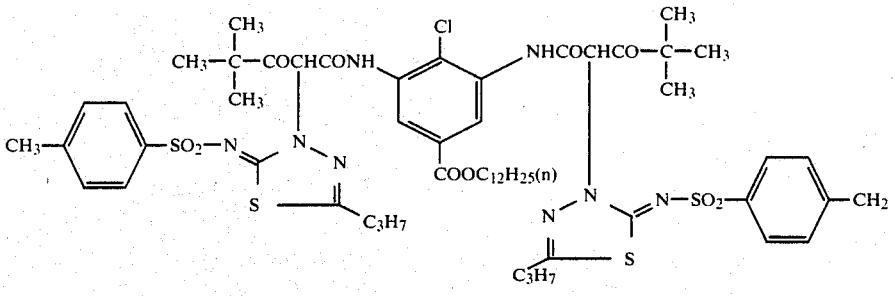
(Y-31)
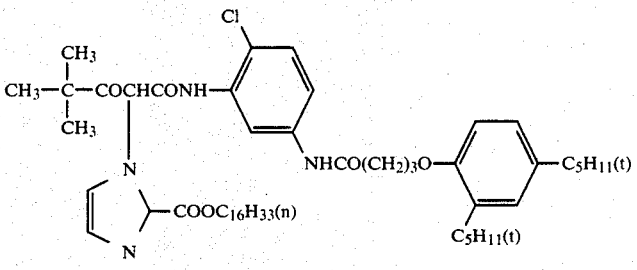
(Y-32)
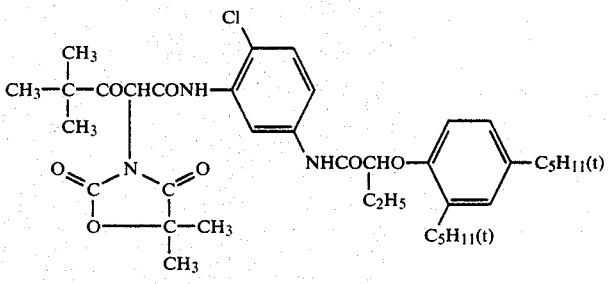
(Y-33)
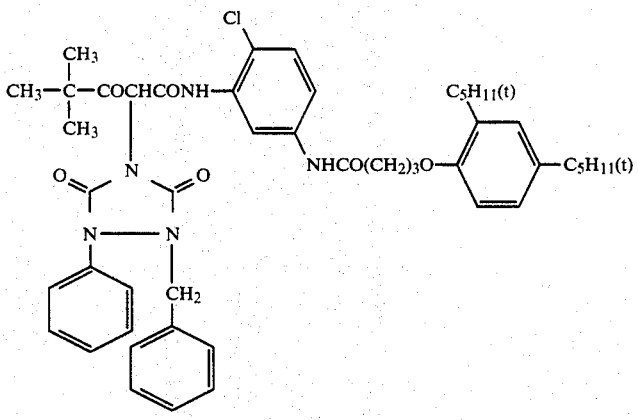

-continued
(Y-34)
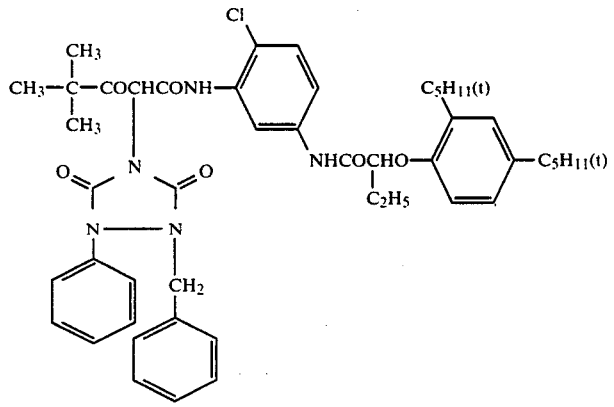
(Y-35)
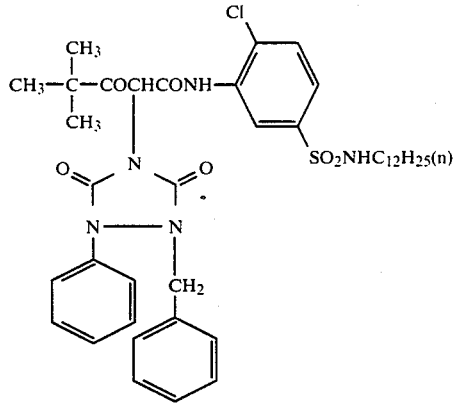
(Y-36)
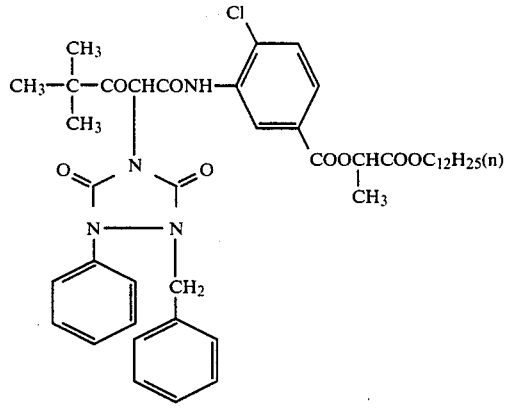
(Y-37)
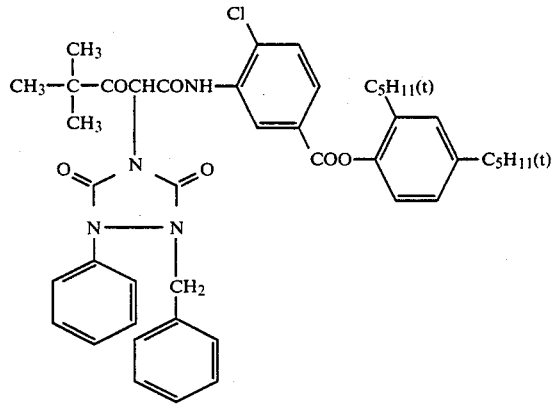

-continued
(Y-38)
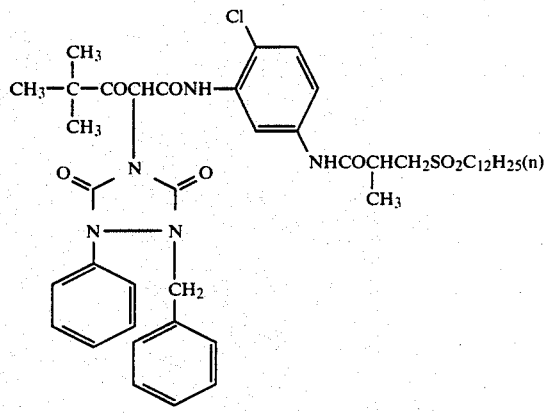
(Y-39)
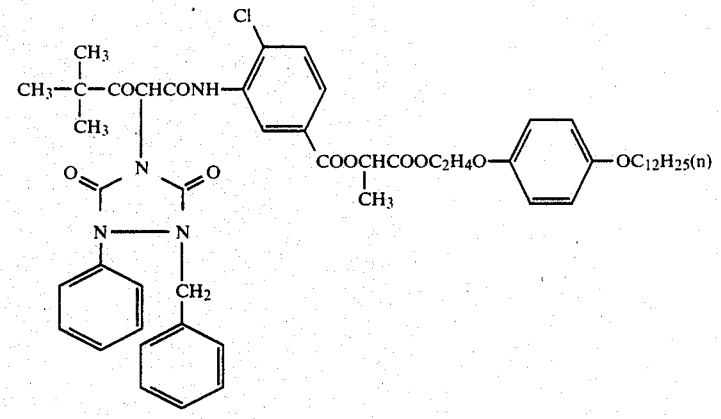
(Y-40)
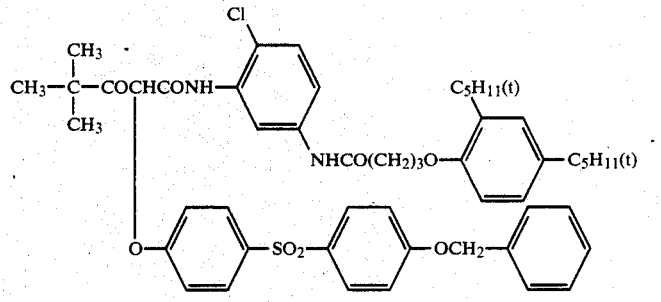
(Y-41)
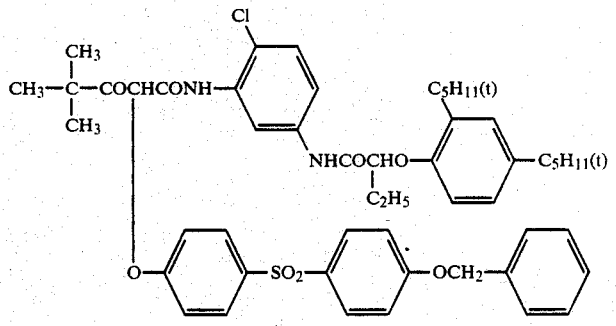

-continued
(Y-42)
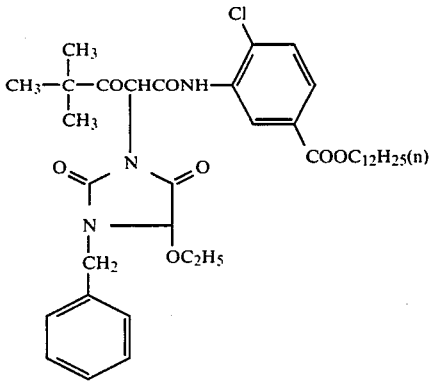
(Y-43)
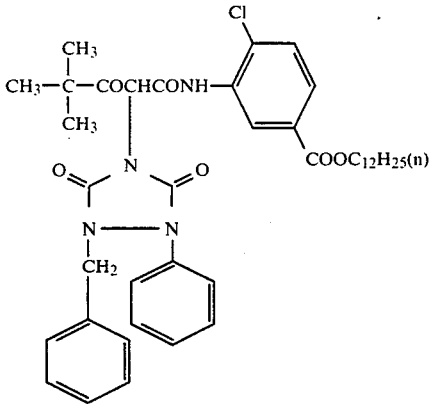
(Y-44)
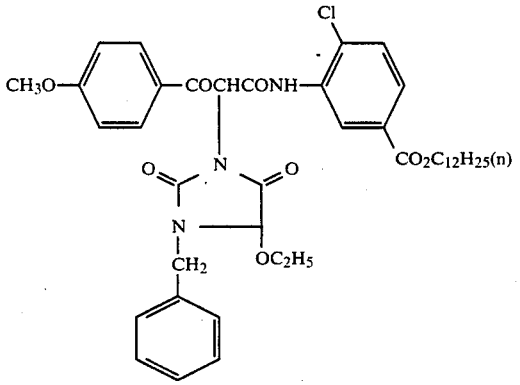
(Y-45)
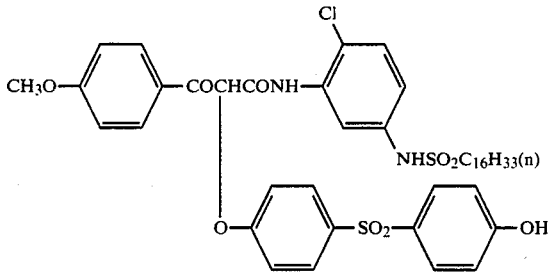

-continued
(Y-46)
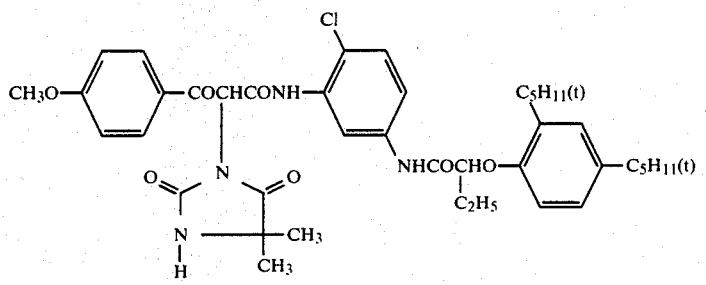
(Y-47)
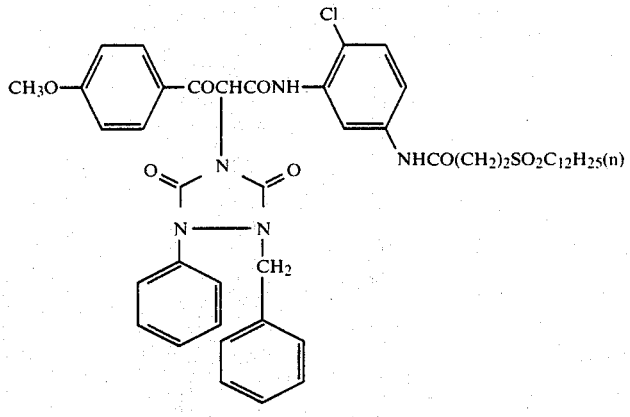
(Y-48)
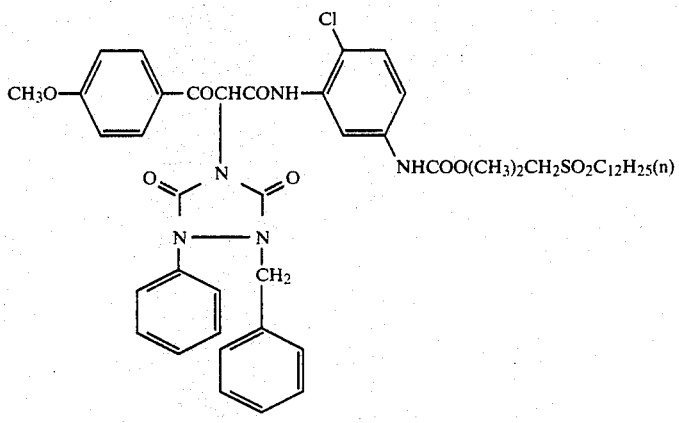
(Y-49)
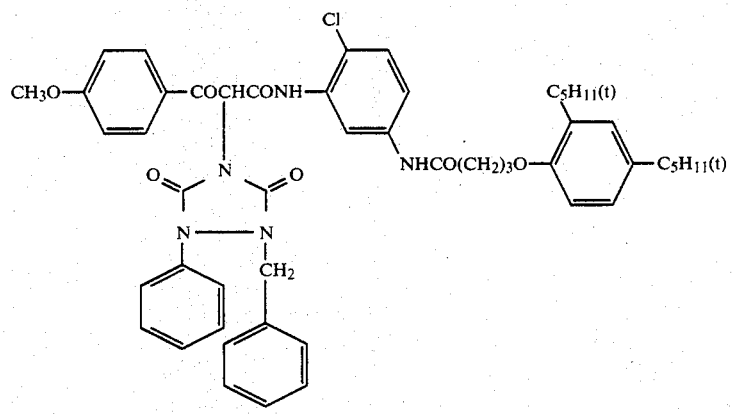

-continued
(Y-50)
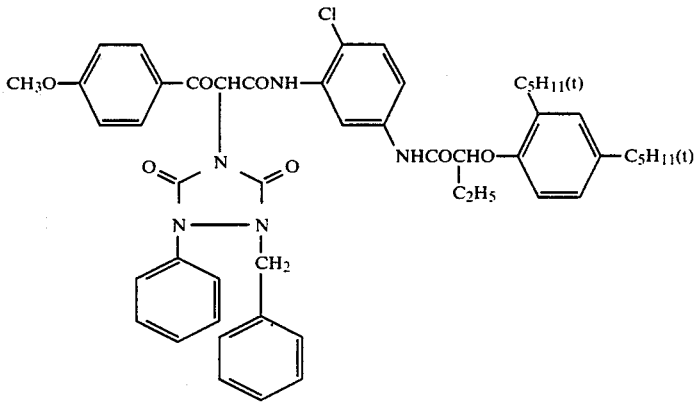
(Y-51)
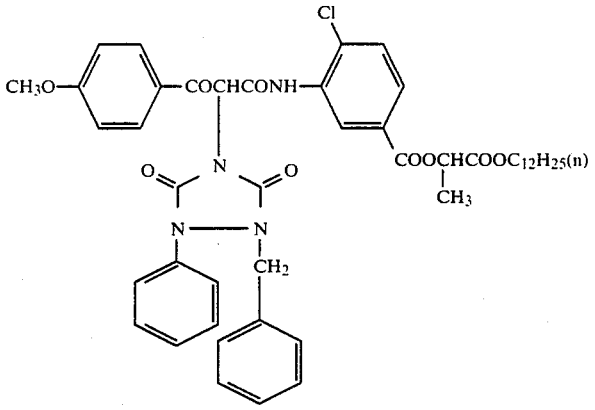
(Y-52)
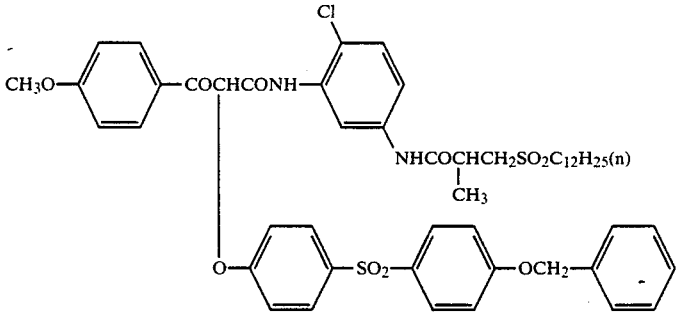
(Y-53)
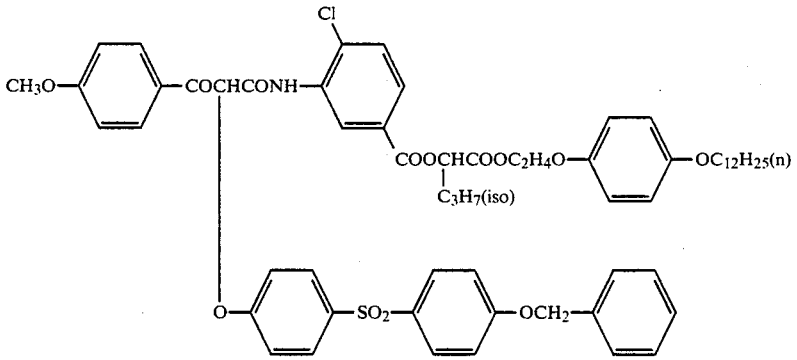

-continued
(Y-54)
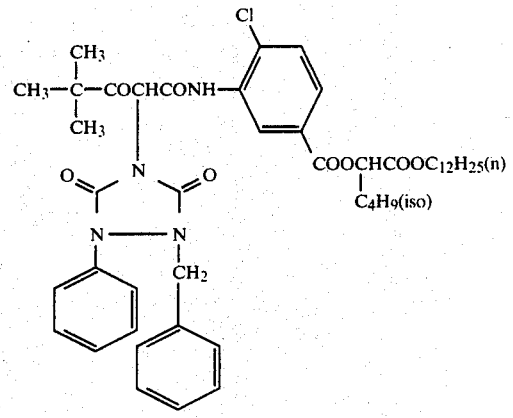
(Y-55)
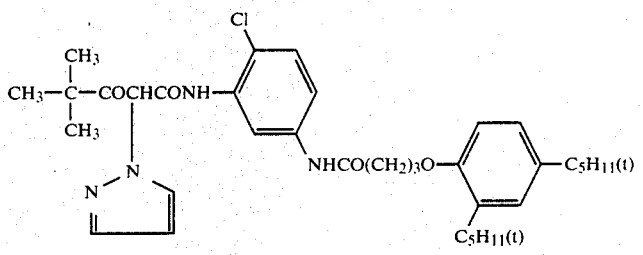
(Y-56)
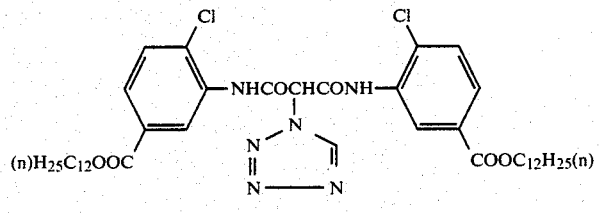
(Y-57)
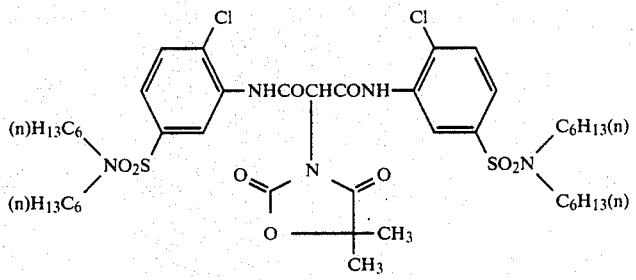
(Y-58)
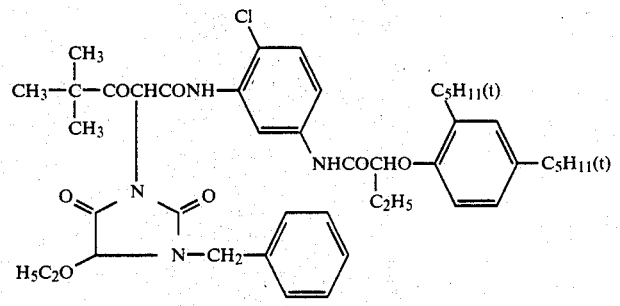
The cyan image forming couplers represented by the following Formula [E] or [F] may preferably be used:

Formula [E]

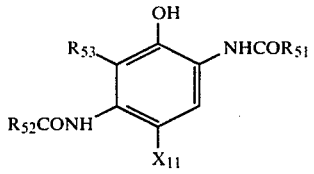

Wherein $R_{51}$ represents an aryl group, a cycloalkyl group or a heterocyclic group; $R_{52}$ represents an alkyl group or a phenyl group; $R_{53}$ represents a hydrogen atom, a halogen atom, an alkyl group or an alkoxy group; and $X_{11}$ represents a hydrogen atom, or a substituent capable of splitting off through the reaction thereof with the oxidation products of an aromatic primary amine color developing agent.

Formula [F]

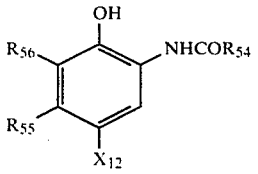

Wherein $R_{54}$ represents such an alkyl group as a methyl group, an ethyl group, a propyl group, a butyl group, a nonyl group or the like; $R_{55}$ represents such an alkyl group as a methyl group, an ethyl group or the like; $R_{56}$ represents a hydrogen atom, such a halogen atom as a fluorine, chlorine, bromine or like atom; and $X_{12}$ represents a hydrogen atom, or a substituent capable of splitting off through the reaction thereof with the oxidation products of an aromatic primary amine color developing agent.

In the invention, the groups represented by $R_{51}$ in the Formula [E] include, for example, a phenyl group and a naphthyl group and more preferably the phenyl groups. The heterocyclic groups represented by $R_{51}$ include, for example, a pyridyl group, a furan group and the like. The cycloalkyl groups represented by $R_{51}$ include, for example, a cyclopropyl group, a cyclohexyl group and the like. The above-mentioned groups represented by $R_{51}$ are allowed to have a single or a plurality of substituents. For example, the substituents capable of being introduced into a phenyl group typically include such a halogen atom as a fluorine, chlorine, bromine or like atom, such an alkyl group as a methyl, ethyl, dodecyl or like group, a hydroxyl group, a cyano group, such an alkoxy group as a methoxy, ethoxy or like group, such an alkylsulfonamido group as a methylsulfonamido, octylsulfonamido or like group, such an arylsulfonamido group as a phenylsulfonamido, naphthylsulfonamido or like group, such an alkylsulfamoyl group as a butylsulfamoyl or like group, such an arylsulfamoyl group as a phenylsulfamoyl or like group, such an alkyloxycarbonyl group as a methyloxycarbonyl or like group, such an aryloxycarbonyl group as a phenyloxycarbonyl or like group, an aminosulfonamido group, an acylamino group, a carbamoyl group, a sulfonyl group, a sulfinyl group, a sulfoxy group, a sulfo group, an aryloxy group, an alkoxy group, a carboxyl group, an alkylcarbonyl group, an arylcarbonyl group, an aminocarbonyl group and the like groups. Two or more kinds of these substituents may be substituted to a phenyl group. The preferable groups represented by $R_{51}$ include, for example, a phenyl group, a halogen atom, or a phenyl group having one or not less than two substituents including an alkylsulfonamido group, an arylsulfonamido group, an alkylsulfamoyl group, an arylsulfamoyl group, an alkylsulfonyl group, an arylsulfonyl group, an alkylcarbonyl group, an arylcarbonyl group or a cyano group.

The alkyl groups represented by $R_{52}$ are of the normal chained or branch chained including, for example, a methyl group, an ethyl group, a propyl group, a butyl group, an octyl group and the like groups.

In the invention, the preferable cyan couplers represented by the Formula [E] include the compounds represented by the following Formula [E']:

Formula [E']

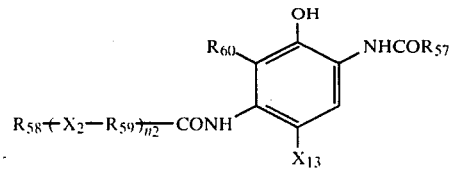

Wherein $R_{57}$ represents a phenyl group.

The above-mentioned phenyl groups are allowed to have a single or a plurality of substituents. Such substituents which are to be introduced thereinto typically include, for example, such a halogen atom as a fluorine, chlorine, bromine or like atoms, such an alkyl group as a methyl group, an ethyl group, a propyl group, a butyl group, an octyl group, a dodecyl group or the like, a hydroxyl group, a cyano group, a nitro group, such an alkoxy group as a methoxy group, an ethoxy group or the like, such an alkylsulfonamido group as a methylsulfonamido group, an octylsulfonamido group or the like, such an arylsulfonamido group as a phenylsulfonamido group, a naphthylsulfonamido group or the like, such an alkylsulfamoyl group as a butylsulfamoyl group or the like, such an arylsulfamoyl group as a phenylsulfamoyl group or the like, such an alkyloxycarbonyl group as a methyloxycarbonyl group or the like, and such an aryloxycarbonyl group as a phenyloxycarbonyl group or the like. Two or more kinds of these substituents may be substituted to a phenyl group.

The preferable groups represented by $R_{57}$ include, for example, a phenyl group, a halogen atom preferably including a fluorine or bromine atom, or a phenyl group having one or not less than two substituents which are an alkylsulfonamido group preferably including an o-methylsulfonamido group, a p-octylsulfonamido group and an o-dodecylsulfonamido group, an arylsulfonamido group preferably including a phenylsulfonamido group, an alkylsulfamoyl group preferably including a butylsulfamoyl group, an arylsulfamoyl group preferably including a phenylsulfamoyl group, an alkyl group preferably including a methyl group and a trifluoromethyl group, and an alkoxy group preferably including a methoxy group and an ethoxy group.

$R_{58}$ includes an alkyl or aryl group. Such alkyl or aryl groups are allowed to have a single or a plurality of substituents. Such substituents typically include, for example, such a halogen atom as a fluorine, chlorine, bromine or like atom, a hydroxyl group, a carboxyl group, such an alkyl group as a methyl, ethyl, propyl, butyl, octyl, dodecyl or like group, an aralkyl group, a cyano group, a nitro group, such an alkoxy group as a methoxy group, or an ethoxy group, an aryloxy group, such an alylsulfonamido group as a methylsulfonamido group, an octylsulfonamido group or the like, such an arylsulfonamido group as a phenylsulfonamido group, a naphthylsulfonamido group or the like, such an alkylsulfamoyl group as a butylsulfamoyl group or the like, such an arylsulfamoyl group as a phenylsulfamoyl group or the like, such an alkyloxycarbonyl group as a methyloxycarbonyl group or the like, such an aryloxycarbonyl group as a phenyloxycarbonyl group or the like, such an aminosulfonamido group as a dimethylaminosulfonamido group or the like, an alkylsulfonyl group, an arylsulfonyl group, an alkylcarbonyl group, an arylcarbonyl group, an aminocarbonylamido group, a carbamoyl group, a sulfinyl group and the like groups. Two or more kinds of the above-mentioned substituents may be introduced.

The preferable groups represented by $R_{59}$ include, for example, an alkyl group provided that n=o and an aryl group provided that n=1 or n<1. The more preferable groups represented by $R_{58}$ include, for example, such an alkyl group as, preferably, a methyl, ethyl, propyl, butyl, octyl or dodecyl group each having 1 to 22 carbon atoms provided that $n_2$ is o, and a phenyl group or a phenyl group having one or not less than two substituents including, for example, such an alkyl group as preferably a t-butyl, t-amyl or octyl group, such an alkylsulfonamido group as preferably a butylsulfonamido, octylsulfonamido or dodecylsulfonamido group, such an arylsulfonamido group as preferably a phenylsulfonamido group, such an aminosulfonamido group as preferably a dimethylaminosulfonamido group, and such an alkyloxycarbonyl group as preferably a methyloxycarbonyl or butyloxycarbonyl group provided that $n_2$ is not less than 1.

$R_{59}$ represents a normal chained or branch chained alkylene group having 1 to 20 carbon atoms and more preferably those having 1 to 12 carbon atoms.

$R_{60}$ represents a hydrogen atom or such a halogen atom as a fluorine, chlorine, bromine or iodine atom, and more preferably a hydrogen atom.

$n_2$ is 0 or a positive integer and preferably 0 or 1.

X represents a divalent group of —O—, —CO—, —COO—, —OCO—, —$SO_2NR''$—, —$NR'SO_2NR''$—, —S—, —SO— or —$SO_2$ group, in which R' and R'' represent a substituted or unsubstituted alkyl group. The preferable groups represented by X include a —O—, —S—, —SO— or —$SO_2$— group.

$X_{13}$ represents a hydrogen atom or a substituent capable of splitting off through the reaction thereof with the oxidation products of an aromatic primary amine color developing agent and more preferably a chlorine or fluorine atom.

The typical examples of the cyan couplers represented by the Formula [E] will now be given below. It is, however, to be understood that the invention shall not be limited thereto.

(CI-1)

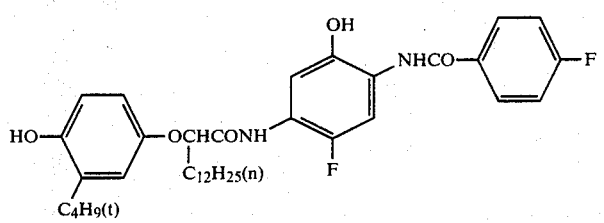

(CI-2)

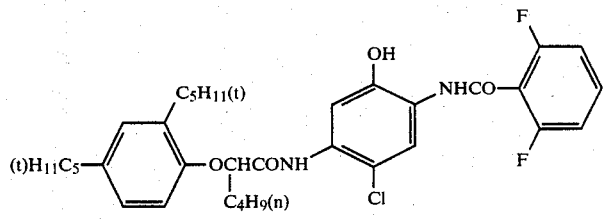

(CI-3)

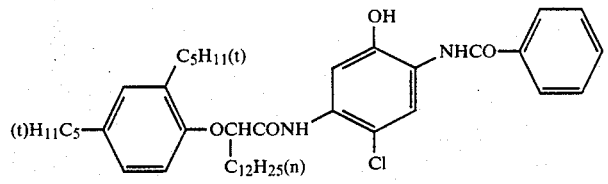

(CI-4)

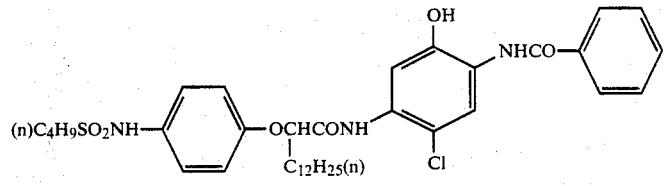

-continued
(CI-5)
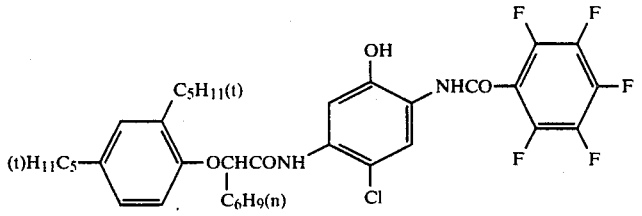
(CI-6)
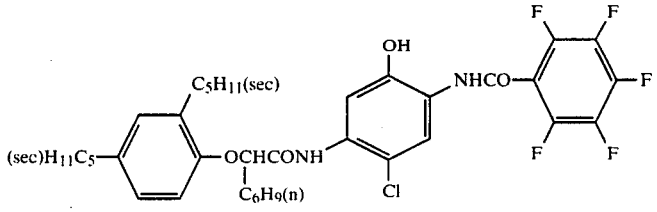
(CI-7)
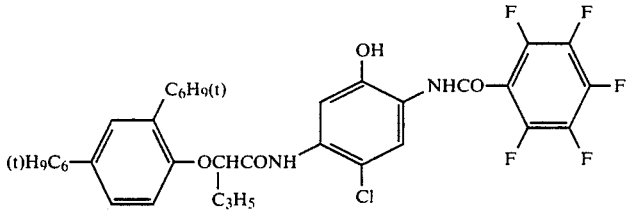
(CI-8)
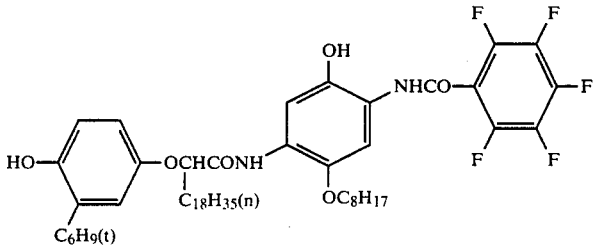
(CI-9)
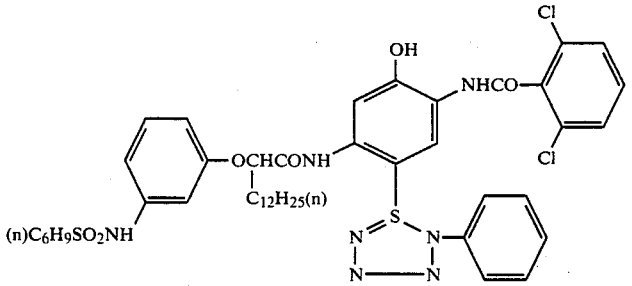
(CI-10)
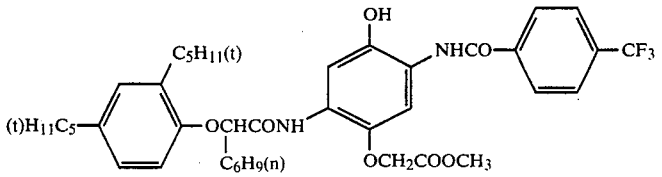
(CI-11)
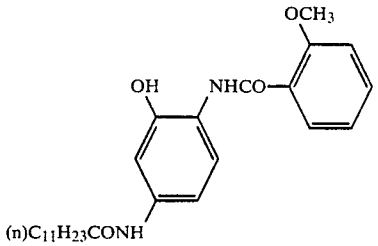

-continued
(CI-12)
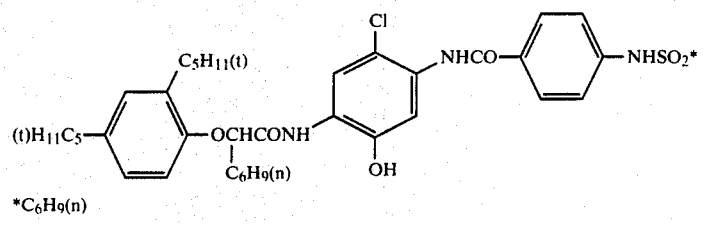
(CI-13)
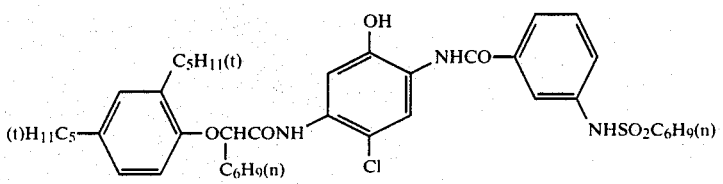
(CI-14)
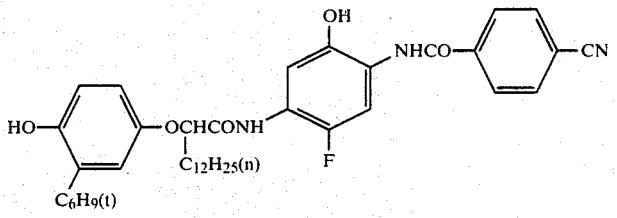
(CI-15)
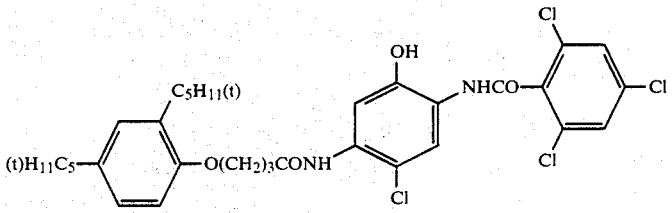
(CI-16)
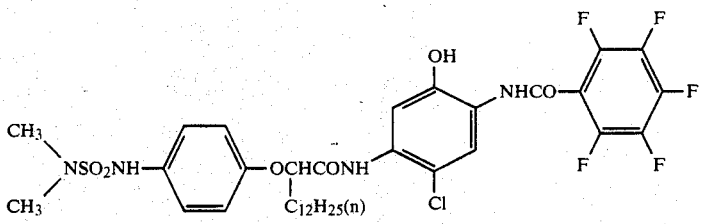
(CI-17)
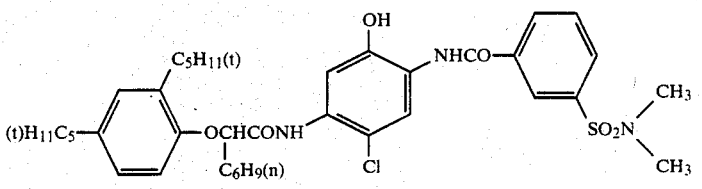
(CI-18)
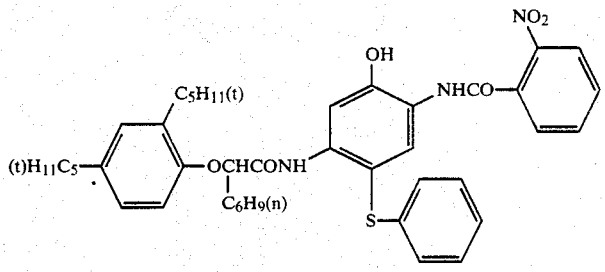

-continued
(CI-19)
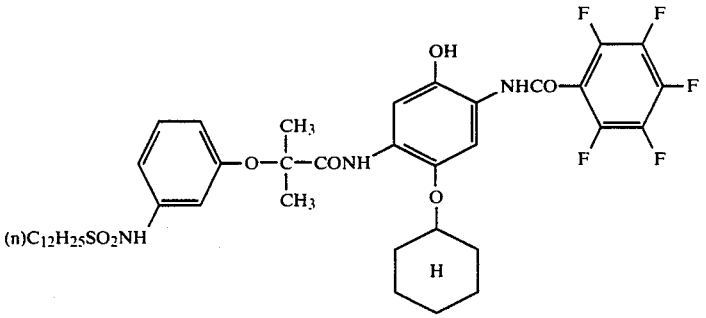
(CI-20)
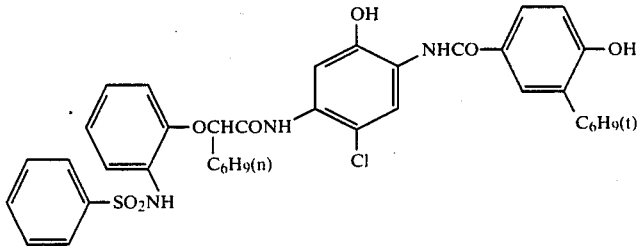
(CI-21)
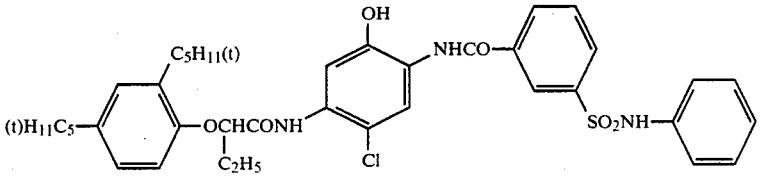
(CI-22)
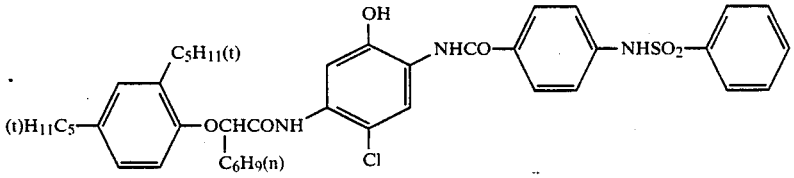
(CI-23)
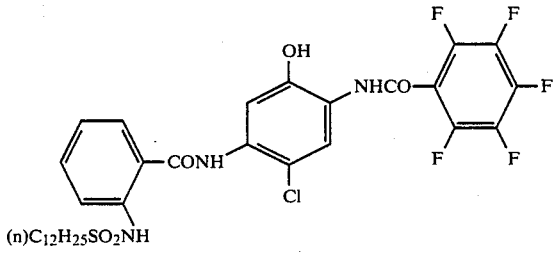
(CI-24)
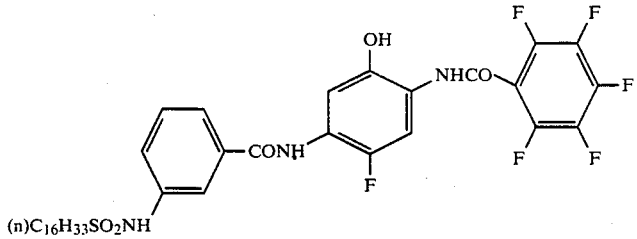

-continued
(CI-25)
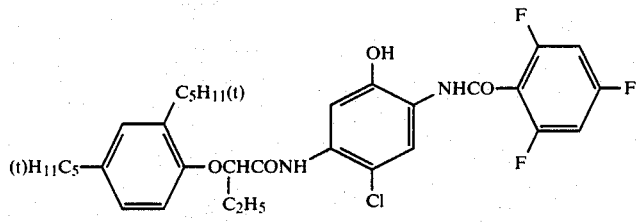
(CI-26)
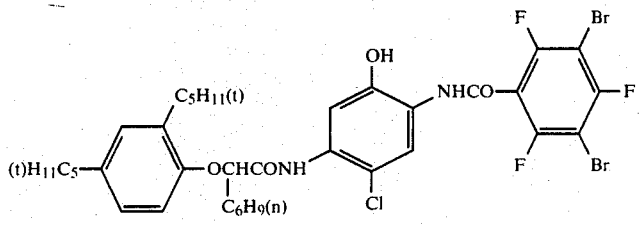
(CI-27)
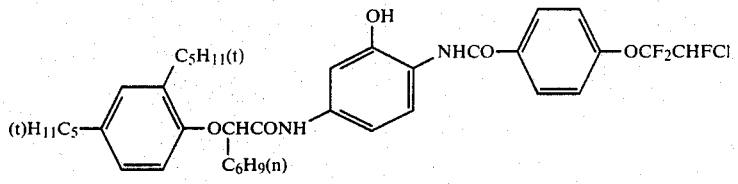
(CI-28)
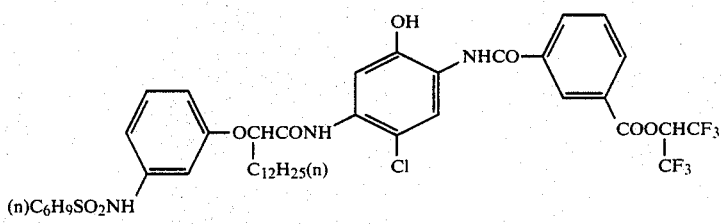
(CI-29)
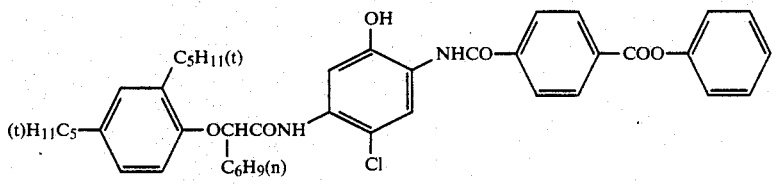
(CI-30)
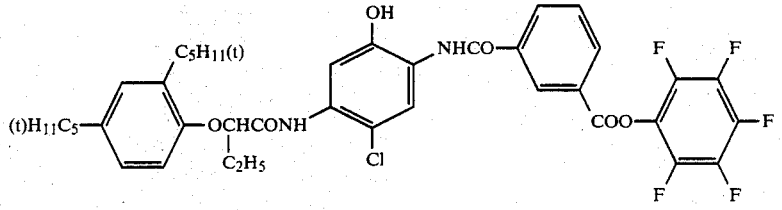
(CI-31)
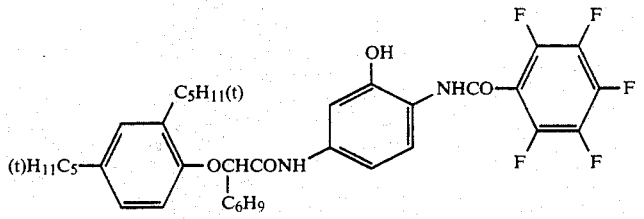

-continued
(CI-32)
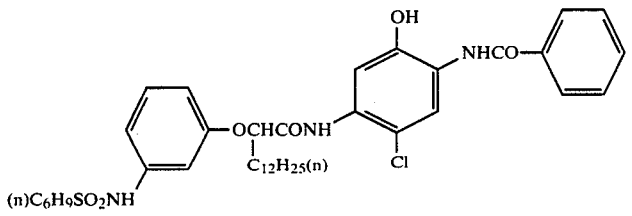
(CI-33)
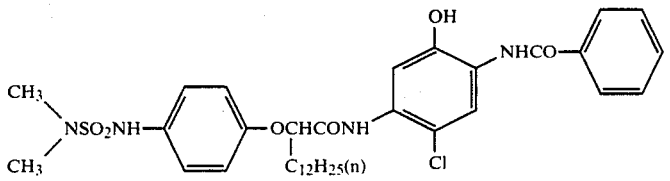
(CI-34)
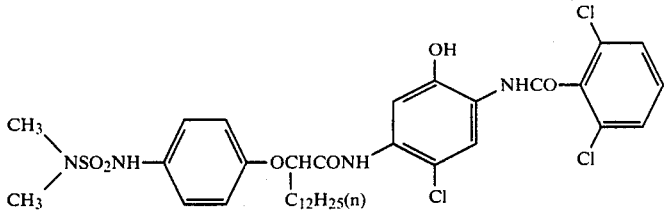
(CI-35)
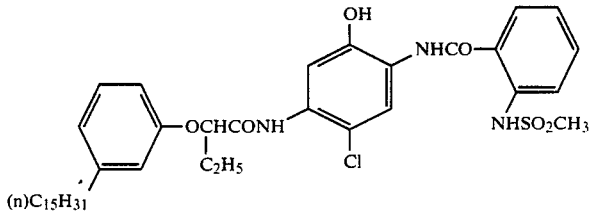
(CI-36)
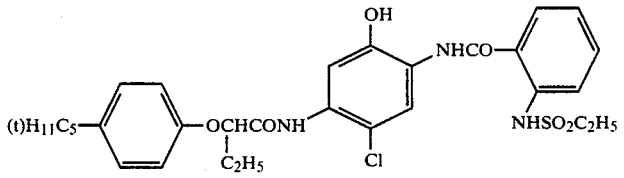
(CI-37)
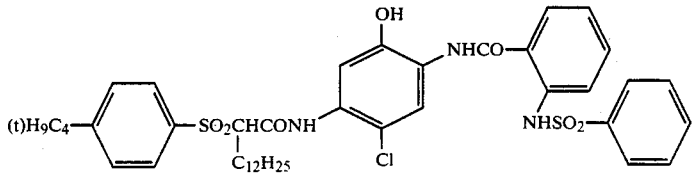
(CI-38)
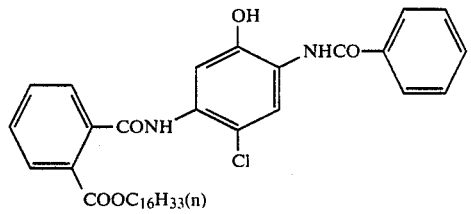

-continued
(CI-39)
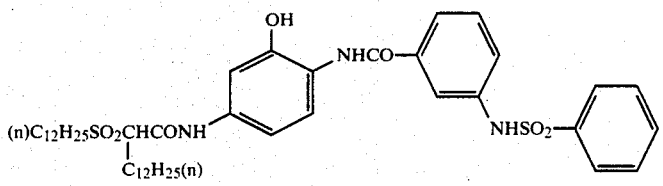
(CI-40)
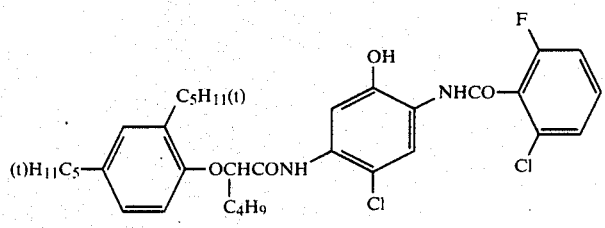
(CI-41)
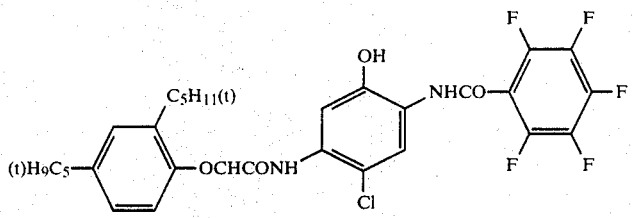
(CI-42)
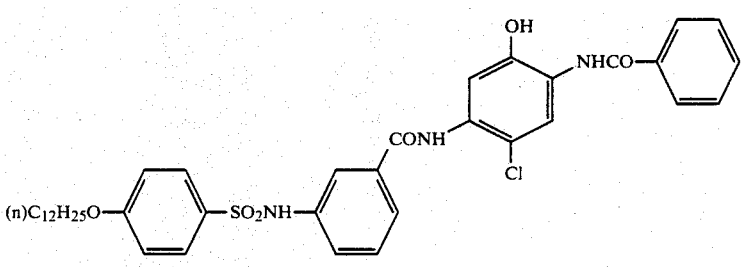
(CI-43)
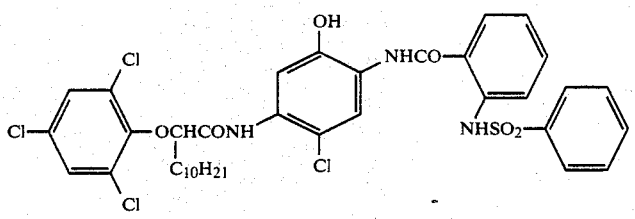
(CI-44)
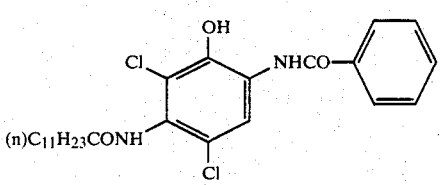
(CI-45)
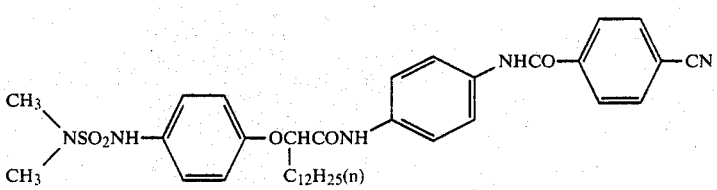

-continued (CI-46)

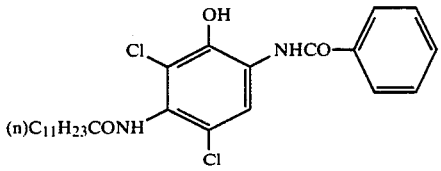

(CI-47)

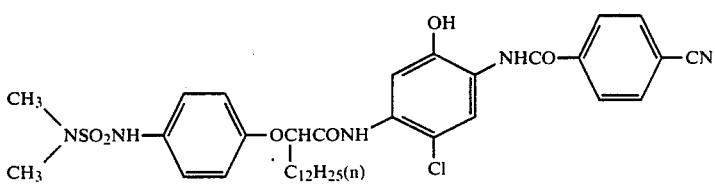

(CI-48)

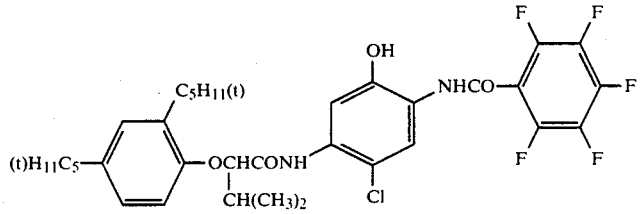

(CI-49)

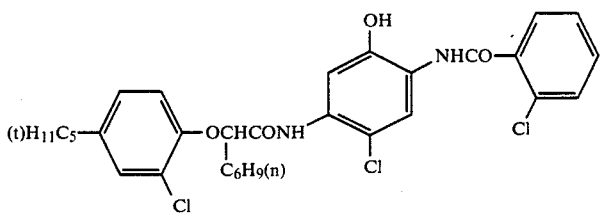

In the invention, among the cyan couplers represented by the Formula [F], the preferable ones are represented by the following Formula [F']:

Formula [F']

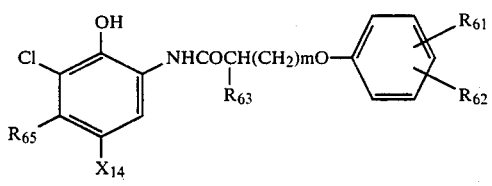

Wherein $R_{61}$ and $R_{62}$ may be the same with or different from each other and they represent a hydrogen atom, such an alkyl group as a methyl, ethyl, propyl, butyl, amyl, octyl dodecyl or like group, or such an alkoxy group as a methoxy, ethoxy or like group, provided that a total number of the carbon atoms in both of the $R_{61}$ and $R_{62}$ is from 8 to 16, and it is preferable that both of the $R_{61}$ and $R_{62}$ are a butyl or amyl group, respectively;

$R_{63}$ represents a hydrogen atom or such an alkyl group as a methyl, ethyl, propyl, butyl, octyl or like group, and more preferably a hydrogen atom, an ethyl group or a butyl group;

$R_{65}$ represents an alkyl group including, for example, a methyl, ethyl or like group;

m is an integer of from 0 to 2; and $Z_{14}$ represents a hydrogen atom, a halogen atom or a group capable of splitting off through the reaction thereof with the oxidation products of an aromatic primary amine color developing agent.

In the Formulas [E], [F], [E'] and [F'], the groups each capable of splitting off through the reaction thereof with the oxidation products of an aromatic primary amine color developing agent, which are respectively represented by $X_{11}$, $X_{12}$, $X_{13}$ and Xhd 14 in the Formulas, have so far been well-known by the skilled in the art. Such groups modifies the reactivity of couplers or splits off from the couplers so as to advantageously perform such a function as a development inhibition, a bleach inhibition, a color correction and the like in the coated layers containing the couplers or other layers of a silver halide color photographic light-sensitive material. The typical examples thereof include an alkoxy group, an aryloxy group, an arylazo group, a thioether, a carbamoyloxy group, an acyloxy group, an imido group, a sulfonamido group, a thiocyano group or such a heterocyclic group as an oxazolyl, a diazolyl, triazolyl, tetrazolyl and the like. The particularly suitable examples represented by $X_{11}$ through $X_{14}$ are a hydrogen atom and a chlorine atom.

The typical examples of the cyan couplers represented by the Formula [F] will be given below. It is, however, to be understood that the invention shall not be limited thereto.

(CII-1)
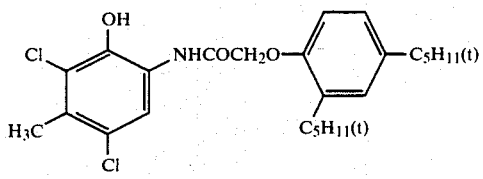
(CII-2)
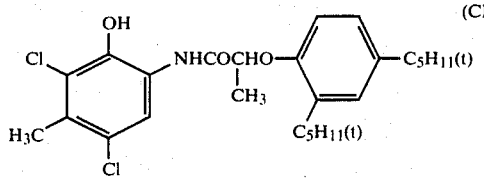
(CII-3)
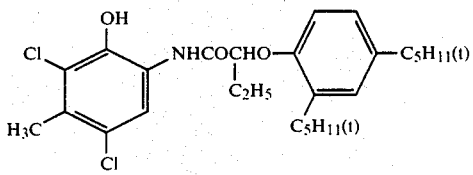
(CII-4)
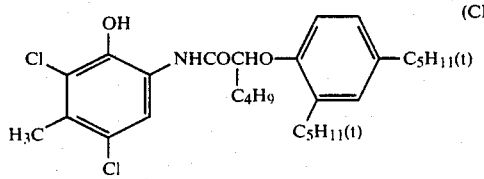
(CII-5)
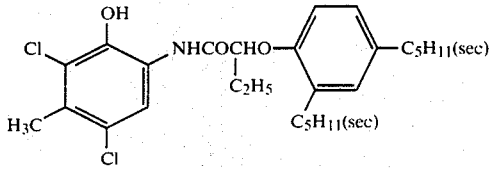
(CII-6)
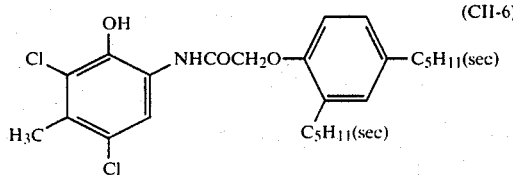
(CII-7)
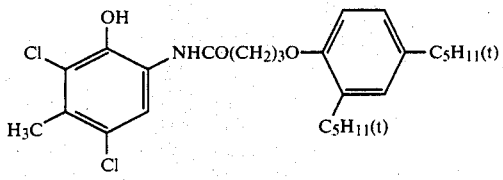
(CII-8)
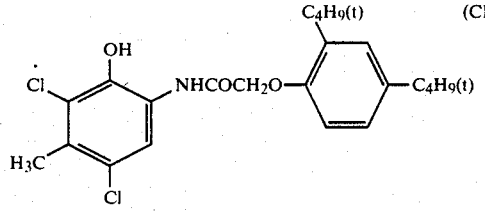
(CII-9)
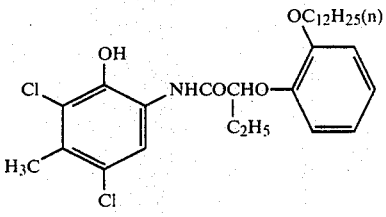
(CII-10)
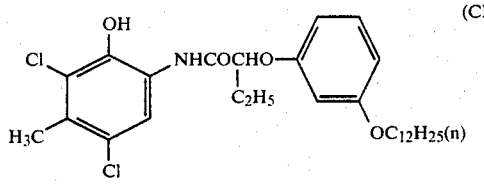
(CII-11)
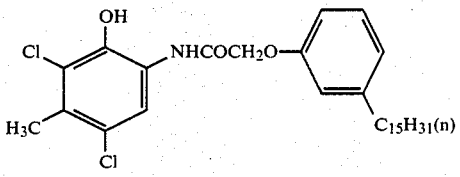
(CII-12)
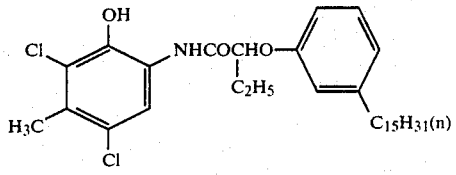
(CII-13)
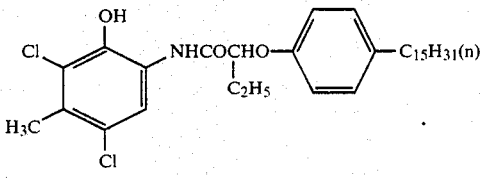
(CII-14)
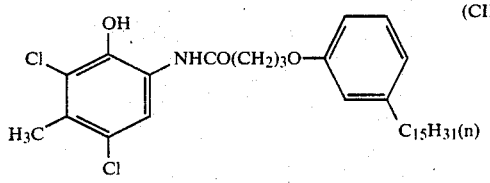
(CII-15)
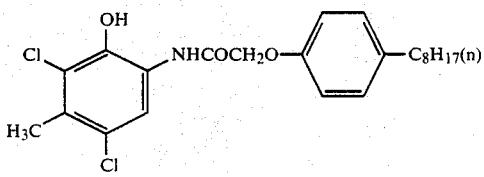
(CII-16)
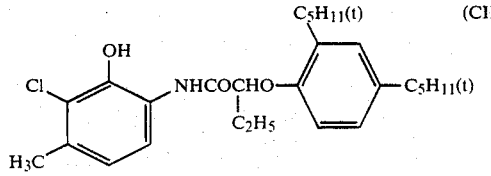

-continued
(CII-17)
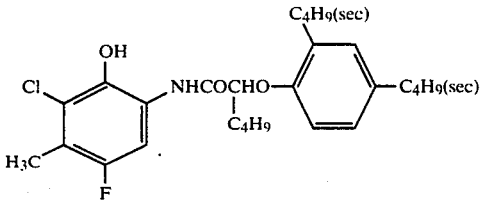
(CII-18)
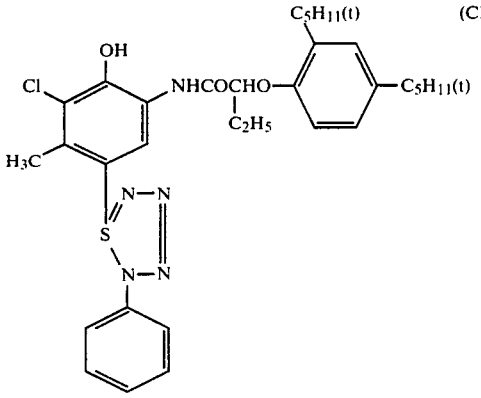
(CII-19)
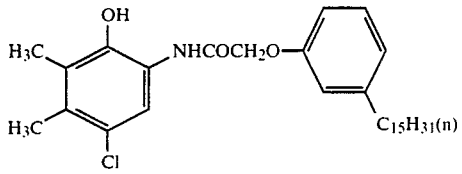
(CII-20)
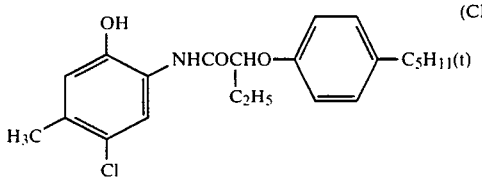
(CII-21)
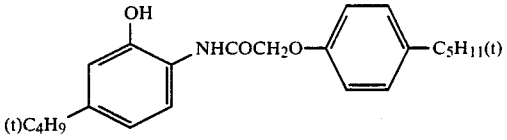
(CII-22)
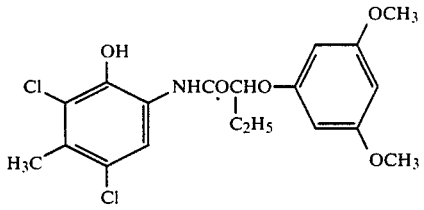
(CII-23)
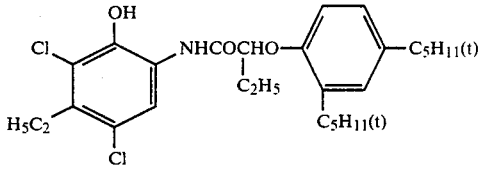
(CII-24)
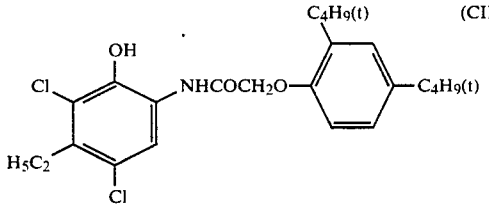
(CII-25)
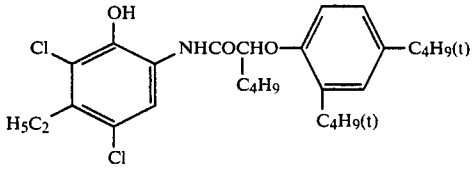
(CII-26)
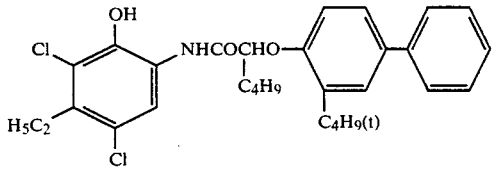
(CII-27)
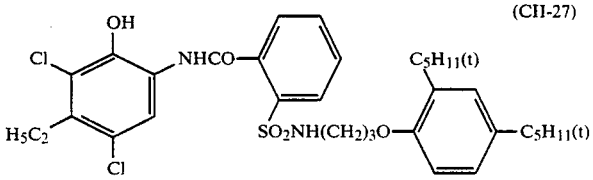
(CII-28)
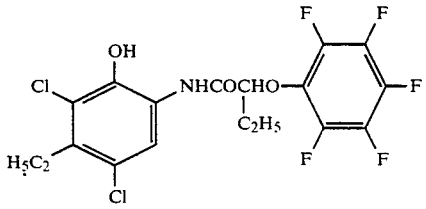
(CII-29)
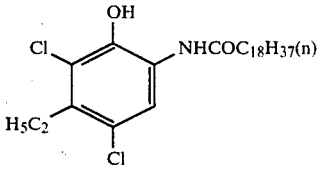
(CII-30)
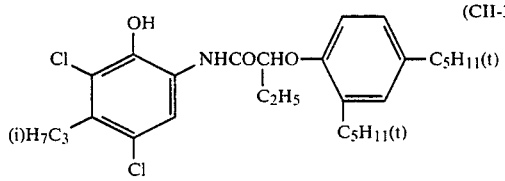

-continued (CII-31)

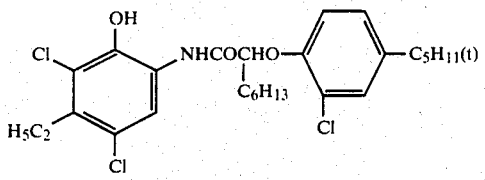

(CII-32)

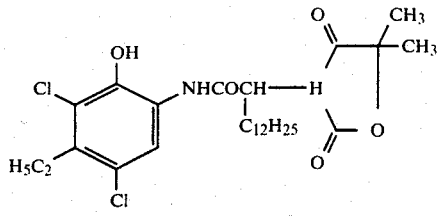

(CII-33)

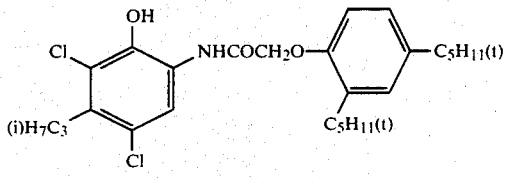

(CII-34)

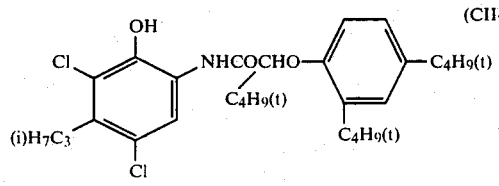

In the silver halide photographic light-sensitive materials relating to the invention, the magenta dye image forming couplers represented by the following Formulas [G] and [H-I] can preferably be used.

Formula [G]

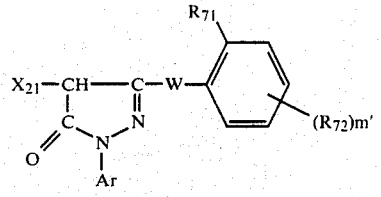

[Wherein Ar represents an aryl group; $R_{71}$ represents a hydrogen atom or a substituent; $R_{72}$ represents a substituent; $X_{21}$ represents a hydrogen atom or a substituent capable of splitting off through the reaction thereof with the oxidation products of a color developing agent; W represents a —NH—, —NHCO— in which the N atom couples to a carbon atom of a pyrazolone nucleus, or a —NHCONH—; and m is an integer of 1 or 2.]

Formula [H-I]

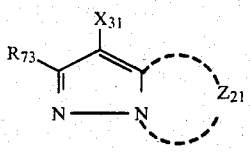

[Wherein $Z_{21}$ represents a group of nonmetal atoms for necessary forming a nitrogen-containing heterocyclic ring, and the ring formed by the $Z_{21}$ is allowed to have a substituent; $X_{31}$ represents a hydrogen atom or a substituent capable of splitting off through the reaction thereof with the oxidation products of a color developing agent; and $R_{73}$ represents a hydrogen atom or a substituent.]

Next, the couplers represented by the Formula [G] will be described in detail, below:

The aryl groups represented by Ar include, for example, a phenyl group or a naphthyl group, preferably a phenyl group and more preferably a substituted phenyl group.

Such substituents include, for example, a halogen atom, an alkyl group, an alkoxy group, an aryloxy group, an alkoxycarbonyl group, a cyano group, a carbamoyl group, a sulfamoyl group, a sulfonyl group, a sulfonamido group, an acylamino group or the like; and the phenyl groups represented by Ar are allowed to have not less than two substituents.

The typical examples of the substituents will now be given below:

Halogen atoms: A chlorine, bromine or fluorine atom;

Alkyl groups: A methyl, ethyl, iso-propyl, butyl, t-butyl, t-pentyl or like group and, more preferably, an alkyl group having 1 to 5 carbon atoms.

Alkoxy groups: A methoxy, ethoxy, butoxy, sec-butoxy, iso-pentyloxy or like group and, more preferably, an alkoxy group having 1 to 5 carbon atoms.

Aryloxy groups: A phenoxy, β-naphthoxy or like group; and the aryl part thereof is allowed to have a substituent similar to those given for the phenyl groups represented by Ar.

Alkoxycarbonyl groups: A carbonyl group coupled thereto with the above-mentioned alkoxy group and, more preferably, a methoxycarbonyl or pentyloxycarbonyl group having 1 to 5 carbon atoms in the alkyl part thereof.

Carbamoyl groups: A carbamoyl group or such an alkylcarbamoyl group as a dimethylcarbamoyl or like group.

Sulfamoyl groups: A sulfamoyl group or such an alkylsulfamoyl group as a methylsulfamoyl, dimethylsulfamoyl, ethylsulfamoyl or like group.

Sulfonyl groups: Such an alkylsulfonyl group as a methansulfonyl, ethanesulfonyl, butanesulfonyl or like group.

Sulfonamido groups: Such an alkylsulfonamido group as a methanesulfonamido, toluenesulfonamido or like group, an arylsulfonamido group, and the like.

Acylamino groups: An acetamino, pivaloylamino, benzamino or like group.

Among the above-mentioned substituents, the particularly preferable ones are a halogen atom and, inter alia, a chlorine atom is most preferable.

The substituents represented by $R_{71}$ include, for example, a halogen atom, an alkyl group, an alkoxy group and the like.

The typical examples thereof will now be given below:

Halogen atoms: A chlorine, bromine or fluorine atom.

Alkoxy groups: Preferable ones are those such as a methoxy, ethoxy, butoxy, sec-butoxy, iso-pentyloxy or like group each having 1 to 5 carbon atoms.

Alkyl groups: Preferable ones are those such as a methyl, ethyl, iso-propyl, butyl, t-butyl, t-pentyl or like group each having 1 to 5 carbon atoms.

The particularly preferable substituents are a halogen atom and, inter alia, a chlorine atom.

The substituents represented by $R_{72}$ include, for example, a halogen atom, an alkyl group, an amido group, an imido group, a N-alkylcarbamoyl group, a N-alkylsulfamoyl group, an alkoxycarbonyl group, an acyloxy group, a sulfonamido group, a urethane group or the like. Among the above-mentioned substituents the preferably useful ones include, for example, such an amido group as a tetradecanamido group, a 3-t-butyl-4-hydroxyphenoxy tetradecanamido group or the like, such an imido group as a dodecylsuccinimido group, an octadecenenylsuccinimido group or the like, and such a sulfonamido group as a butylsulfonamido group, a dodecylsulfonamido group or the like.

The groups represented by W may be anyone of a —NH—, —NHCO— in which the nitrogen atom thereof couples to the carbon atom of a pyrazolone nucleus, or a —NHCONH—, and particularly —NH— is useful.

The substituents which are represented by YHd 2 and capable of splitting off through the coupling reaction thereof with the oxidation products of an aromatic primary amine color developing agent include, for example, a halogen atom, an alkoxy group, an aryloxy group, an acyloxy group, an arylthio group, an alkylthio group, a

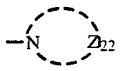

in which $Z_{22}$ represents a group of atoms necessary for forming a 5-membered or 6-membered ring with an atom selected from a group of a carbon atom, an oxygen atom, a nitrogen atom and sulfur atom, as well as with a nitrogen atom.

The typical examples thereof wll be given below:

Halogen atoms: A chlorine, bromine or fluorine atom.

Alkoxy groups: An ethoxy, benzyloxy, methoxyethylcarbamoylmethoxy, tetradecylcarbamoylmethoxy or like group.

Aryloxy groups: A phenoxy, 4-methoxyphenoxy, 4-nitrophenoxy or like group.

Acyloxy group: An acetoxy, myristoyloxy, benzoyloxy or like group.

Arylthio groups: A phenylthio, 2-butoxy-5-octylphenylthio, 2,5-dihexyloxyphenylthio or like groups.

Alkylthio groups: A methylthio, octylthio, hexadecylthio, benzylthio, 2-(diethylamino)ethylthio, ethoxycarbonylmethylthio, ethoxyethylthio, phenoxyethylthio or like group.

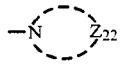

groups: a pyrazolyl, imidazolyl, triazolyl, tetrazolyl or like group.

Next, the typical examples of the magenta couplers represented by the Formula [G] will now be given below. It is, however, to be understood that the invention shall not be limited thereto.

MI-1

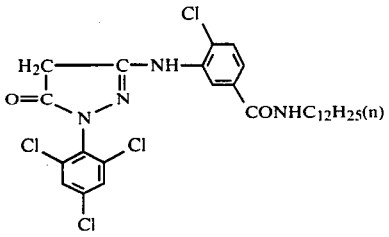

MI-2

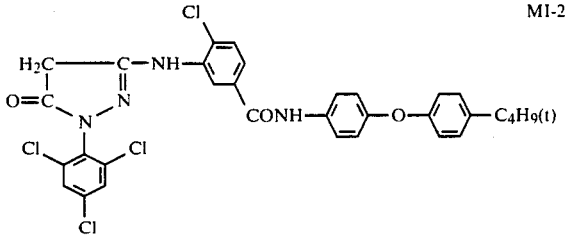

MI-3

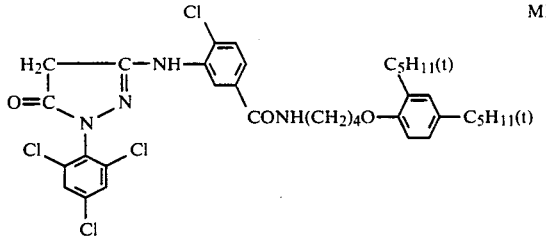

MI-4

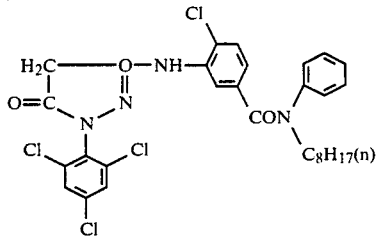

MI-5

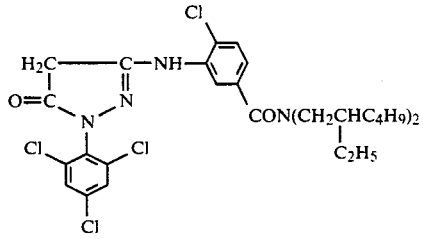

MI-6

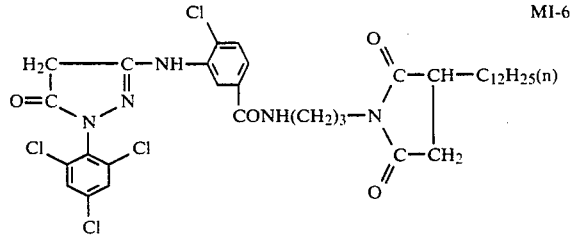

-continued
MI-7
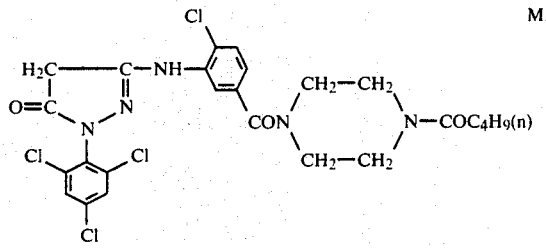
MI-8
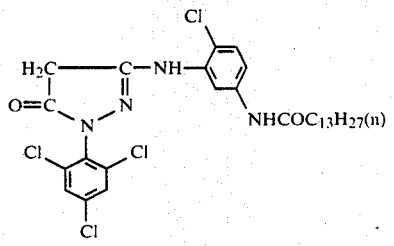
MI-9
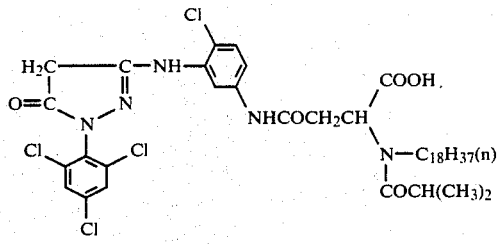
MI-10
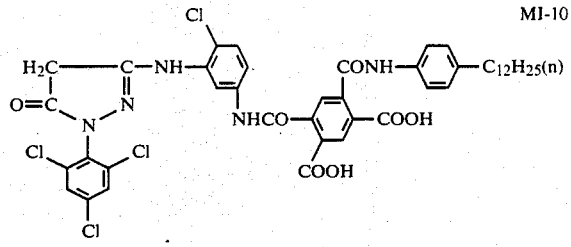
MI-11
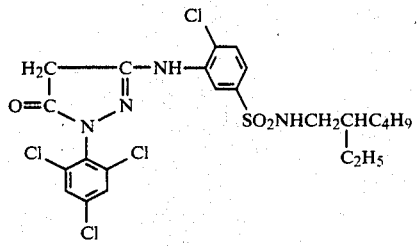
MI-12
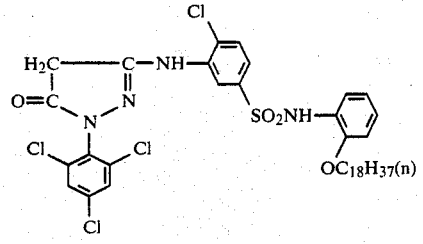
-continued
MI-13
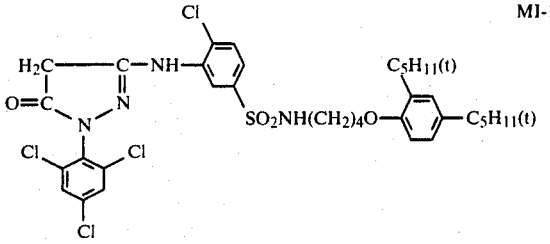
MI-14
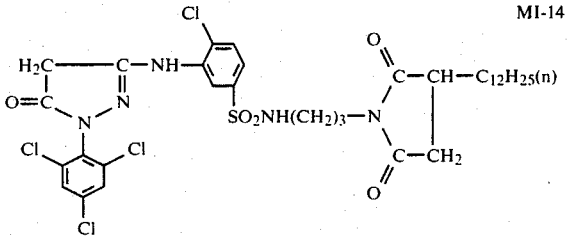
MI-15
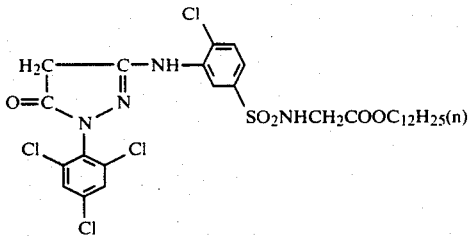
MI-16
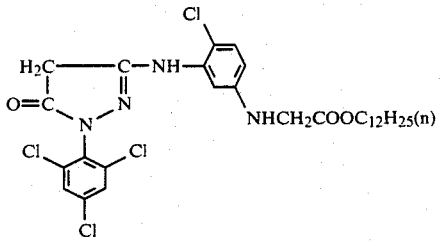
MI-17
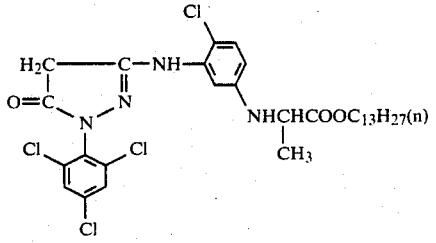
MI-18
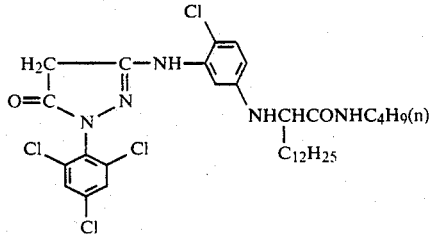

-continued
MI-19
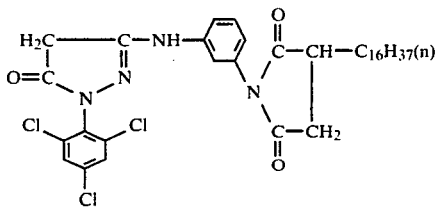
MI-20
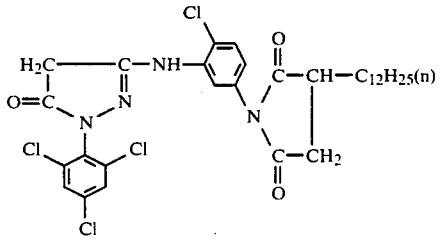
MI-21
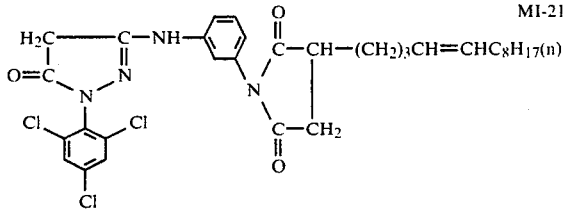
MI-22
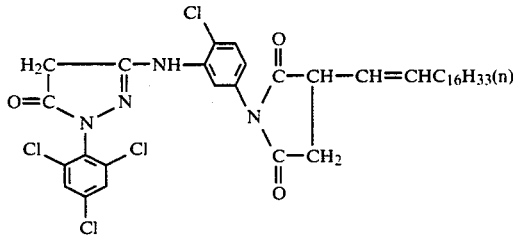
MI-23
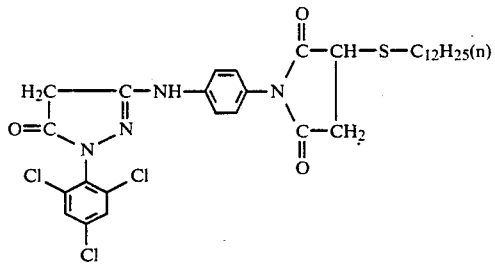
MI-24
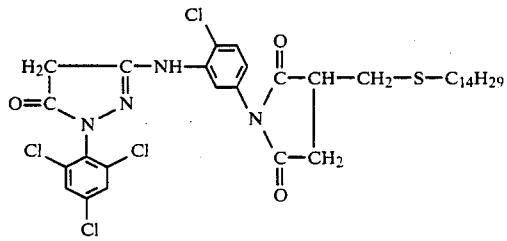
MI-25
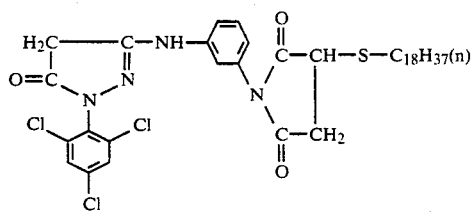
-continued
MI-26
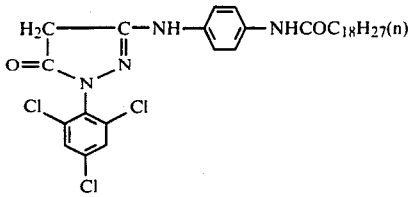
MI-27
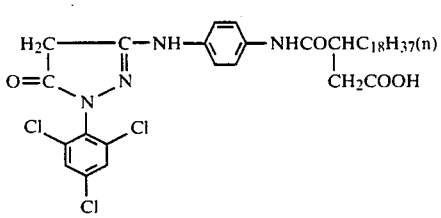
MI-28
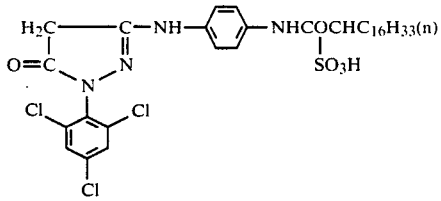
MI-29
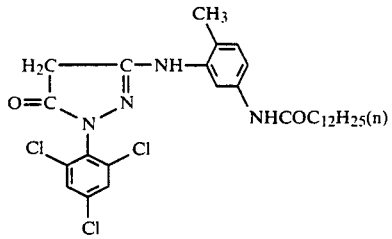
MI-30
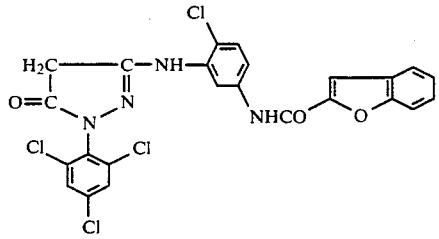
MI-31
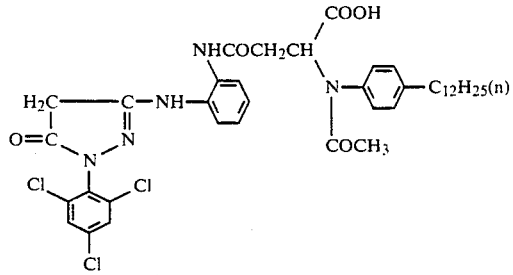

-continued
MI-32
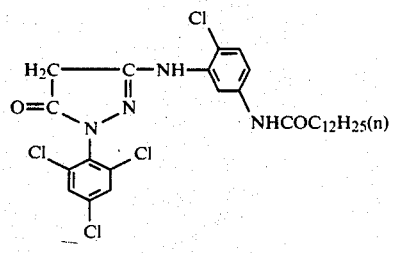
MI-33
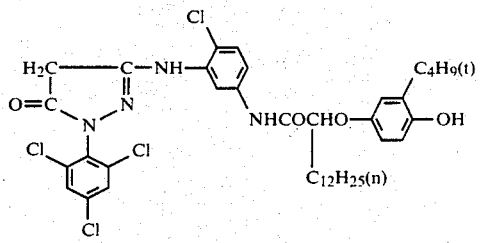
MI-34
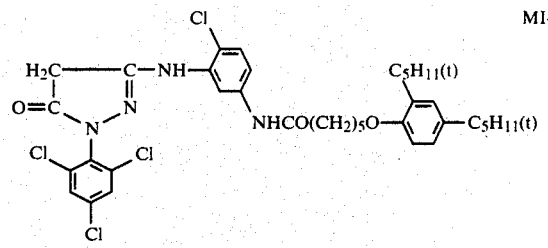
MI-35
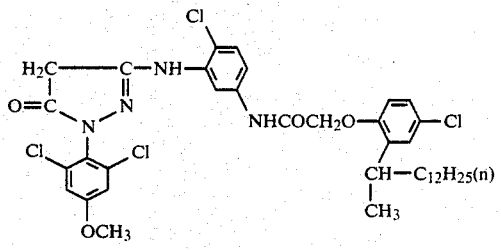
MI-36
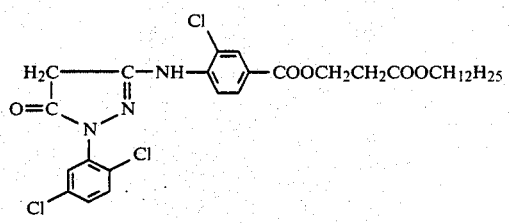
MI-37
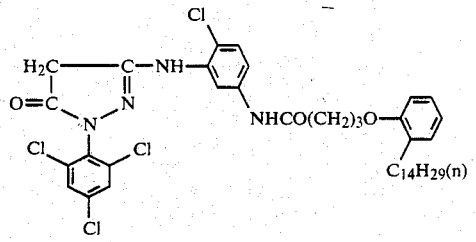
-continued
MI-38
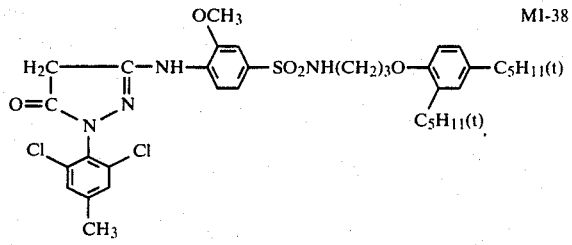
MI-39
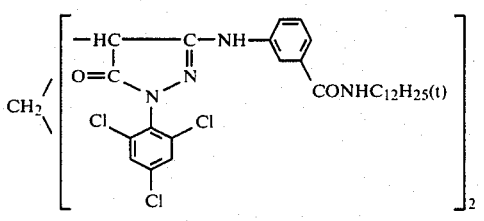
MI-40
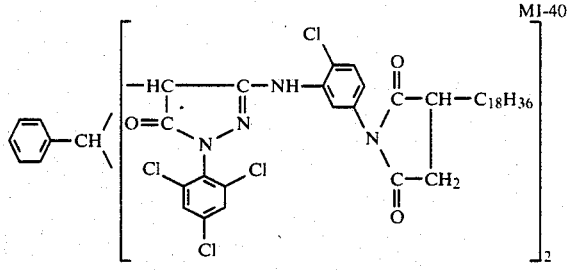
MI-41
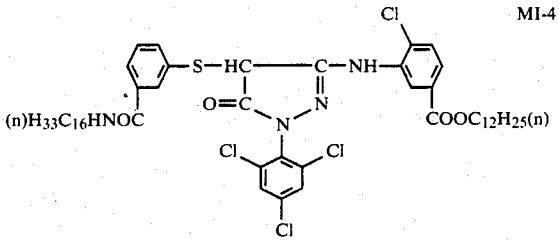
MI-42
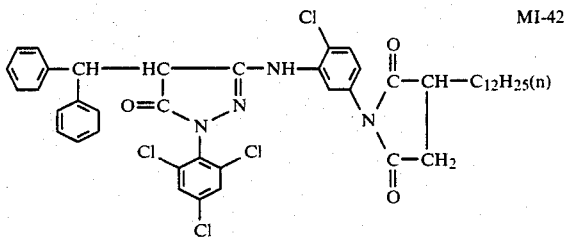
MI-43
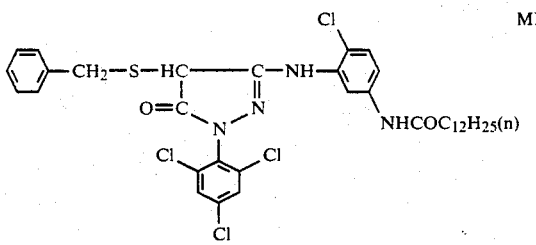

-continued

MI-44

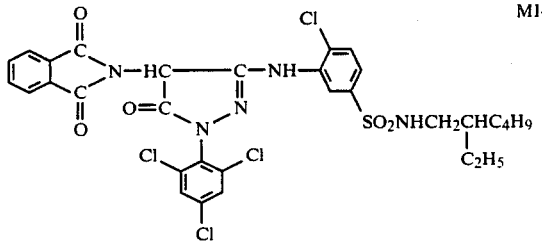

MI-45

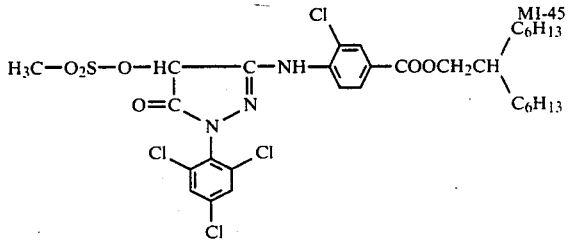

MI-46

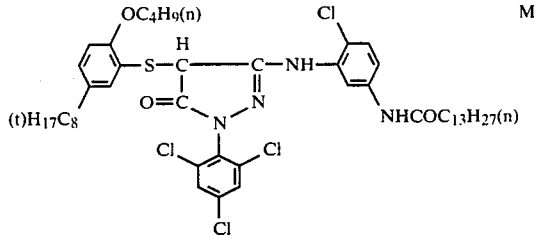

MI-47

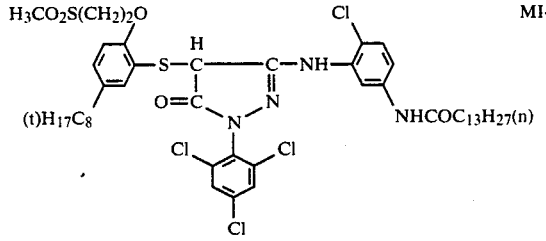

MI-48

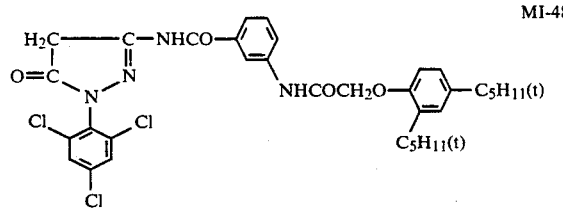

MI-49

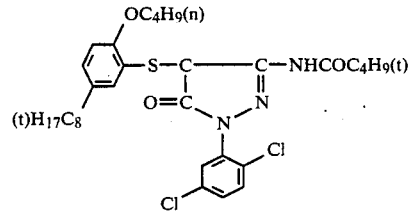

MI-50

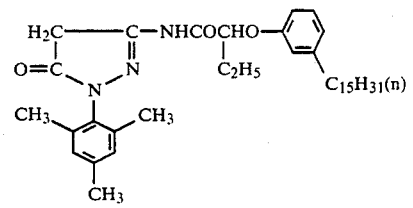

-continued

MI-51

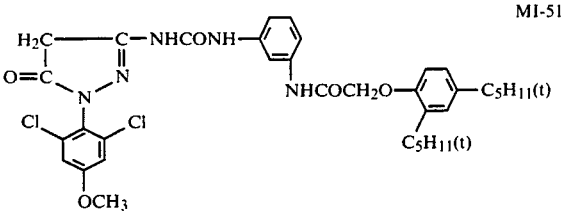

The above-mentioned magenta couplers are described in, for example, U.S. Pat. Nos. 2,600,788, 3,061,432, 3,062,653,3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publication Nos. 29639/1974, 111631/1974, 129538/1974, 13041/1975, 58922/1977, 62454/1980, 118034/1980, 38043/1981, 35858/1982 and 23855/1985; British Pat. No. 1,247,493; Belgian Pat. Nos. 769,116 and 792,525; West German Pat. No. 2,156,111; Japanese Patent Examined Publication No. 60479/71; and the like.

The magenta couplers relating to the invention represented by the aforegiven Formula [H-I];

Formula [H-I]

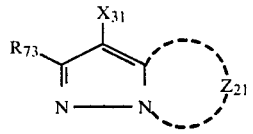

wherein $Z_{21}$ represents a group of atoms necessary for forming a nitrogen-containing heterocyclic ring, and the rings formed by the $Z_{21}$ are allowed to have a substituent;

$X_{31}$ represents a hydrogen atom or a group capable of splitting off through the reaction thereof with the oxidation products of a color developing agent; and $R_{73}$ represents a hydrogen atom or a substituent.

The substituents represented by the $R_{73}$ include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a cross-linked hydrocarbon residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkylthio group, an arylthio group and a heterocyclic thio group.

The above-mentioned halogen atoms include, for example, a chlorine atom and a bromine atom and more preferably a chlorine atom.

The above-mentioned alkyl groups represented by $R_{73}$ include, for example, those each having 1 to 32 carbon atoms; the alkynyl groups and the alkenyl groups each represented thereby include, for example, those each having 2 to 32 carbon atoms; and the cycloalkyl groups and the cycloalkenyl groups include, for example, those each having 3 to 12 carbon atoms and more preferably those each having 5 to 7 carbon atoms; provided that the alkyl groups, the alkenyl groups and the alkynyl groups may be normal chained or branch chained.

The above-mentioned alkyl groups, alkenyl groups, alkynyl groups, cycloalkyl groups and cycloalkenyl groups are allowed to have a substituent including, for example, an aryl group, an cyano group, a halogen atom, a heterocyclic group, a cycloalkyl group, a cycloalkenyl group, a spiro compound residual group, a bridged hydrocarbon compound residual group; and besides, those substituting through such a carbonyl group as an acyl, carboxy, carbamoyl, alkoxycarbonyl or aryloxycarbonyl group; and those substituting through a hetero atom and more particularly those substituting through the oxygen atom of a hydroxy, alkoxy, aryloxy, heterocyclic oxy, siloxy, acyloxy, carbamoyloxy or like group; those substituting through the nitrogen atom of a nitro, amino including dialkylamino or the like, sulfamoylamino, alkoxycarbonylamino, aryloxycarbonylamino, acylamino, sulfonamido, imido, ureido or like group; those substituting through the sulfur atom of an alkylthio, arylthio, heterocyclic thio, sulfonyl, sulfinyl, sulfamoyl or like group; and those substituting through the phosphorus atom of a phosphonyl or like group.

The typical examples thereof include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfonaminophenoxypropyl group, a 3-4'-{α-[4''(p-hydroxybenzenesulfonyl)phenoxy]-dodecanoylamino}phenylpropyl group, a 3-{4'-[α-(2'',4''-di-t-amylphenoxy)butanamido]phenyl}-propyl group, a 4-[α-(o-chlorophenoxy)tetradecanamido-phenoxy]propyl group, an allyl group, a cyclopentyl group, a cyclohexyl group and the like.

The aryl groups represented by $R_{73}$ preferably include a phenyl group which is also allowed to have such a substituent as an alkyl group, an alkoxy group, an acylamino group and the like. The typical examples thereof include, for example, a phenyl group, a 4-t-butylphenyl group, a 2,4-di-t-amylphenyl group, a 4-tetradecanamidophenyl group, a hexadesiloxyphenyl group, a 4'-[α-(4''-1-butylphenoxy)tetradecanamido]-phenyl group and the like.

The heterocyclic groups represented by $R_{73}$ preferably include, for example, those of the 5- to 7-membered which may also be substotuted or condensed. The typical examples thereof include, for example, a 2-furyl group, a 2-thienyl group, a 2-pyrimidinyl group, a 2-benzothiazolyl group and the like.

The acyl groups represented by $R_{73}$ include, for example, such an alkylcarbonyl group as an acetyl group, a phenylacetyl group, a dodecanoyl group, an α-2,4-di-t-amylphenoxybutanoyl group and the like; and such an arylcarbonyl group as a benzoyl group, a 3-pentadecyloxybenzoyl group, a p-chlorbenzoyl group and the like.

The sulfonyl groups represented by $R_{73}$ include, for example, such an alkylsulfonyl group as a methylsulfonyl group and a dodecylsulfonyl group; such an arylsulfonyl group as a benzenesulfonyl group and a p-toluenesulfonyl group; and the like.

The sulfinyl groups represented by $R_{73}$ include, for example, such an alkylsulfimyl group as an ethylsulfinyl group, an octylsulfinyl group and a 3-phenoxybutylsulfinyl group; such an arylsulfinyl group as a phenylsulfinyl group and a m-pentadecylphenylsulfinyl group; and the like.

The phosphonyl groups represented by $R_{73}$ include, for example, such an alkylphosphonyl group as a butyloctylphosphonyl group; such an alkoxyphosphonyl group as an octyloxyphosphonyl group; such an aryloxyphosphonyl group as a phenoxyphosphonyl group; such an arylphosphonyl group as a phenylphosphonyl group; and the like.

The carbamoyl groups represented by $R_{73}$ may be substituted with an alkyl group, an aryl group and more preferably a phenyl group, or the like. The examples thereof include a N-methylcarbamoyl group, a N,N-dibutylcarbamoyl group, a N-(2-pentadecyloctylethyl)-carbamoyl group, a N-ethyl-N-dodecyl-carbamoyl group, a N-{3-(2,4-di-t-amylphenoxy)propyl}carbonyl group, and the like.

The sulfamoyl groups represented by $R_{73}$ may be substituted with an alkyl group, an aryl group and more preferably a phenyl group, or the like. The examples thereof include a N-propylsulfamoyl group, a N,N-diethylsulfamoyl group, a N-(2-pentadecyloxyethyl)sulfamoyl group, N-ethyl-N-dodecylsulfamoyl group, N-phenylsulfamoyl group, and the like.

The spiro compound residual groups represented by $R_{73}$ include, for example, a spiro[3.3]heptane-1-yl and the like.

The bridged hydrocarbon compound residual groups represented by $R_{73}$ include, for example, bicyclo[2.2.1-]heptane-1-yl, tricyclo[3.3.1.1$^{3,7}$]decane-1-yl, 7,7-dimethyl-bicyclo-[2.2.1]heptane-1-yl, and the like.

The alkoxy groups represented by $R_{73}$ are also allowed to substitute the substituents which are given to the aforementioned alkyl groups. The examples thereof include a methoxy group, a propoxy group, a 2-dodecyloxyethoxy group, a phenetyloxyethoxy group and the like.

The aryloxy groups represented by $R_{73}$ preferably include, for example, a phenyloxy. The aryl nucleus thereof may also be substituted with the substituents or atoms given for the above-mentioned aryl groups. The examples thereof include a phenoxy group, a p-1-butylphenoxy group, a m-pentadecylphenoxy group, and the like.

The heterocyclic oxy groups represented by $R_{73}$ preferably include those each having a 5- to 7-membered heterocyclic ring. Such heterocyclic ring may have a further substituent. The examples thereof include a 3,4,5,6-tetrahydropyranyl-2-oxy group and a 1-phenyltetrazole-5-oxy group.

The siloxy groups represented by $R_{73}$ may further be substituted with an alkyl group or the like. The examples thereof include a trimethylsiloxy group, a triethylsiloxy group, a dimethylbutylsiloxy group and the like.

The acyloxy groups represented by $R_{73}$ include, for example, an alkylcarbonyloxy group, an arylcarbonyloxy group and the like, and they are allowed to have a further substituent. The examples thereof include an acetyloxy group, an α-chloroacetyloxy group, a benzoyloxy group and the like.

The carbamoyloxy groups represented by $R_{73}$ may also be substituted with an alkyl group, an aryl group or the like. The examples thereof include a N-ethylcarbamoyloxy group, a N,N-diethylcarbamoyloxy group, a N-phenylcarbamoyloxy group and the like.

The amino groups represented by $R_{73}$ may also be substituted with an alkyl group, an aryl group and more preferably a phenyl group, or the like. The examples thereof include an ethylamino group, an anilino group, a m-chloranilino group, a 3-pentadecyloxycarbonylanilino group, a 2-chloro-5-hexadecanamidoanilino group, and the like.

The acylamino groups represented by $R_{73}$ include, for example, an alkylcarbonylamino group, an arylcarbonylamino group and more preferably a phenylcarbonylamino group, and the like. They are allowed to have a further substituent. The typical examples thereof include an acetamido group, an α-ethylpropanamido group, a N-phenylacetamido group, a dodecanamido group, a 2,4-di-t-amylphenoxyacetamido group, an α-3-t-butyl-4-hydroxyphenoxybutamido group, and the like.

The sulfonamido groups represented by $R_{73}$ include, for example, an alkylsulfonylamino group, an arylsulfonylamino group and the like; and they are allowed to have a further substituent. The typical examples thereof include a methylsulfonylamino group, a pentadecylsulfonylamino group, a benzenesulfonamido group, a p-toluenesulfonamido group, a 2-methoxy-5-t-amylbenzenesulfonamido group and the like.

The imido groups represented by $R_{73}$ may be the open-chained or the cyclic ones, and they are also allowed to have a substituent. The examples thereof include a succinimido group, a 3-heptadecyl succinimido group, a phthalimido group, a glutarimido group and the like.

The ureido groups represented by $R_{73}$ may be substituted with an alkyl group, an aryl group and more preferably a phenyl group, and the like. The examples thereof include a N-ethylureido group, a N-methyl-N-decylureido group, a N-phenylureido group, a N-p-tolylureido group and the like.

The sulfamoylamino groups represented by $R_{73}$ may also be substituted with an alkyl group, an aryl group and more preferably a phenyl group, and the like. The examples thereof include a N,N-dibutylsulfamoylamino group, a N-methylsulfamoylamino group, a N-phenylsulfamoylamino group and the like.

The alkoxycarbonylamino groups represented by $R_{73}$ are further allowed to have a substituent. The examples thereof include a methoxycarbonylamino group, a methoxyethoxycarbonylamino group, an octadecyloxycarbonylamino group and the like.

The aryloxycarbonylamino groups represented by $R_{73}$ are also allowed to have a substituent. The examples thereof include a phenoxycarbonylamino group and a 4-methylphenoxycarbonylamino group.

The alkoxycarbonyl groups represented by $R_{73}$ are further allowed to have a substituent. The examples thereof include a methoxycarbonyl group, a butyloxycarbonyl group, a dodecyloxycarbonyl group, an octadecyloxycarbonyl group, an ethoxymethoxycarbonyloxy group, a benzyloxycarbonyl group and the like.

The aryloxycarbonyl groups represented by $R_{73}$ are further allowed to have a substituent. The examples therof include a phenoxycarbonyl group, a p-chlorophenoxycarbonyl group, a m-pentadecyloxyphenoxycarbonyl group and the like.

The alkylthio groups represented by $R_{73}$ are further aloowed to have a substituent. The examples thereof include an ethylthio group, a dodecylthio group, an octadecylthio group, a phenethylthio group and a 3-phenoxypropylthio group.

The arylthio groups represented by $R_{73}$ preferably include, for example, a phenylthio group, and they are further allowed to have a substituent. The examples thereof include a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclic thio groups represented by $R_{73}$ preferably include those of the 5- or 7-membered. They are allowed to have a condensed ring and/or a substituent. The examples thereof include a 2-pyridylthio group, a 2-benzothiazolylthio group, and a 2,4-diphenoxy-1,3,5-triazole-6-thio group.

The substituents which are represented by $X_{31}$ and are capable of splitting off through the reaction thereof with the oxidation products of a color developing agent include, for example, such a halogen atom as a chlorine, bromine, fluorine or like atom, and besides, a group capable of substituting through a carbon, oxygen, sulfur or nitrogen atom.

The groups capable of substituting through a carbon atom include, for example, a carboxyl group and besides a group represented by the following Formula;

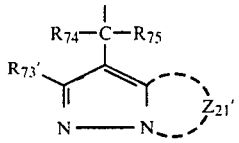

(wherein $R_{73}'$ is synonymous with the above-mentioned R; $Z_{21}'$ is synonymous with the above-mentioned $Z_{21}$; and $R_{74}$ and $R_{75}$ represent a hydrogen atom, an aryl group, an alkyl group or a heterocyclic group.), and a hydroxymethyl group, a and a triphenylmethyl group.

The groups capable of substituting through an oxygen atom include, for example, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group and an alkoxyoxalyloxy group.

The above-mentioned alkoxy groups are further allowed to have a substituent. The examples thereof include an ethoxy group, a 2-phenoxyethoxy group, a 2-cyanoethoxy group, aphenethyloxy group, a p-chlorobenzyloxy group and the like.

The above-mentioned aryloxy groups preferably include a phenoxy group, and the aryl groups thereof are further allowed to have a substituent. The examples thereof include a phenoxy group, a 3-methylphenoxy group, a 3-dodecylphenoxy group, a 4-methanesulfonamidophenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

The above-mentioned heterocyclic oxy groups preferably include a 5- to 7-membered heterocyclic oxy group which may have a condensed ring and/or a substituent. The typical examples thereof include a 1-phenyltetrazolyloxy group, a 2-benzothiazolyloxy group and the like.

The above-mentioned acyloxy groups include, for example, such an alkylcarbonyloxy group as an acetoxy group, a butanoloxy group; such a alkenylcarbonyloxy group as a cinnamoyloxy group; and such an arylcarbonyloxy group as a benzoyloxy group.

The above-mentioned sulfonyloxy groups include, for example, a butanesulfonyloxy group and a methanesulfonyloxy group.

The above-mentioned alkoxycarbonyloxy groups include, for example, an ethoxycarbonyloxy group and a benzyloxycarbonyloxy group.

The above-mentioned aryloxycarbonyl groups include, for example, a phenoxycarbonyloxy group and the like.

The above-mentioned alkyloxalyloxy groups include, for example, a methyloxalyloxy group.

The above-mentioned alkoxyoxalyloxy groups include, for example, an ethoxyoxalyloxy group.

The above-mentioned groups capable of substituting through a sulfur atom include, for example, an alkylthio group, an arylthio group, a heterocyclic thio group, and an alkyloxythiocarbonylthio group.

The above-mentioned alkylthio groups include, for example, a butylthio group, a 2-cyanoethylthio group, a phenethylthio group, a benzylthio group and the like.

The above-mentioned arylthio groups include, for example, a phenylthio group, a 4-methanesulfonamidophenylthio group, a 4-dodecylphenethylthio group, a 4-nonafluoropentanamidophenethylthio group, a 4-carboxyphenylthio group, a 2-ethoxy-5-t-butylphenylthio group and the like.

The above-mentioned heterocyclic thio groups include, for example, a 1-phenyl-1,2,3,4-tetrazolyl-5-thio group, a 2-benzothiazolylthio group and the like.

The above-mentioned alkyloxythiocarbonylthio groups include, for example, a dodecyloxythiocarbonylthio group and the like.

The above-mentioned groups capable of substituting through a nitrogen atom include, for example, those represented by the following Formula:

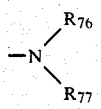

wherein $R_{76}$ and $R_{77}$ represent a hydrogen atom, an alkyl group, an aryl group, a heterocyclic group, a sulfamoyl group, a carbamoyl group, an acyl group, a sulfonyl group, an aryloxycarbonyl group and an alkoxycarbonyl group; and $R_{76}$ and $R_{77}$ may be coupled each other to form a heterohcyclic ring; provided that $R_{76}$ and $R_{77}$ are not hydrogen at the same time.

The above-mentioned alkyl groups may be the normal chained or branch chained and preferably those each having 1 to 22 carbon atoms. They are also allowed to have such a substituent as an aryl group, an alkoxy group, an aryloxy group, an alkylthio group, an arylthio group, an alkylamino group, an arylamino group, an acylamino group, a sulfonamido group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, and a halogen atom.

The typical examples of the alkyl groups include an ethyl group, an octyl group, a 2-ethylhexyl group and a 2-chlorethyl group.

The aryl groups represented by $R_{76}$ and $R_{77}$ include, for example those each having 6 to 32 carbon atoms and more preferably a phenyl group and a naphthyl group each having the same carbon atoms. The above-mentioned aryl groups are allowed to have such a substituent as those given to the alkyl groups represented by $R_{76}$ and $R_{77}$ and an alkyl group. The typical examples of the aryl groups include a phenyl group, a 1-naphthyl group, and a 4-methylsulfonylphenyl group.

The heterocyclic groups represented by $R_{76}$ and $R_{77}$ preferably include those of the 5- or 6-membered, and they are allowed to have a condensed ring and/or a substituent. The examples thereof include a 2-furyl group, a 2-quinolyl group, a 2-pyrimidyl group, a 2-benzothiazolyl group, a 2-pyridyl group and the like.

The sulfamoyl groups represented by $R_{76}$ and $R_{77}$ include, for example, a N-alkylsulfamoyl group, a N,N-dialkylsulfamoyl group, a N-arylsulfamoyl group, a N,N-diarylsulfamoyl group and the like. The above-mentioned alkyl and aryl groups are allowed to have the same substituents as those given with respect to the aforementioned alkyl and aryl groups. The typical examples of the sulfamoyl groups include a N,N-diethylsulfamoyl group, a N-methylsulfamoyl group, a N-dodecylsulfamoyl group, and a N-p-tolylsulfamoyl group.

The carbamoyl groups represented by $R_{76}$ and $R_{77}$ include, for example, a N-alkylcarbamoyl group, a N,N-dialkylcarbamoyl group, a N-arylcarbamoyl group, a N,N-diarylcarbamoyl group and the like. Such alkyl and aryl groups are allowed to have the same substituents as those given with respect to the aforementioned alkyl and aryl groups. The typical examples of the carbamoyl groups include a N,N-diethylcarbamoyl group, a a N-methylcarbamoyl group, a N-dodecylcarbamoyl group, a N-p-cyanophenylcarbamoyl group and a N-p-tolylcarbamoyl group.

The acyl groups represented by $R_{76}$ and $R_{77}$ include, for example, an alkylcarbonyl group, an arylcarbonyl group and a heterocyclic carbonyl group. The alkyl, aryl and heterocyclic agroups thereof are allowed to have a substituent. The typical examples of the acyl groups include a hexafluorobutanoyl group, a 2,3,4,5,6-pentafluorobenzoyl group, an acetyl group, a benzoyl group, a naphthoyl group, a 2-furylcarbonyl group and the like.

The sulfonyl groups represented by $R_{76}$ and $R_{77}$ include, for example, an alkylsulfonyl group an arylsulfonyl group and a heterocyclic sulfonyl group; and they are allowed to have a substituent. The typical examples thereof include an ehtanesulfonyl group, a benzenesulfonyl group, an octanesulfonyl group, a naphthalenesulfonyl group, a p-chlorobenzenesulfonyl group and the like.

The aryloxycarbonyl groups represented by $R_{76}$ and $R_{77}$ are allowed to have the same substituents as those given with respect to the above-mentioned aryl groups, and they typically include, for example, a phenoxycarbonyl group and the like.

The alkoxycarbonyl groups represented by $R_{76}$ and $R_{77}$ are allowed to have the same substituents as those given with respect to the above-mentioned alkyl groups, and they typically include, for example, a methoxycarbonyl group, a dodecyloxycarbonyl group, a benzyloxycarbonyl group and the like.

The hetrocyclic rings formed by coupling $R_{76}$ and $R_{77}$ to each other include, preferably those of the 5- or 6-membered; and they may be of the saturated or the unsaturated, and may be aromatic or not aromatic.

They may also be a condensed ring. Such heterocyclic rings include, for example, an N-phthalimido group, an N-succinimido group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyridone group, a phthaladione group, a 2-oxo-1-piperidinyl group and the like. Such heterocyclic groups may be substituted with an alkyl group, an aryl group, an alkyloxy group, an aryloxy group, an acyl group, a sulfonyl group, an akylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imido group, a nitro group, acyano group, a carboxyl group, a halogen atom and the like.

The nitrogen-containing heterocyclic rings each formed by the Z or Z' include, for example a pyrazole ring, an imidazole ring, a triazole ring, a tetrazole ring or the like. The substituents which the above-mentioned rings are allowed to have include, for example, those given with respect to the $R_{73}$.

On the heterocyclic rings represented by the Formula [H-I] and the Formulas [H-II] through [H-VIII] which will be described later, and when such a substituent as $R_{73}$ or $R_{76}$ through $R_{82}$ has the following portion;

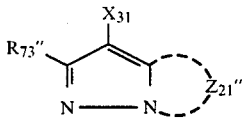

wherein $R_{73}''$, $X_{31}$ and $Z_{21}''$ are synonymous with $R_{73}$, $X_{31}$ and $Z_{21}$ in the Formula [H-I]; the so-called bis-type couplers are formed and it is the matter of course that the couplers shall be within the scope of the invention. It is also allowed that the rings formed by $Z_{21}$, $Z_{21}'$, $Z_{21}''$ and $Z_{21}$ which will be described later are condensed with a further ring such as a 5- to 7-membered cycloalkene. For example, $R_{81}$ and $R_{82}$ in the Formula [H-IV], or $R_{83}$ and $R_{84}$ in the Formula [H-V], may be coupled to each other so as to form such a ring as a 5- to 7-membered cycloalkene or benzene.

Those represented by the Formula [H-I] are further represented by the following Formulas [H-II] through [H-VII];

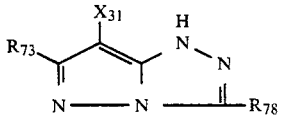

Formula [H-II]

-continued

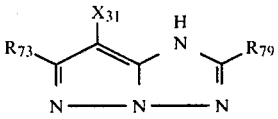

Formula [H-III]

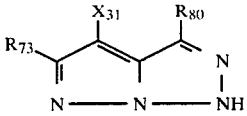

Formula [H-IV]

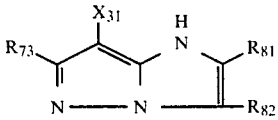

Formula [H-V]

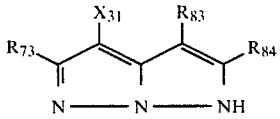

Formula [H-VI]

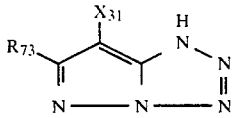

Formula [H-VII]

In the Formulas [H-II] through [H-VII], $R_{78}$ through $R_{84}$ and $X_3$ are synonymous with the above-mentioned $R_{73}$ and $X_3$, respectively.

The preferable ones represented by the Formula [H-I] are those represented by the following Formula [H-VIII];

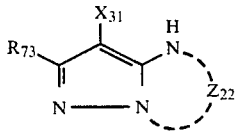

Formula [H-VIII]

wherein $R_{73}$, $X_3$ and $Z_{22}$ are synonymous with $R_{73}$, $X_3$ and $Z_{21}$ denoted in the Formula [H], respectively.

The particularly preferable magenta couplers among those represented by the Formulas [H-II] through [H-VII] are the magenta couplers represented by the Formula [H-II].

With respect to the substituents on the heterocyclic rings in the Formulas [H-I] through [H-VIII], it is preferable when the R in the Formula [H-I], or the $R_{37}$ in the Formulas [H-II] through [H-VIII], satisfies the following requirement 1; more preferable when satisfying the requirements 1 and 2; and particularly preferable when satisfying the requirements 1, 2 and 3:

Requirement 1: A root atom directly coupled to a heterocyclic ring is a carbon atom.

Requirement 2: The carbon atom is coupled with only one hydrogen atom, or it is not coupled at all.

Requirement 3: All the couplings between the carbon atom and the adjacent atoms are single couplings.

The most preferable substituent represented by $R_{73}$ on the above-mentioned heterocyclic ring is that represented by the following Formula [H-IX]:

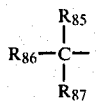

Formula [H-IX]

wherein $R_{85}$, $R_{86}$ and $R_{87}$ represent a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro compound residual group, a cross-linked hydrocarbon compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group; provided that at least two of $R_{85}$, $R_{86}$ and $R_{87}$ are not a hydrogen atom.

It is allowed that such a saturated or unsaturated ring as a cycloalkane, cycloalkene or heterocyclic ring may be formed by coupling two of the above-mentioned $R_{85}$, $R_{86}$ and $R_{87}$, that is, $R_{85}$ and $R_{86}$, for example; and it is further allowed that a cross-linled hydrocarbon compound residual group may be formed by coupling $R_{87}$ to the above-mentioned ring.

The groups represented by any one of the $R_{85}$ through $R_{87}$ are allowed to have a substituent. The typical examples of the groups represented by any one of the $R_{85}$ through $R_{87}$, and the substituents thereof include the typical examples of the groups represented by $R_{73}$ on the aforegiven Formula [H-I] and the substituents thereof.

In the rings formed by coupling $R_{85}$ to $R_{86}$, for example, and the typical examples of the cross-linked hydrocarbon compound residual groups formed from the $R_{85}$ through $R_{87}$ and the substituents thereof, there may include the typical examples of a cycloalkyl group, a cycloalkenyl group, a heterocyclic group and a bridged hydrocarbon compound residual group, and the substituents thereof, each of which is represented by the $R_{73}$ in the aforegiven Formula [H-I].

Those represented by the Formula [H-IX] may be preferable in the following cases;

(i) that any two of the $R_{85}$ through $R_{87}$ are an alkyl group; and (ii) that one of the $R_{85}$ through $R_{87}$, that is, $R_{87}$ for example, is a hydrogen and the other two, that is, $R_{85}$ and $R_{86}$, are coupled to each other, so that a cycloalkyl group may be formed with a root carbon atom.

A further preferable one in the above-mentioned case (i) is that any two of the $R_{85}$ through $R_{87}$ are alkyl groups and the rest is a hydrogen atom or an alkyl group.

Wherein, the above-mentioned alkyl and cycloalkyl groups are further allowed to have a substituent. The typical examples of the above-mentioned alkyl groups, cycloalkyl groups and substituents include those represented by $R_{73}$ in the aforegiven Formula [H-I].

The substituents which the rings formed by $Z_{21}$ or $Z_{22}$ in the Formula [H-I] or [H-VIII], respectively, and those represented by $R_{78}$ through $R_{84}$ in the Formulas [H-II] through [H-VI] are allowed to have, preferably include, for example, those represented by the following Formula [H-X]:

Formula [H-X]

$$-R_{88}-SO_2-R_{89}$$

wherein $R_{88}$ represents an alkylene group; and $R_{89}$ represents an alkyl, cycloalkyl or aryl group.

The alkylene groups represented by the $R_{88}$ are preferably those each having not less than 2 carbon atoms in the normal-chained portion thereof and, more preferably those each having 3 to 6 carbon atoms, regardless of the normal chained or branch chained; and the above-mentioned alkyl groups are allowed to have a substituent.

The examples of the above-mentioned substituents include those which the alkyl groups are allowed to have, in the case that the alkyl groups are represented by R in the aforegiven Formula [H-I].

The preferable ones of the above-mentioned substituents include, for example, a phenyl group.

The preferable examples of the alkylene groups represented by the $R_{88}$ will typically be given below:

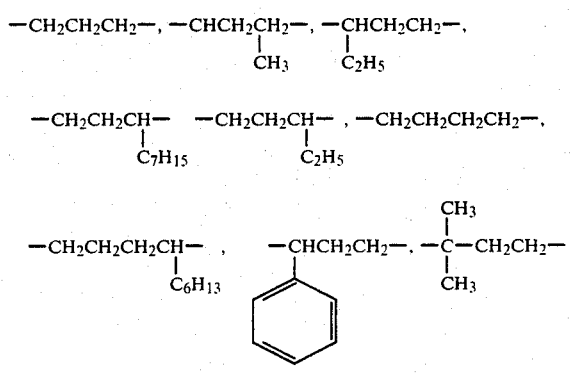

The alkyl groups represented by $R_{89}$ are regardless of the normal chained or branched chained; and they typically include, for example, a methyl, ethyl, propyl, isopropyl, butyl, 2-ethylhexyl, octyl, dodecyl, tetradecyl, hexadecyl, octadecyl, 2-hexyldecyl or like groups.

The cycloalkyl groups represented by $R_{89}$ preferably include, for example, the 5- or 6-membered ones and typically a cyclohexyl group.

The alkyl and cycloalkyl groups represented by $R_{89}$ are allowed to have a substituent including, for example, the substituents exemplified for the $R_{88}$.

The typical examples of the Aryl groups represented by the $R_{89}$ include a phenyl group and a naphthyl group. Such aryl groups are allowed to have a substituent. Such substituents include, for example, a normal chained or branch chained alkyl group and besides those exemplified as the substituents for the above-mentioned $R_{88}$.

When there are not less than two substituents, they are allowed to be the same with or the different from each other.

The particularly preferable compounds represented by the aforegiven Formula [H-I] are represented by the following Formula [H-XI]:

Formula [H-XI]
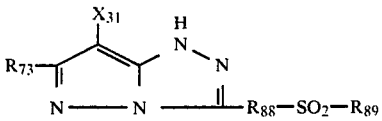
wherein $R_{73}$ and $X_3$ are synonymous with the $R_{73}$ and $X_3$ in the Formula [H-I]; and $R_{88}$ and $R_{89}$ are synonymous with the $R_{88}$ and $R_{89}$ in the Formula [H-X], respectively.
MII-1
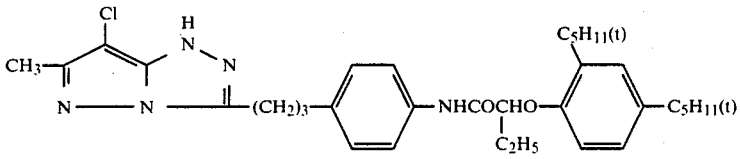
MII-2
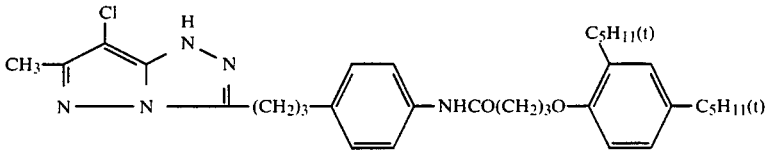
MII-3
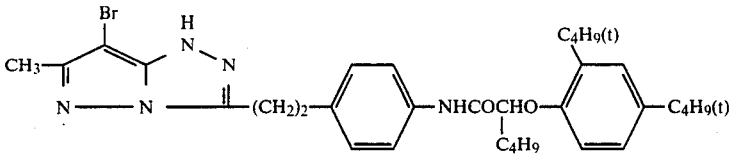
MII-4
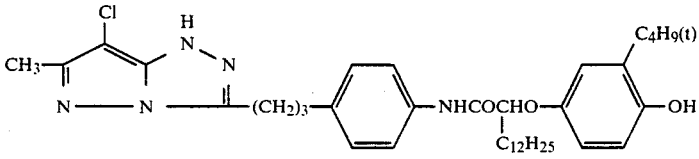
MII-5
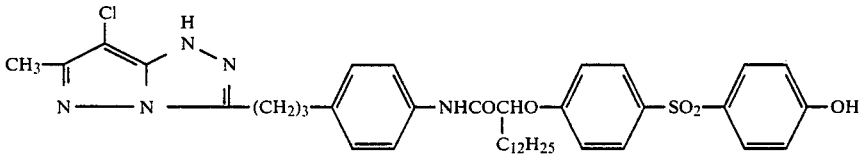
MII-6
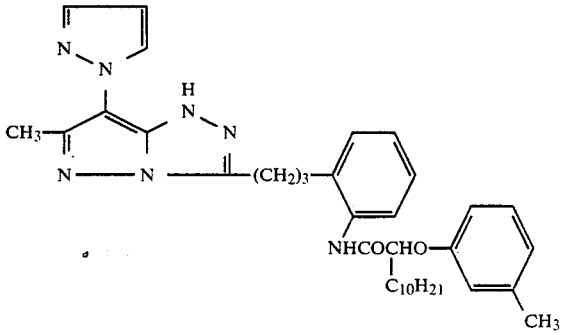
MII-7
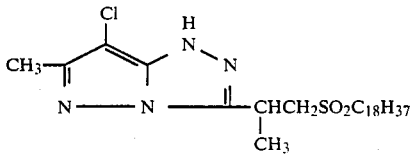

-continued
MII-8
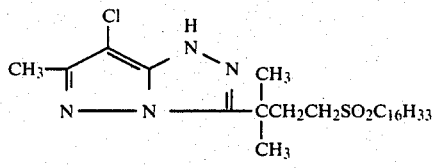
MII-9
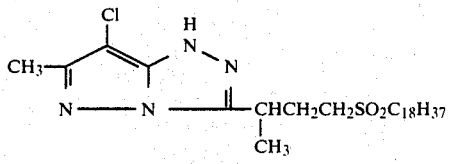
MII-10
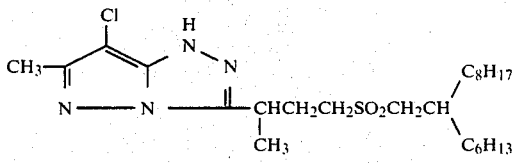
MII-11
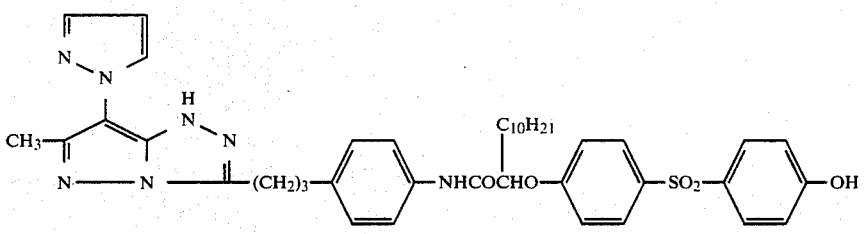
MII-12
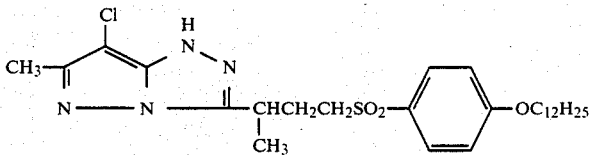
MII-13
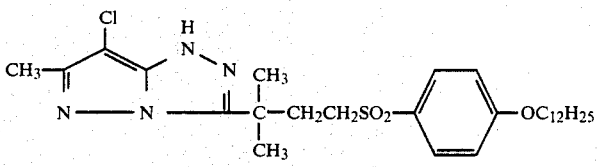
MII-14
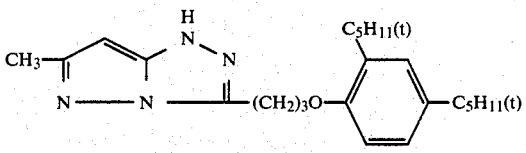
MII-15
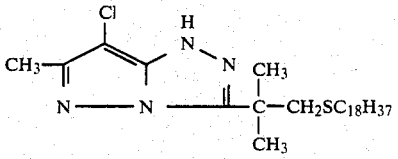
MII-16
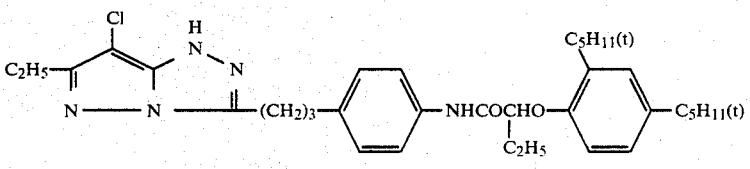

-continued
MII-17
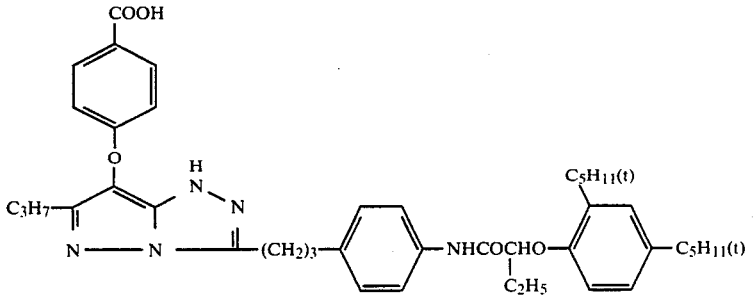
MII-18
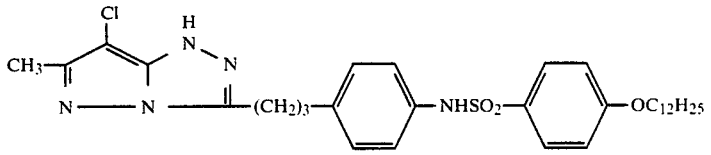
MII-19
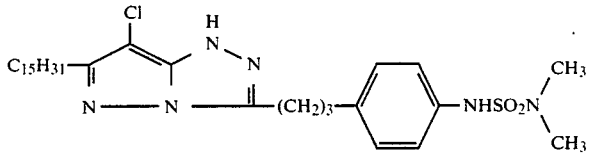
MII-20
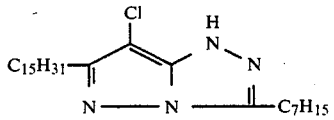
MII-21
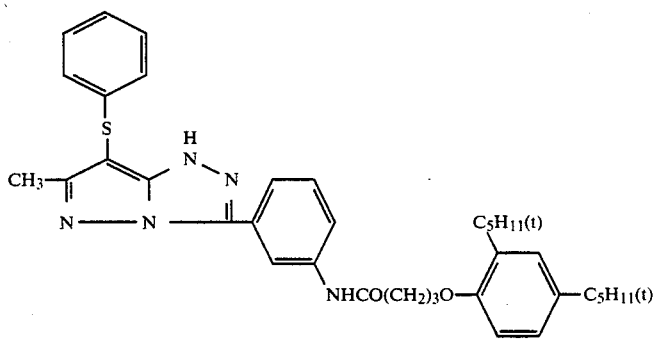
MII-22
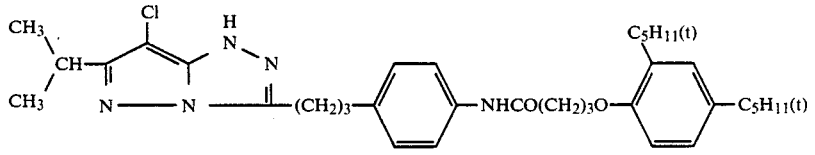
MII-23
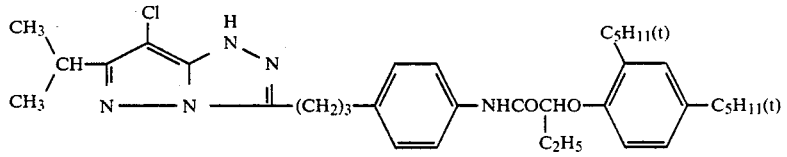
MII-24
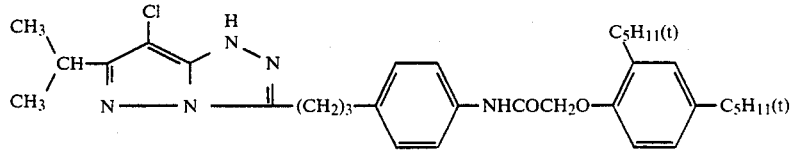

-continued
MII-25
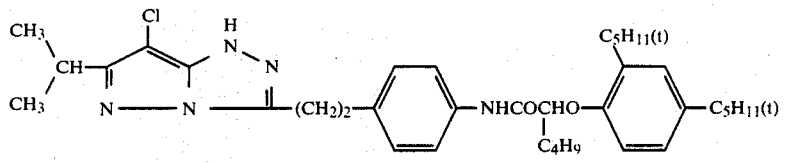
MII-26
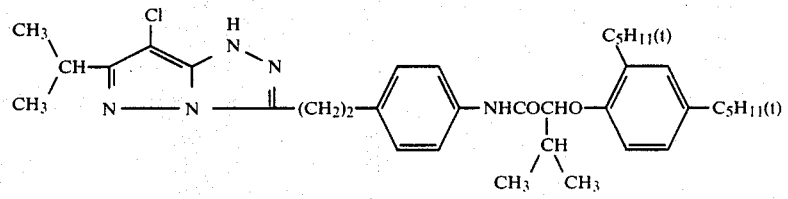
MII-27
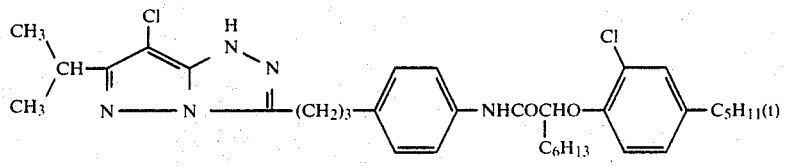
MII-28
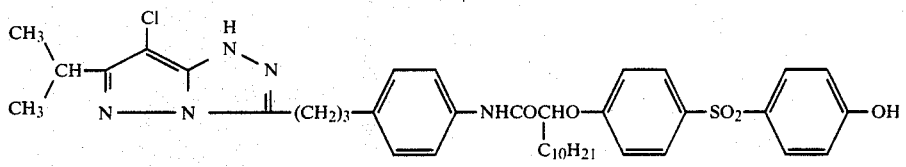
MII-29
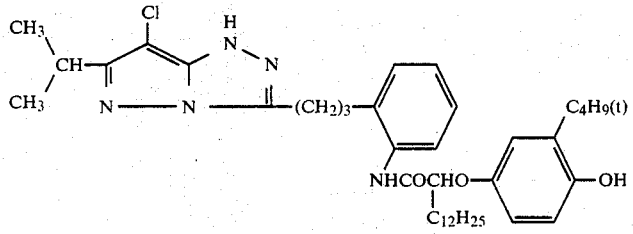
MII-30
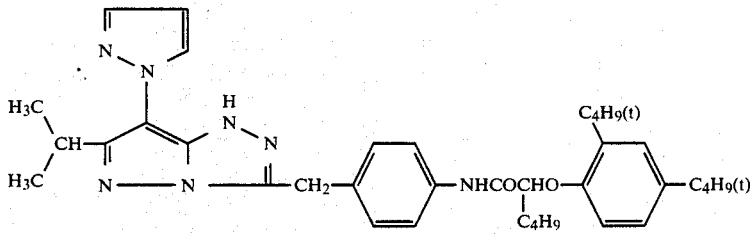
MII-31
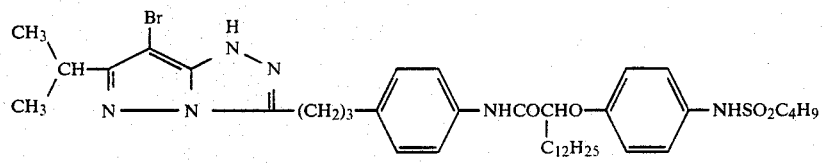
MII-32
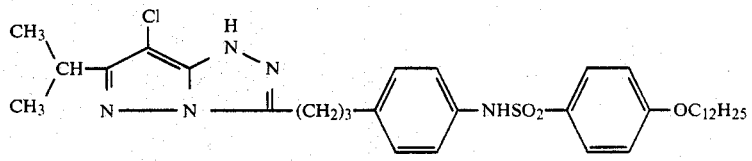

-continued
MII-33
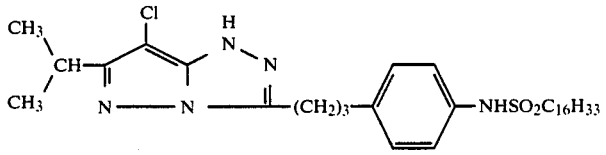
MII-34
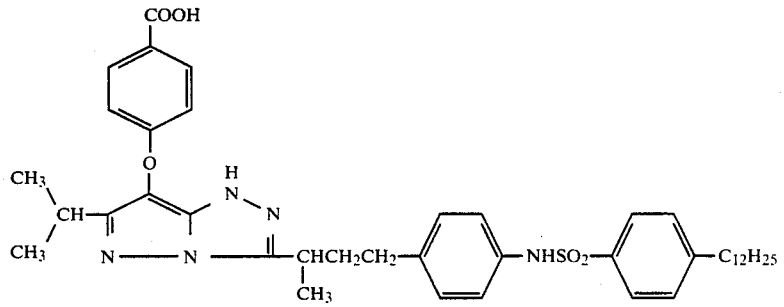
MII-35
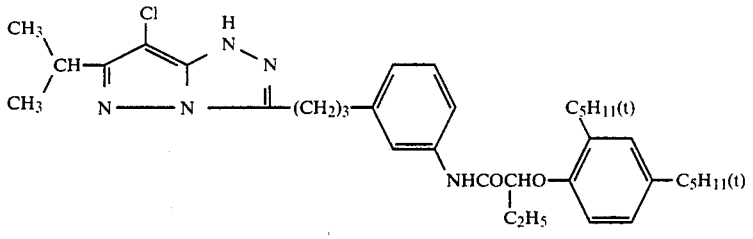
MII-36
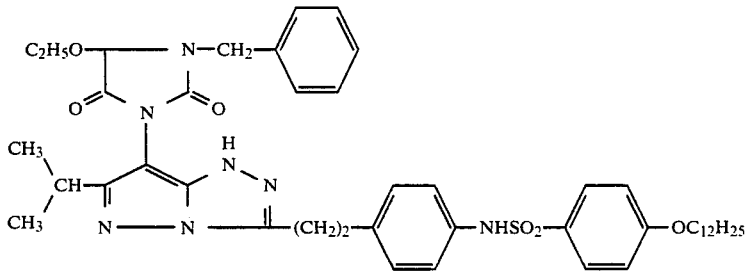
MII-37
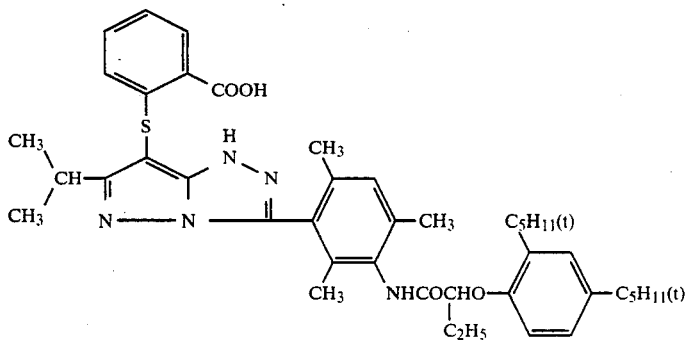
MII-38
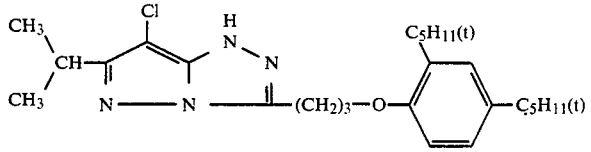

-continued
MII-39
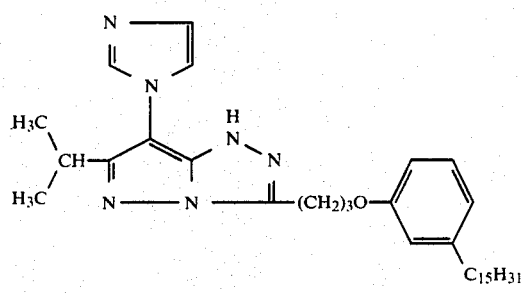
MII-40
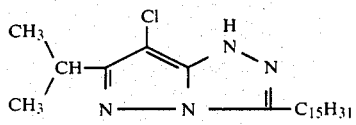
MII-41
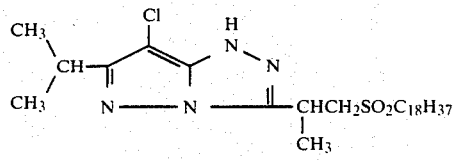
MII-42
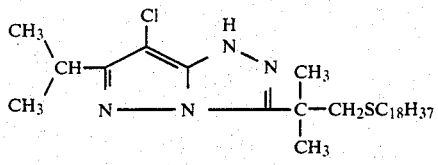
MII-43
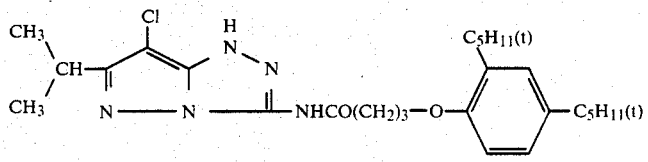
MII-44
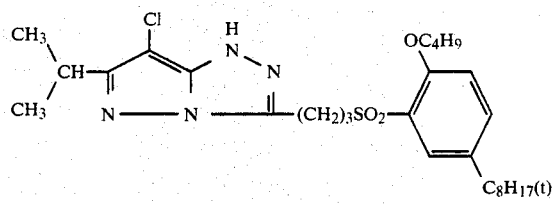
MII-45
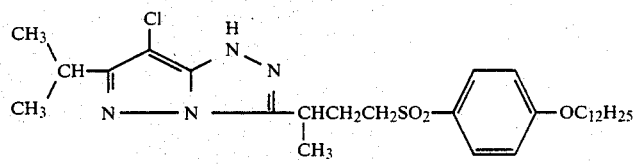
MII-46
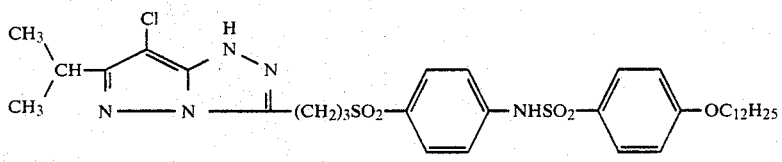
MII-47
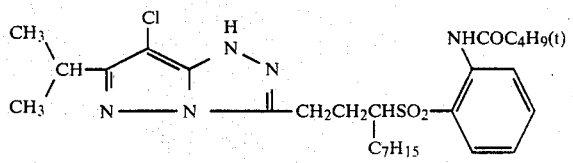

-continued
MII-48
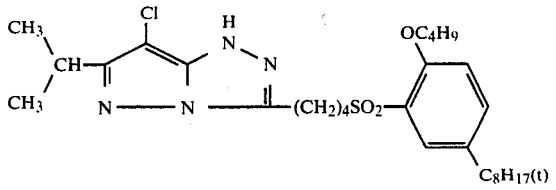
MII-49
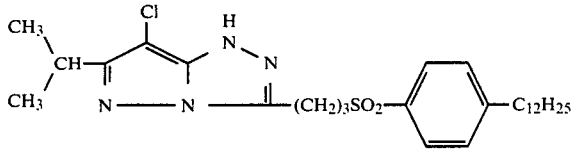
MII-50
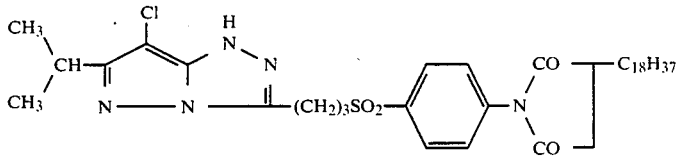
MII-51
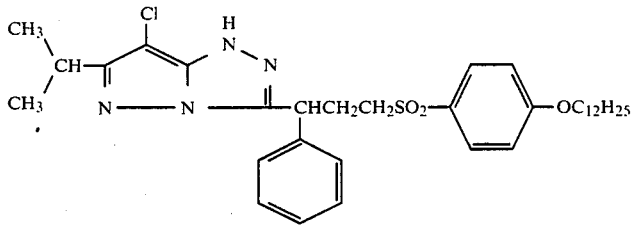
MII-52
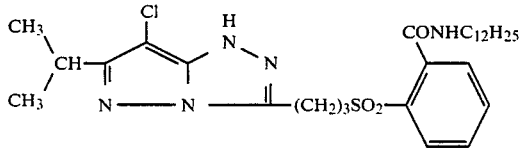
MII-53
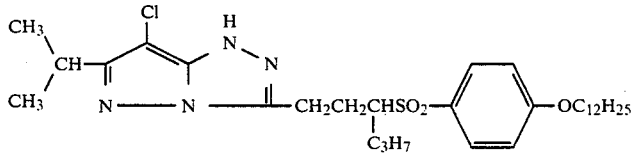
MII-54
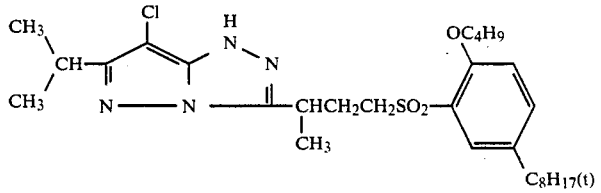
MII-55
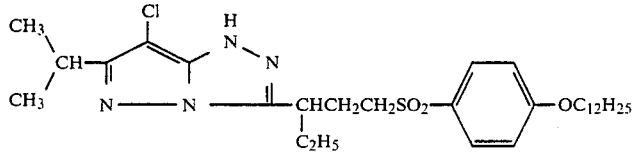
MII-56
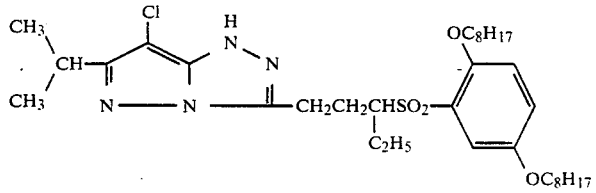

-continued
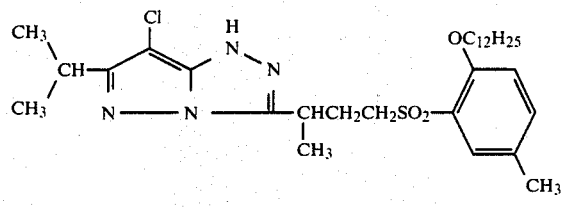
MII-57
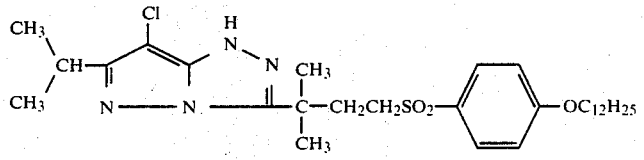
MII-58
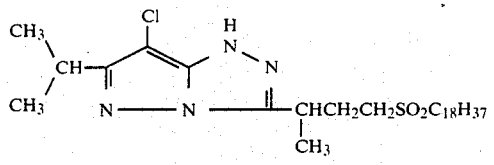
MII-59
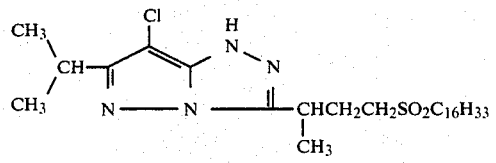
MII-60
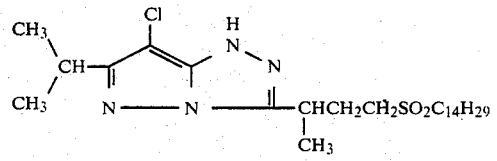
MII-61
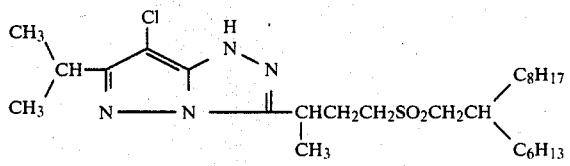
MII-62
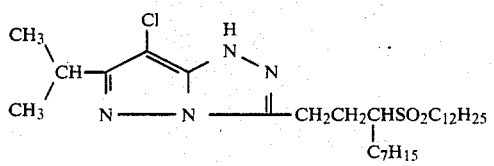
MII-63
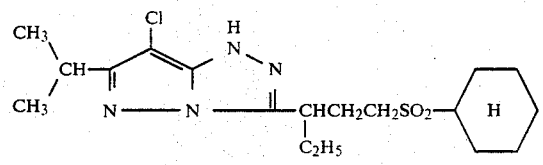
MII-64

-continued
MII-65
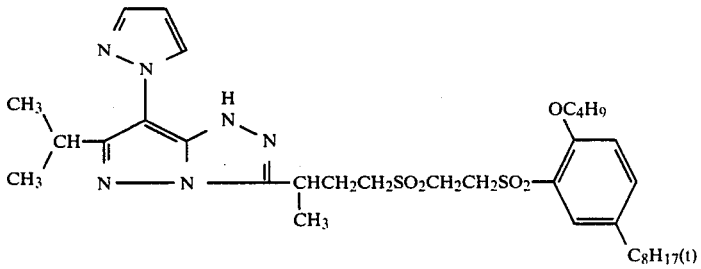
MII-66
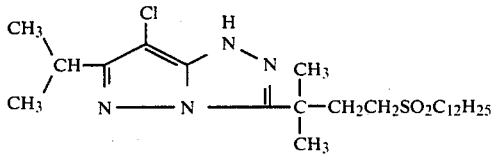
MII-67
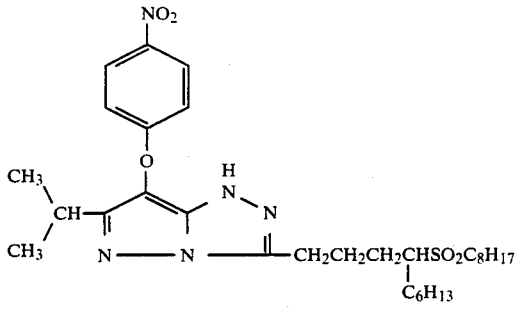
MII-68
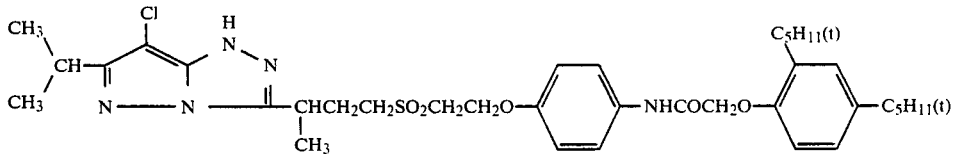
MII-69
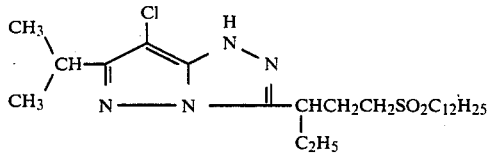
MII-70
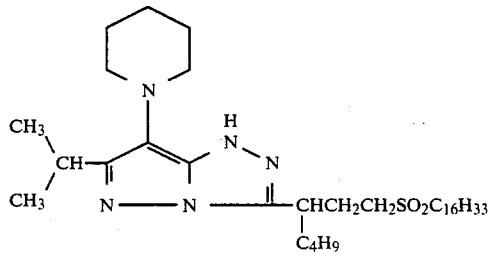
MII-71
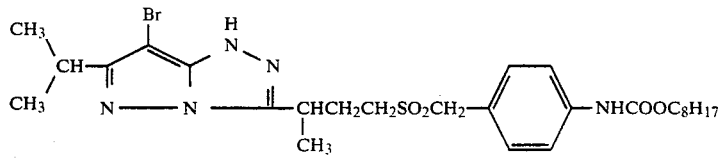

-continued
MII-72
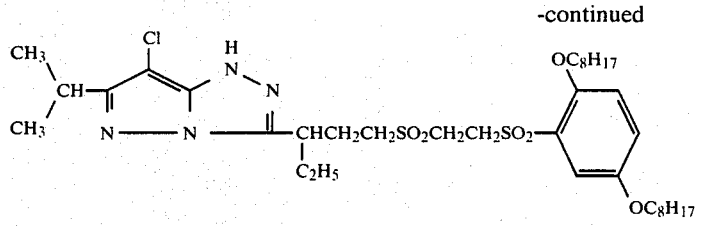
MII-73
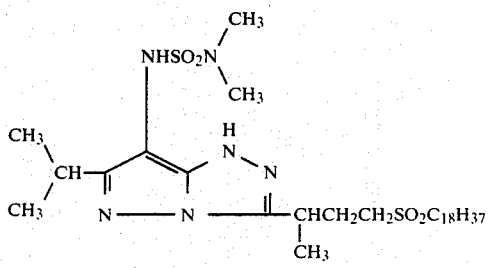
MII-74
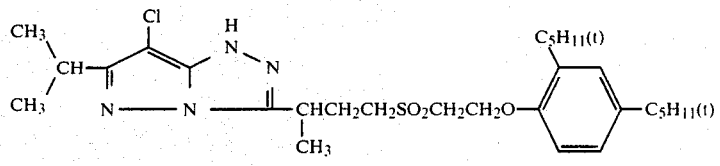
MII-75
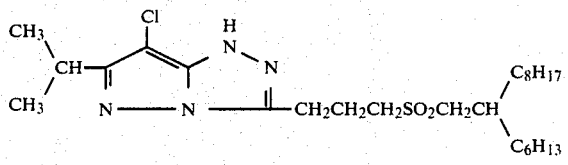
MII-76
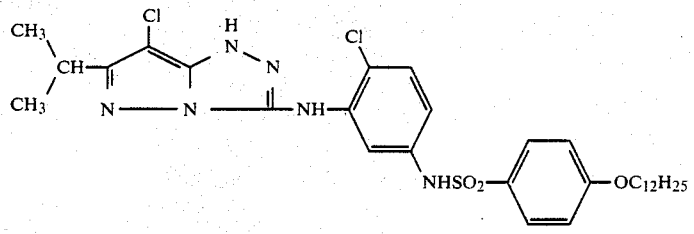
MII-77
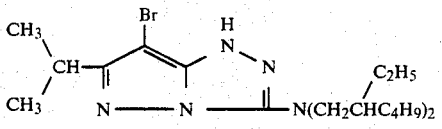
MII-78
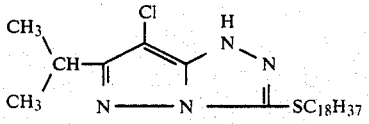
MII-79
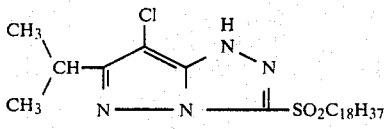
MII-80
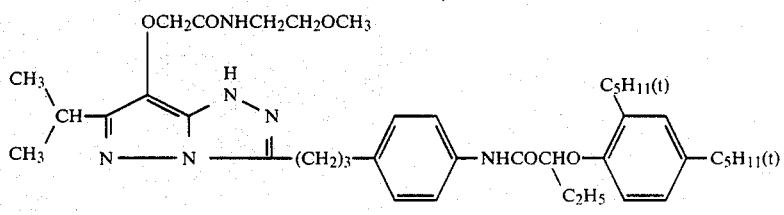

-continued
MII-81
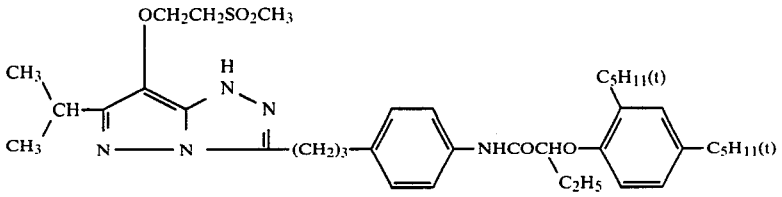
MII-82
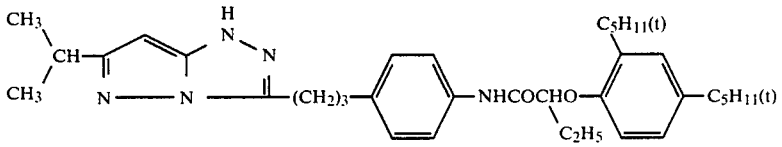
MII-83
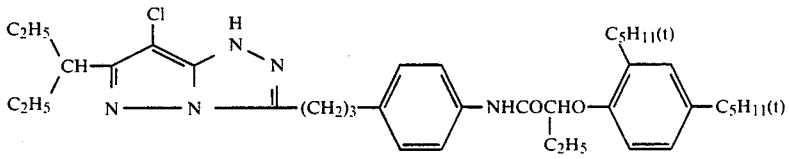
MII-84
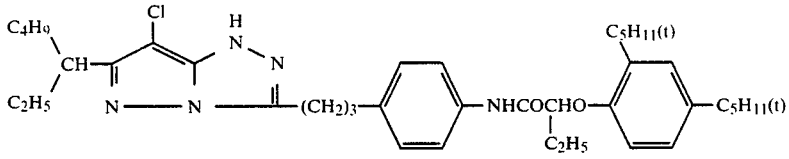
MII-85
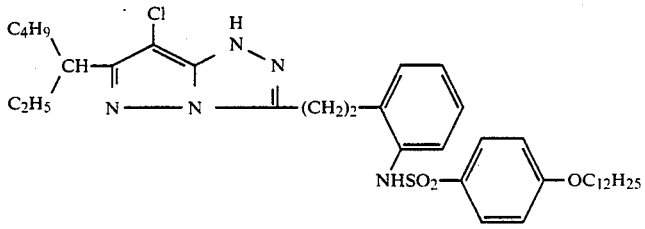
MII-86
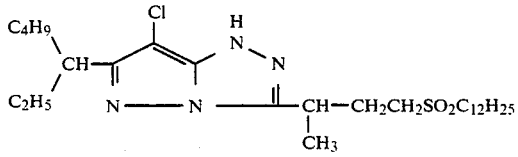
MII-87
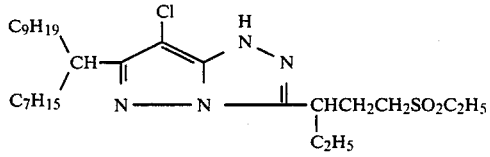
MII-88
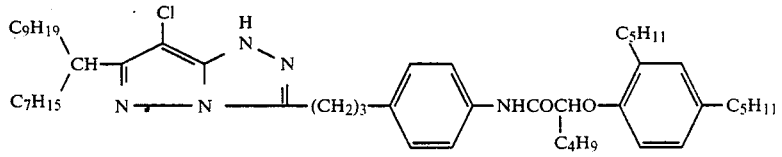
MII-89
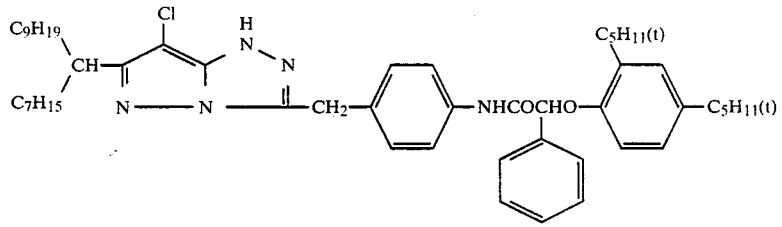

-continued
MII-90
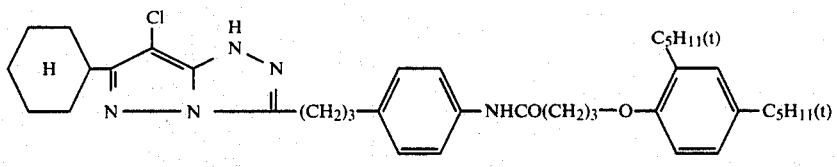
MII-91
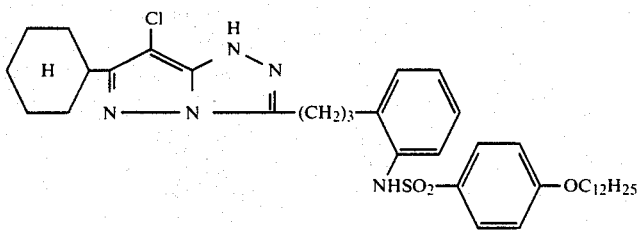
MII-92
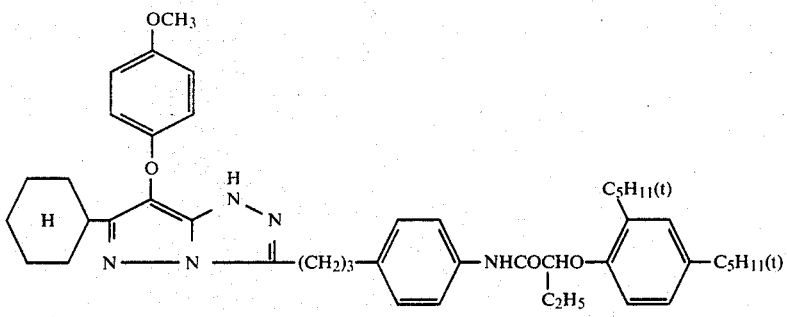
MII-93
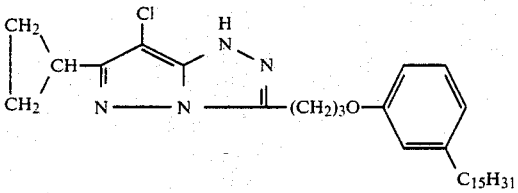
MII-94
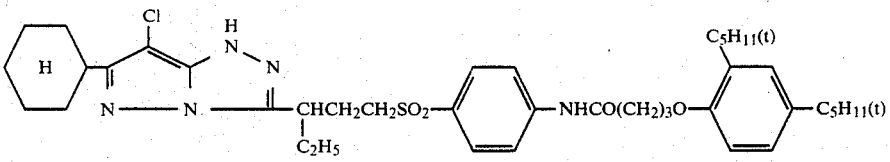
MII-95
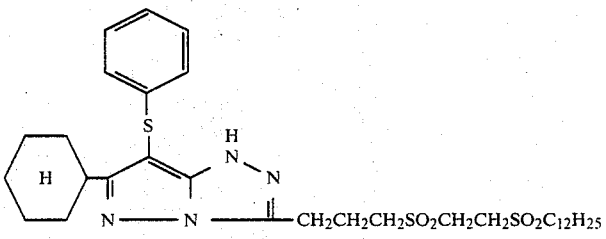
MII-96
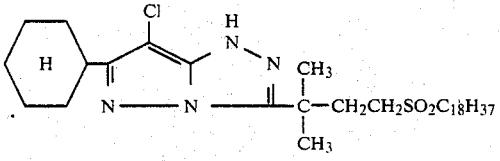

-continued
MII-97
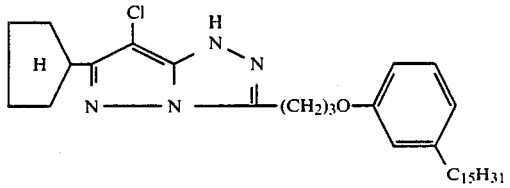
MII-98
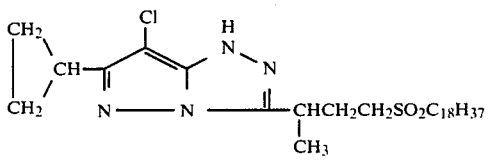
MI-99
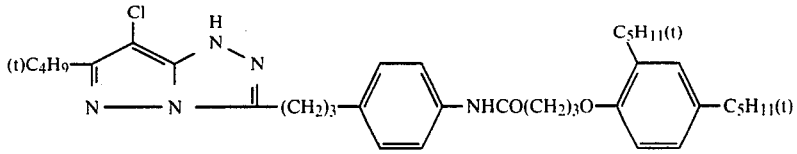
MII-100
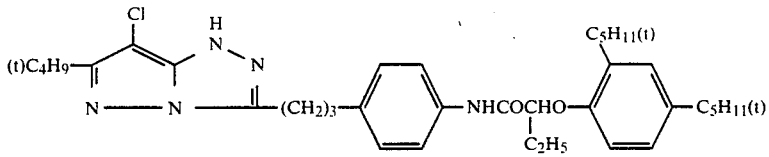
MII-101
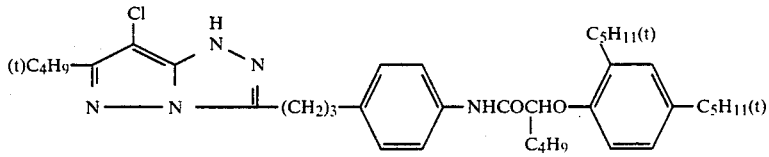
MII-102
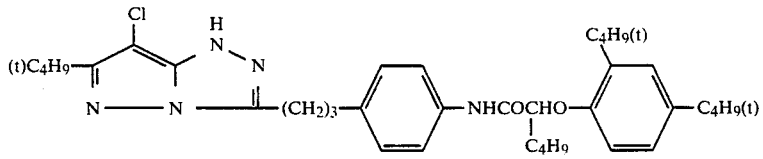
MII-103
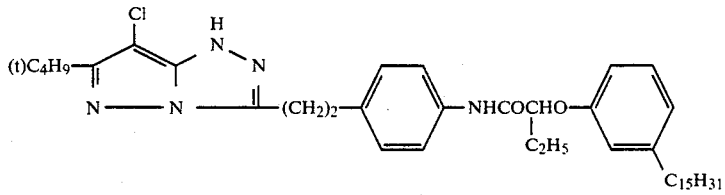
MII-104
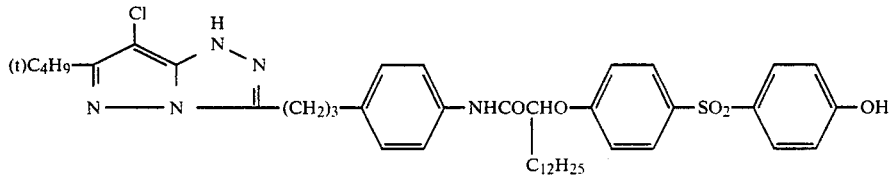
MII-105
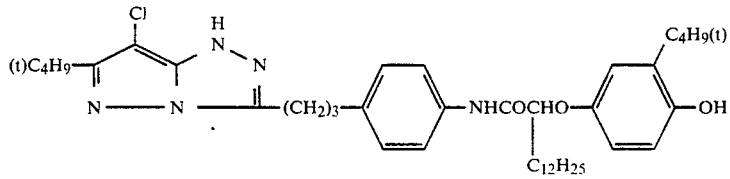

-continued
MII-106
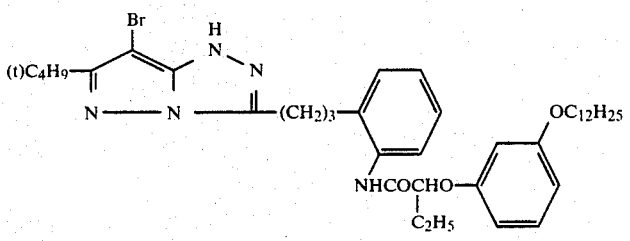
MII-107
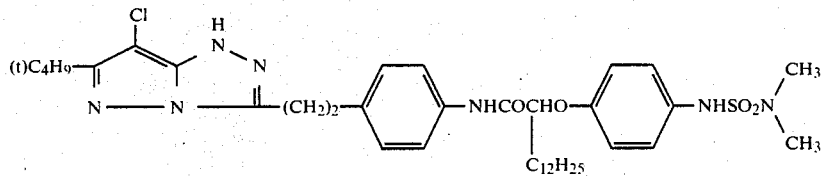
MII-108
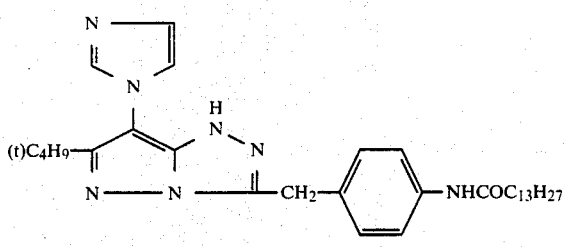
MII-109
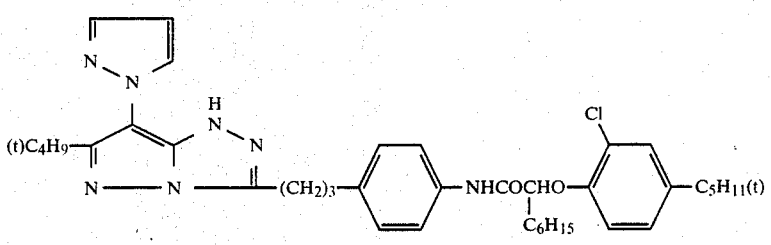
MII-110
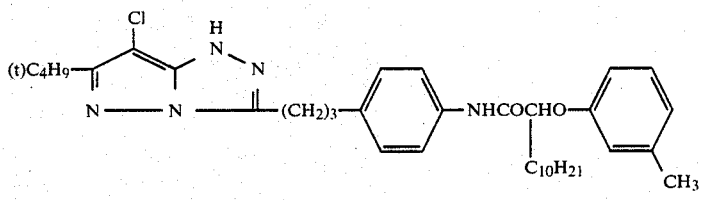
MII-111
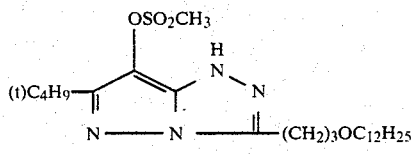
MII-112
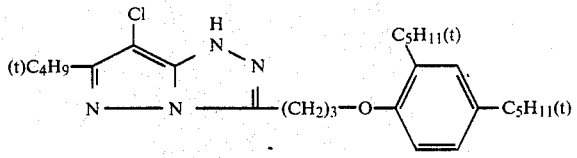

-continued
MII-113
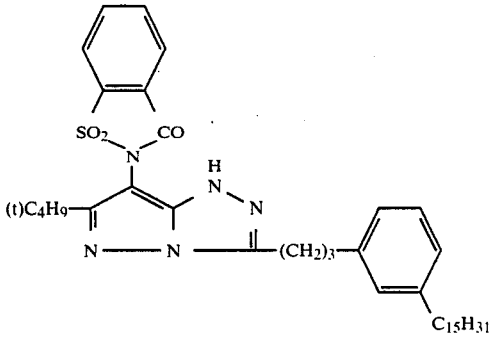
MII-114
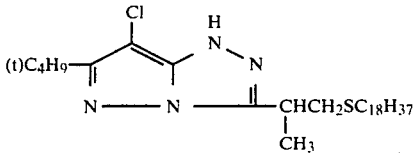
MII-115
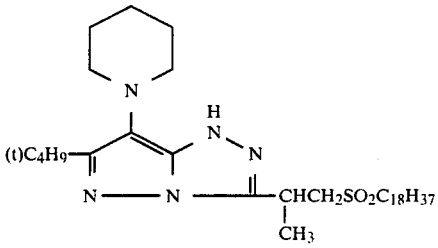
MII-116
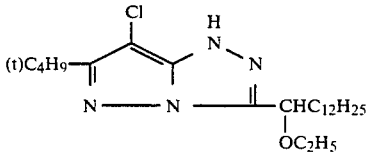
MII-117
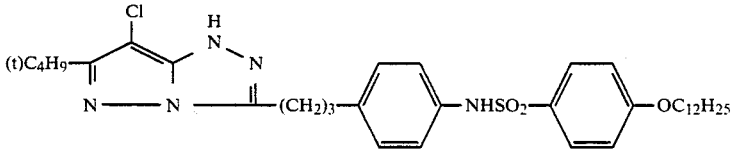
MII-118
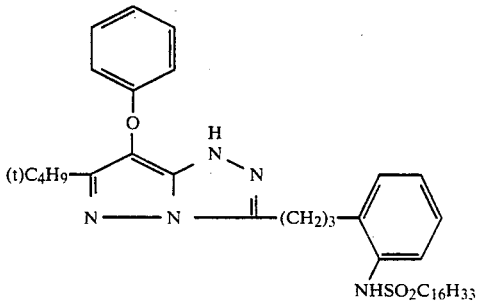
MII-119
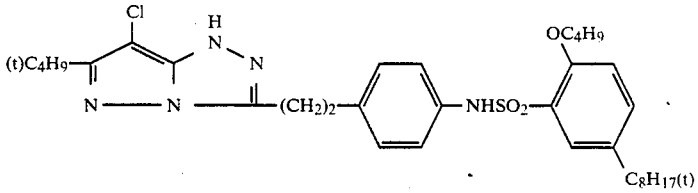

-continued
MII-120
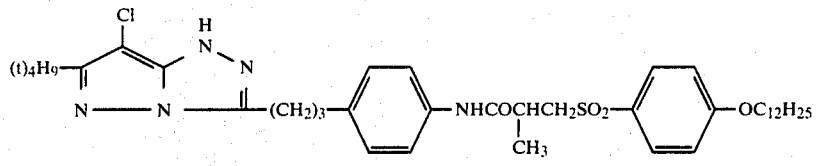
MII-121
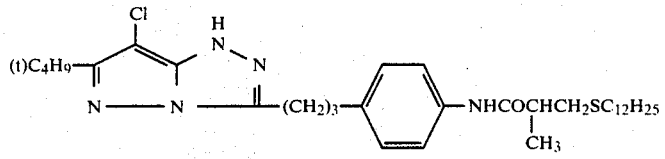
MII-122
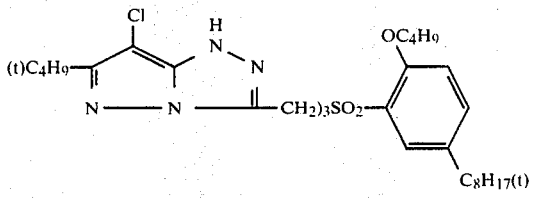
MII-123
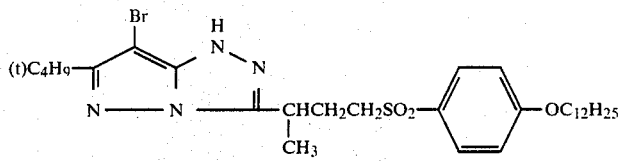
MII-124
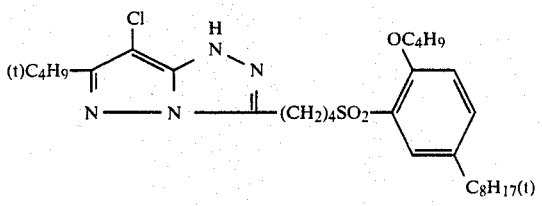
MII-125
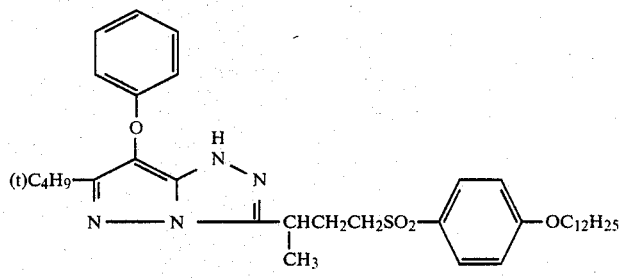
MII-126
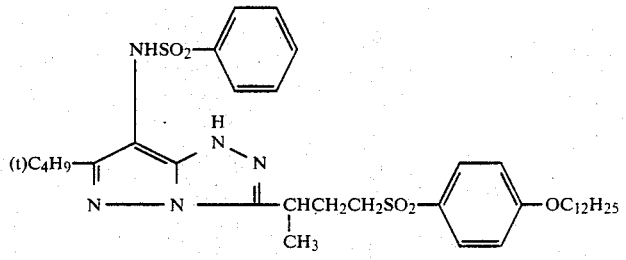
MII-127
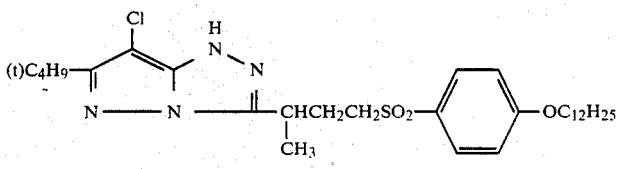

-continued
MII-128
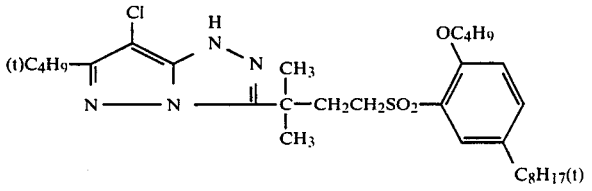
MII-129
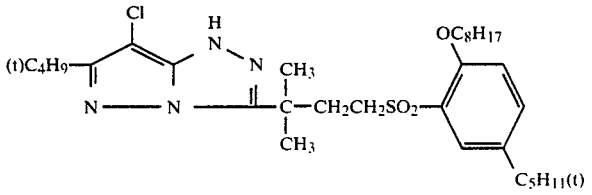
MII-130
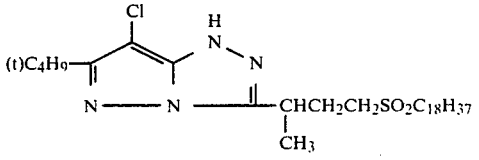
MII-131
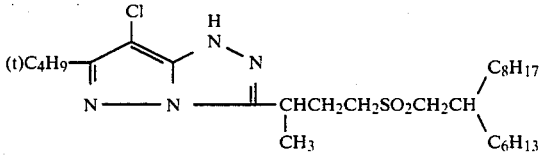
MII-132
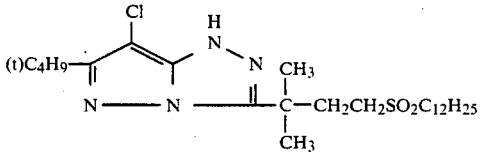
MII-133
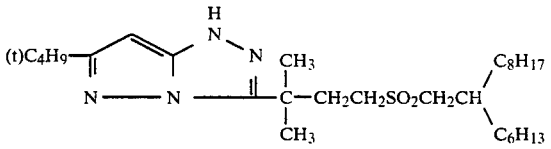
MII-134
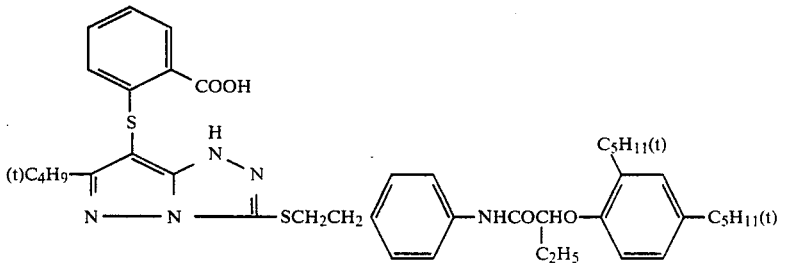
MII-135
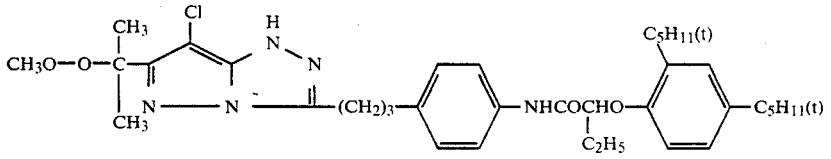

-continued
MII-136
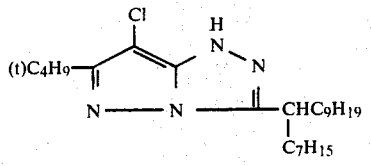
MII-137
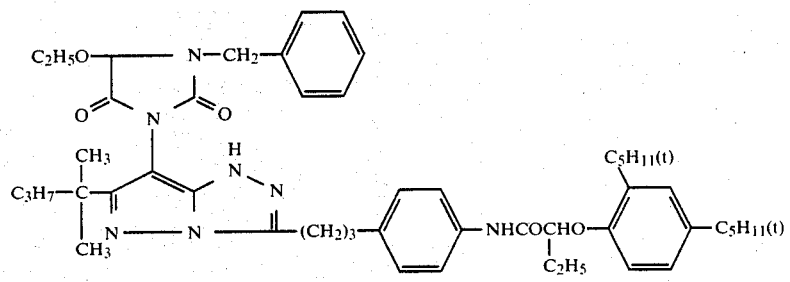
MII-138
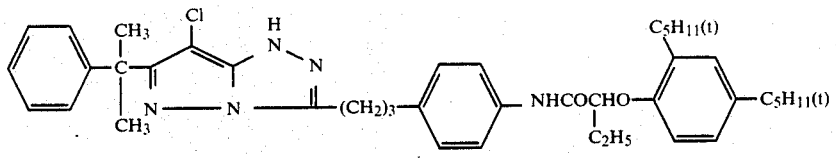
MII-139
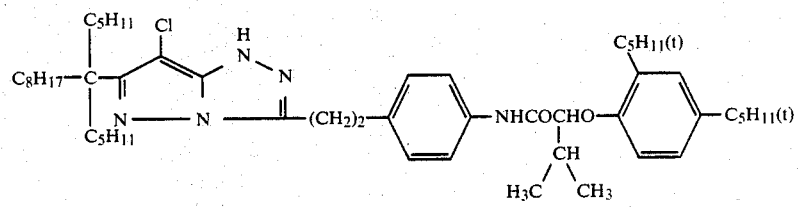
MII-140
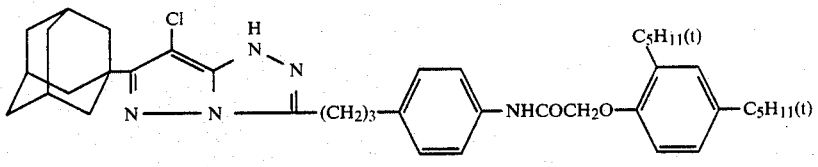
MII-141
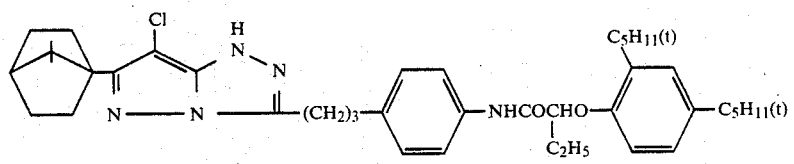
MII-142
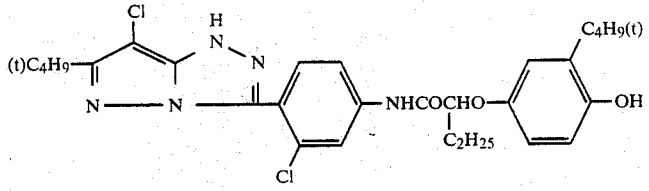

-continued
MII-143
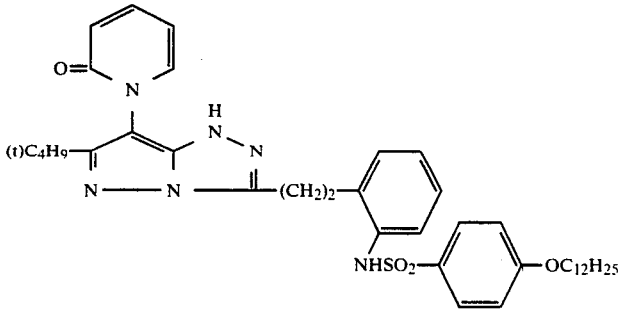
MII-144
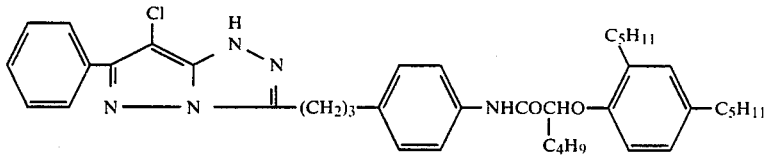
MII-145
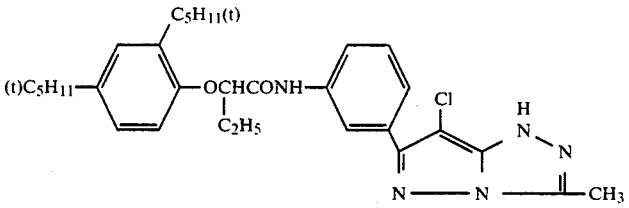
MII-146
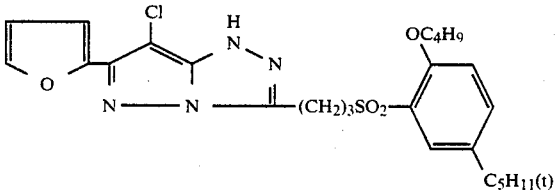
MII-147
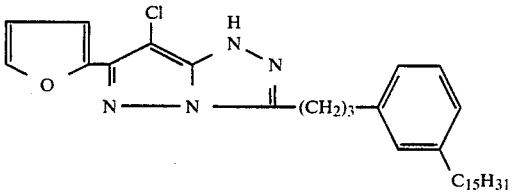
MII-148
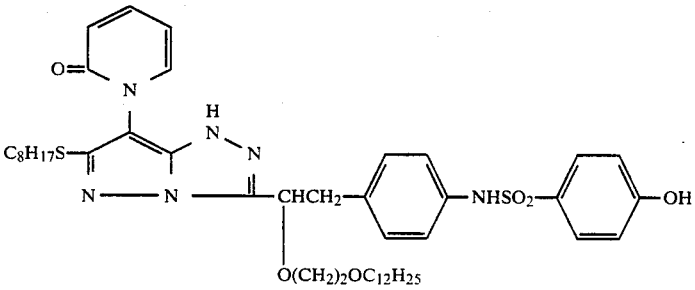
MII-149
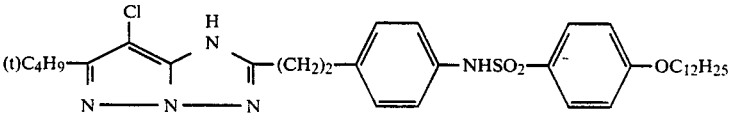

-continued
MII-150
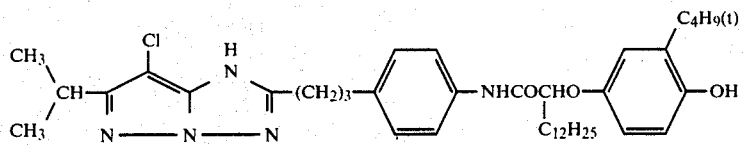
MII-151
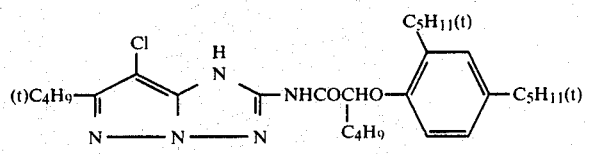
MII-152
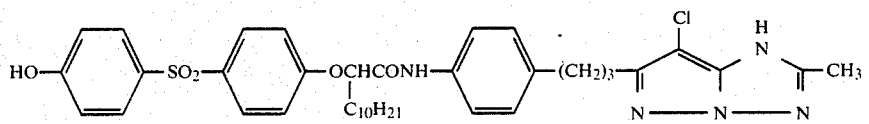
MII-153
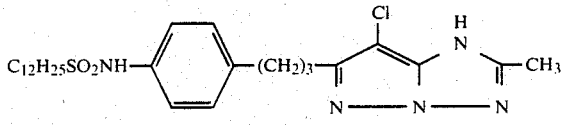
MII-154
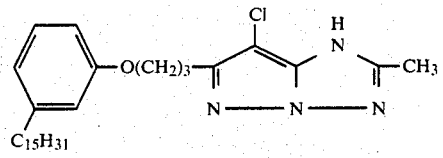
MII-155
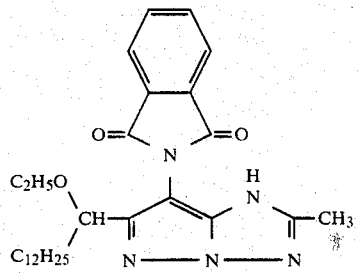
MII-156
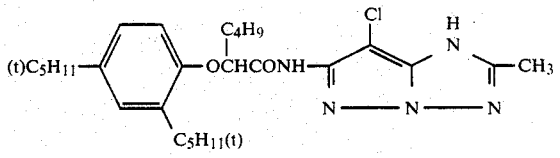
MII-157
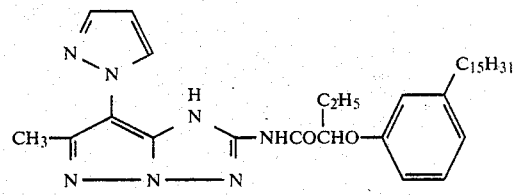
MII-158
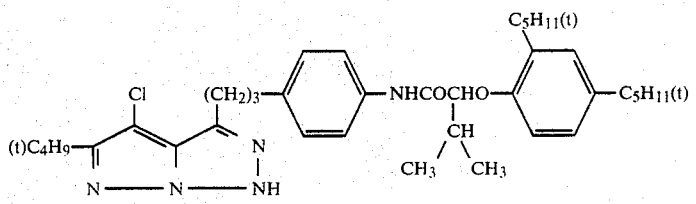

-continued
MII-159
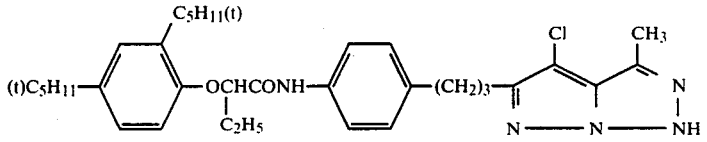
MII-160
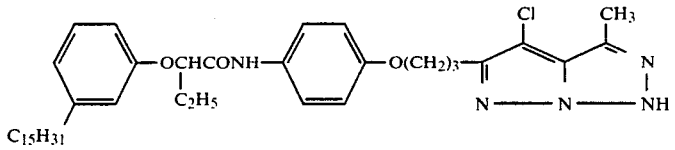
MII-161
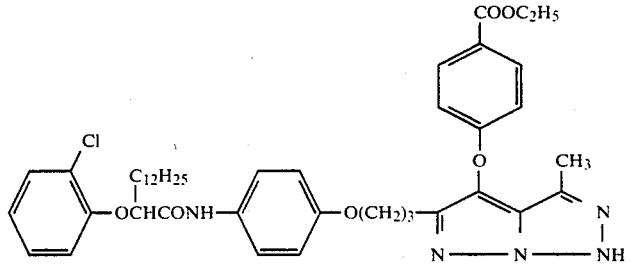
MII-162
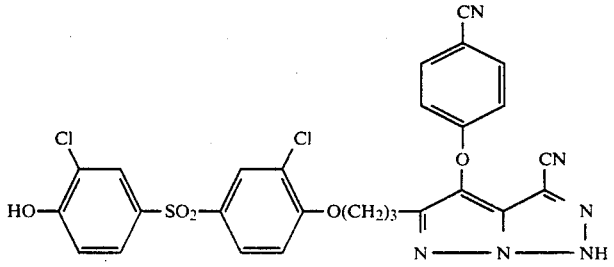
MII-163
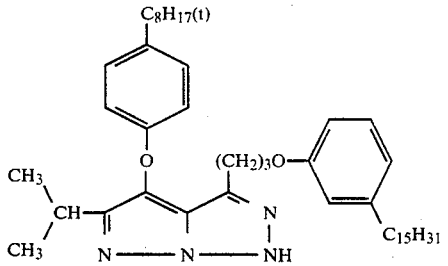
MII-164
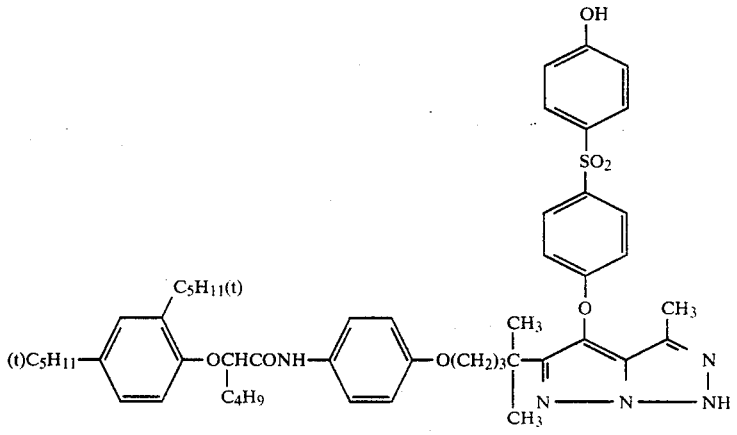

-continued
MII-165
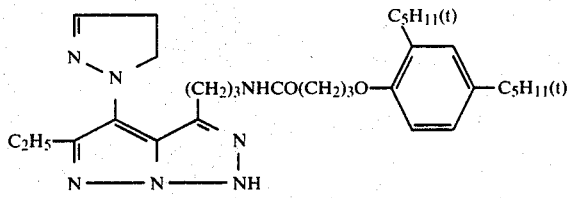
MII-166
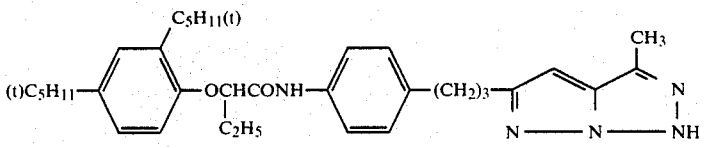
MII-167
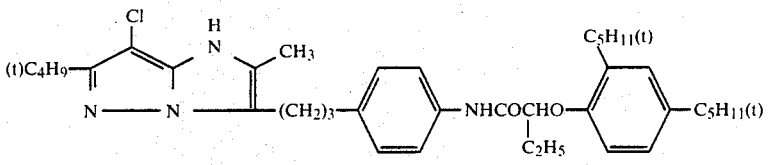
MII-168
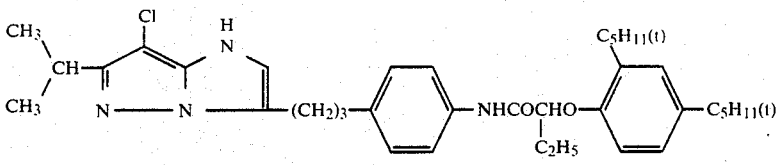
MII-169
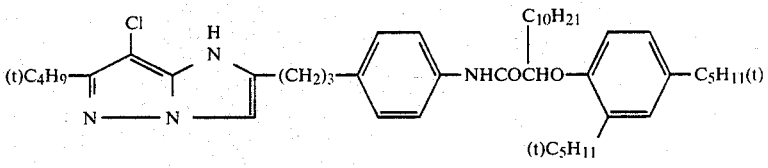
MII-170
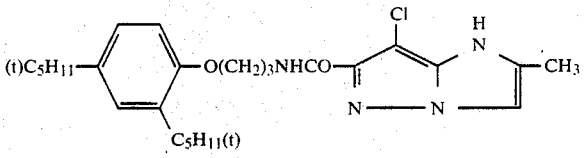
MII-171
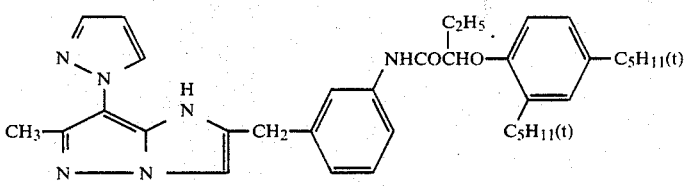
MII-172
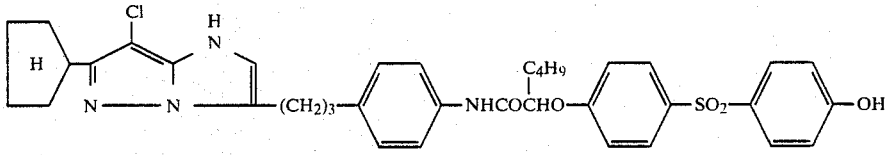
MII-173
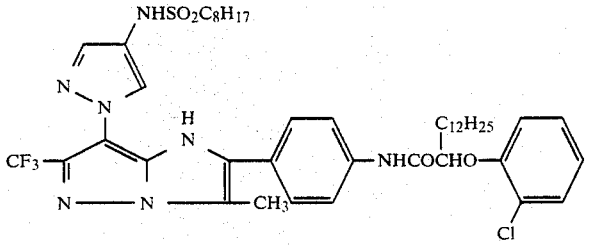

-continued
MII-174
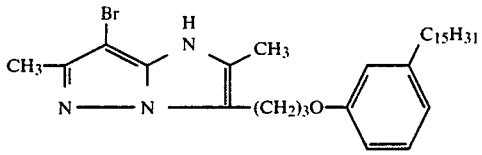
MII-175
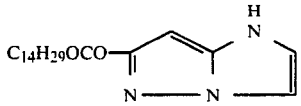
MII-176
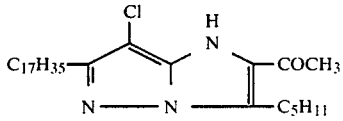
MII-177
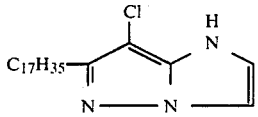
MII-178
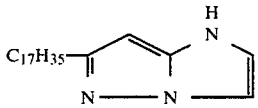
MII-179
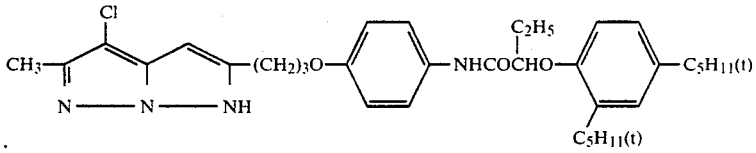
MII-180
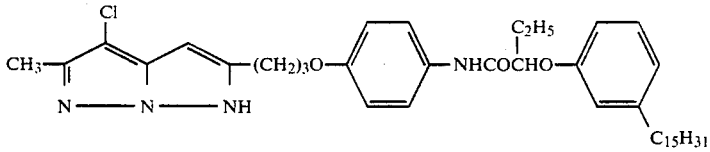
MII-181
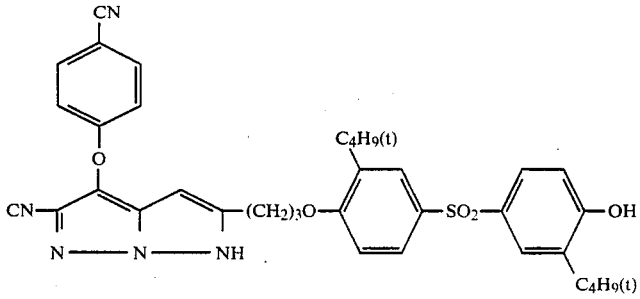
MII-182
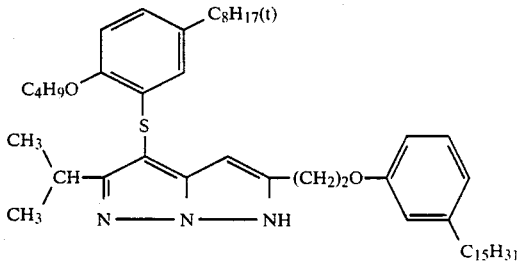

-continued
MII-183
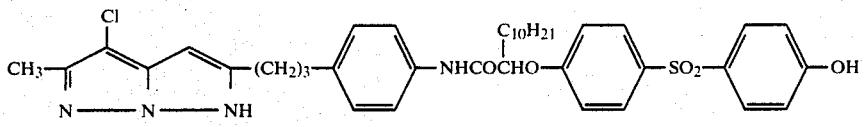
MII-184
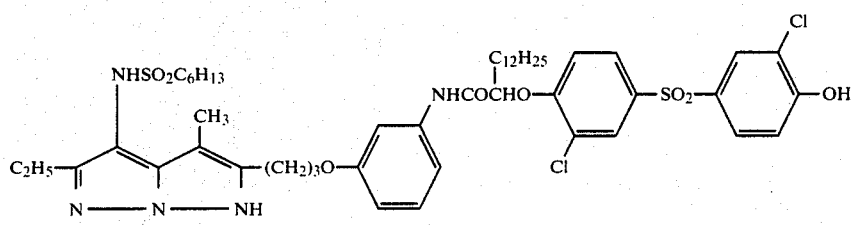
MII-185
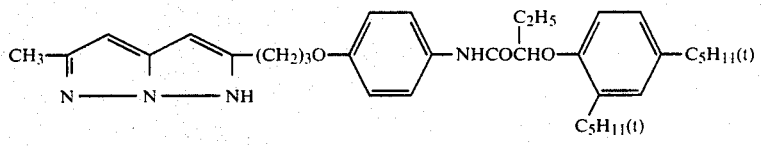
MII-186
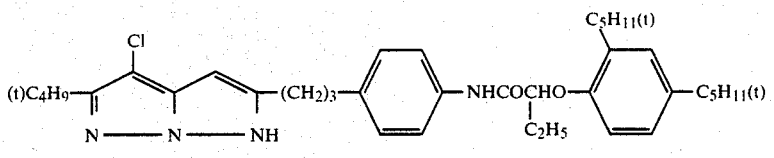
MII-187
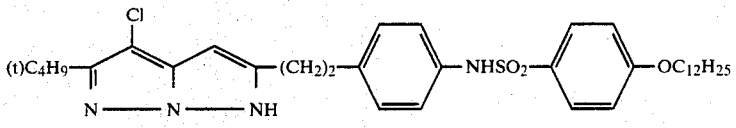
MII-188
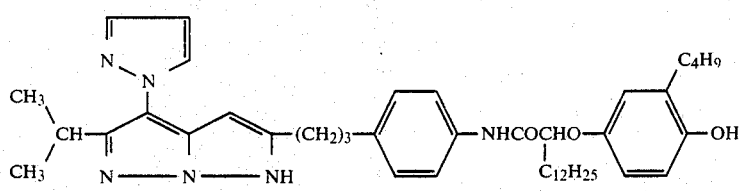
MII-189
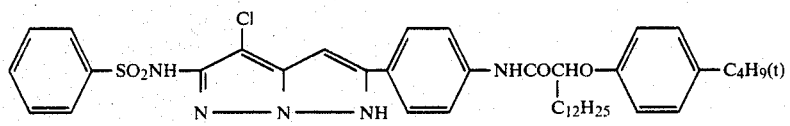
MII-190
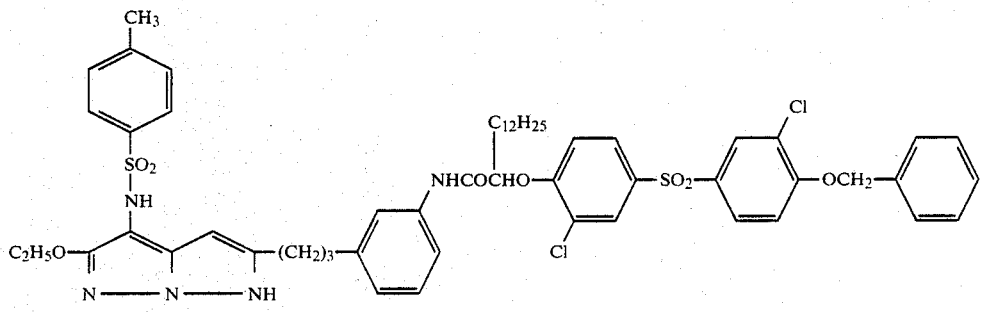
MII-191
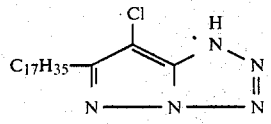

-continued
MII-192
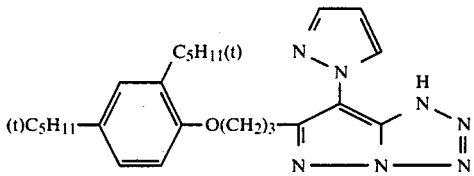
MII-193
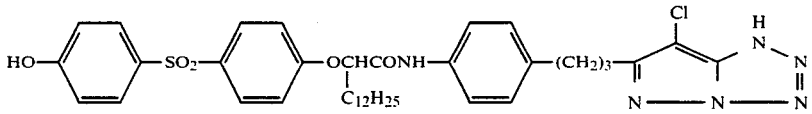
MII-194
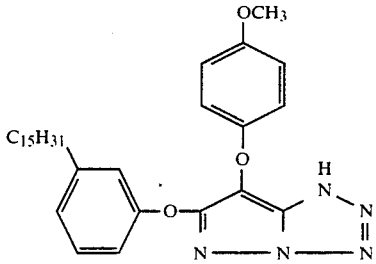
MII-195
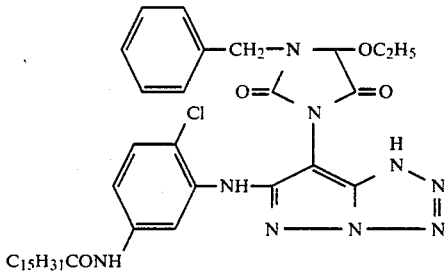
MII-196
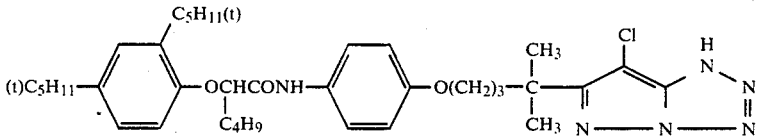
MII-197
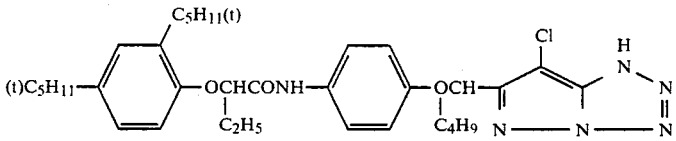
MII-198
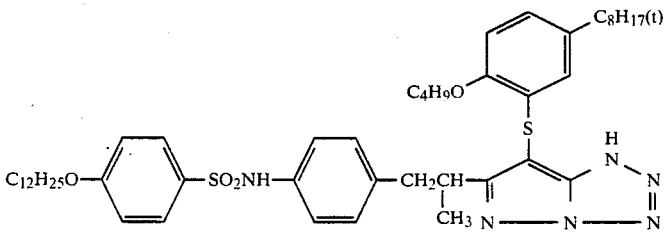
MII-199
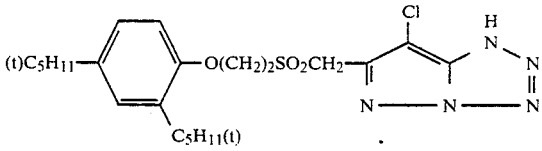
The above-mentioned couplers were synthesized with reference to Journal of the Chemical Society, Perkin I, (1977), pp. 2047–2052; U.S. Pat. No. 3,725,067; Japanese Patent O.P.I. Publication Nos. 99437/1984, 42045/1983, 162548/1984, 171956/1984, 33552/1985 and 43659/1985; and the like.

The above-mentioned couplers may be used normally in an amount within the range of from $1\times10^{-3}$ mol to 1 mol and more preferably from $1\times10^{-2}$ to $8\times10^{-1}$ mol per mol of a silver halide used.

As for the methods of adding the compounds such as the above-mentioned UV absorbing agents, the couplers and the like into a silver halide photographic light-sensitive material, various methods may be used, such as a solid dispersion method, a latex dispersion method, an oil drop-in-water type emulsification dispersion method and the like, which are similar to the methods of adding a common hydrophobic compound. The above-mentioned methods are suitably selected in accordance with the chemical structures of such a hydrophobic compound as a coupler and the like. Among the above-mentioned oil drop-in-water type emulsification dispersion methods, the conventionally know methods for dispersing such a hydrophobic compound as a coupler and the like may be used. Accoring to the methods, a hydrophobic compound including a coupler may be added normally in such a manner that the compound is dissolved with a high boiling organic solvent having a boiling point of not lower than 150° C. and, if required, a low boiling and/or water-soluble organic solvent in combination, and the resulting solution is emulsified and dispersed, with a surface active agent, in such a hydrophilic binder as an aqueous gelatin solution by making use of such a dispersing means as a stirrer, a homogenizer, a colloid mill, a flow-jet mixer, a ultrasonic device or the like, and the resulting matter may be added to an objective hydrophilic colloidal layers. In the above-mentioned case, it is allowed to supplement with a dispersed liquid or a process of removing the low boiling organic solvent at the same time when dispersing the above-mentioned matter.

As for the high boiling organic solvents, an organic solvent having a boiling point of not lower than 150° C. may be used, such as a phenol derivative not reactive with the oxidation products of a developing agent, a phthalic acid ester, a phosphoric acid ester, a citric acid ester, a benzoic acid ester, an alkylamide, a fatty acid ester, a trimethinic acid ester and the like.

The high boiling organic solvents capable of being used preferably in this invention are those having a permittivity of not higher than 6.0, including, for example, such an ester as a phthalic acid ester, a phosphoric acid ester and the like, an orgaic acid amide, a ketone, a hydrocarbon compound and the like, and preferably a high boiling organic solvent having a permittivity within the range of from not higher than 6.0 to not lower than 1.9 and having a vapor pressure of not higher than 0.5 mmHg at 100° C., and more preferably a phthalic acid ester or a phosphoric acid ester among the above-mentioned high boiling organic solvents and, further, the above-mentioned high boiling organic solvents may also be a mixture of not less than two of them.

In this invention, the term, a dielectric constant means a dielectric constant at 30° C.

The phthalic acid esters which are useful in this invention include, for example, those represented by the following Formula [J]:

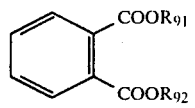

Formula [J]

wherein $R_{91}$ and $R_{92}$ each represent an alkyl group, an alkenyl group or an aryl group, provided that a total number of the carbon atoms of the groups each represented by the $R_{91}$ and $R_{92}$ is from 8 to 32 and more preferably from 16 to 24.

In the invention, the alkyl groups each represented by the $R_{91}$ and $R_{92}$ in the above-given Formula [J] may be the normal chained or branch chained thereof, including, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group and the like. The aryl groups each represented by the $R_{91}$ and $R_{92}$ include, for example, a phenyl group, a naphthyl group and the like, and the alkenyl groups include, for example, a hexenyl group, a heptenyl group, an octadecenyl group and the like. Further, the alkyl groups, alkenyl groups and aryl groups each are allowed to have a single or a plurality of substituents and the substituents of such alkyl groups; and alkenyl groups include, for example, a halogen atom, an alkoxy group, an aryl group, an aryloxy group, an alkenyl group, an alkoxycarbonyl group and the like; and the substituents of the aryl groups include, for example, a halogen atom, an alkyl group, an alkoxy group, an aryl group, an aryloxy group, an alkenyl group, an alkoxycarbonyl group and the like.

The phosphoric acid esters useful in the invention include, for example, those represented by the following Formula [K]:

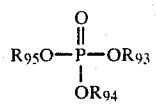

Formula [K]

wherein $R_{93}$, $R_{94}$ and $R_{95}$ each represent an alkyl group, an alkenyl group or an aryl group, provided that a total number of carbon atoms of the groups each represented by the $R_{93}$, $R_{94}$ and $R_{95}$ id from 24 to 54.

The alkyl groups represented by the $R_{93}$, $R_{94}$ and $R_{95}$ in the above-given Formula [K] include, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group and the like; and the aryl groups include, for example, a phenyl group, a naphthyl group and the like; and, further, the alkenyl groups include, for example, a hexenyl group, a heptenyl group, an octadecenyl group and the like.

The above-given alkyl groups, alkenyl groups and aryl groups each are allowed to have a single or a plurality of substituents. The $R_{93}$, $R_{94}$ and $R_{95}$ each preferably represent an alkyl group including, for example, a 2-ethylhexyl group, a n-octyl group, a 3,5,5-trimethylhexyl group, a n-nonyl group, a n-decyl group, a sec-decyl group, a sec-docecyl group, a t-octyl group and the like.

The typical examples of the organic solvents to be used in the invention will be given below, and it is, however, to be understood that the invention shall not be limited thereto.

Exemplified organic solvents:

S-1

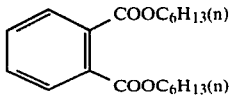

S-2

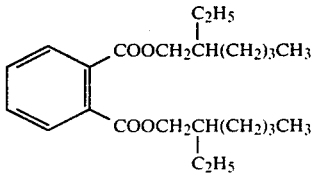

S-3

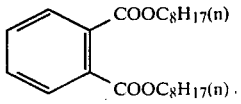

S-4

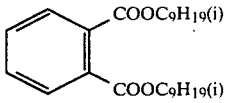

S-5

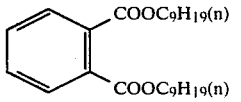

S-6

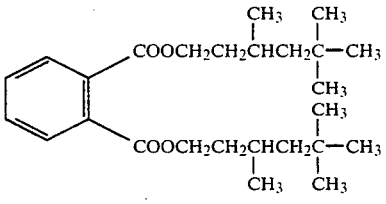

S-7

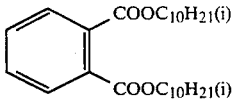

S-8

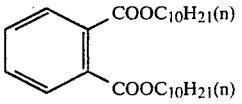

S-9

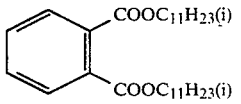

S-10

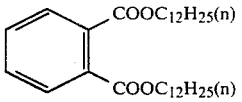

S-11

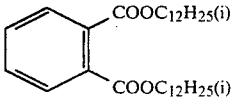

-continued

S-12

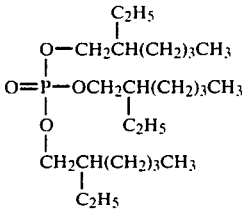

S-13

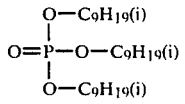

S-14

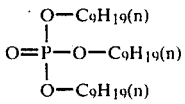

S-15

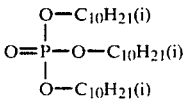

S-16

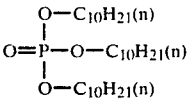

S-17

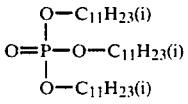

S-18

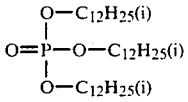

S-19

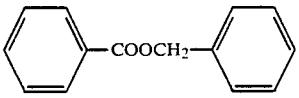

S-20

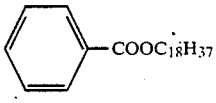

S-21

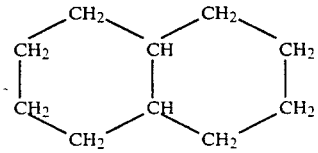

S-22

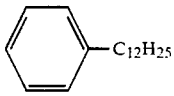

The above-mentioned organic solvents are generally used in a proportion of from 10 to 150% by weight and more preferably from 20 to 100% by weight to the couplers used in the invention.

In the case that such a hydrophobic compound as a coupler is dissolved in such a solvent as a single high boiling solvent or those of a high and low boiling solvents in combination so as to be mechanically or supersinically dispersed in water, such a dispersing aid as an anionic, nonionic or cationic surface active agent may be used.

The silver halide photographic light-sensitive materials of the invention are applied to, for example, a color-negative film, a color-positive film, a color-printing paper and the like and, inter alia, the advantages of the invention can effectively be displayed especially when they are applied to a color-printing paper exhibited for direct appreciation.

In the silver halide emulsions used in the silver halide photographic light-sensitive materials of the invention, there may be used any one of such a silver halide as silver bromide, silver iodobromide, silver iodochloride, silver chlorobromide, silver chloride and the like, which are commonly used in popular type silver halide emulsions.

The silver halide grains used in the silver halide emulsions may be those prepared in any one of the so-called acid process, neutral process and ammonia process. Such grains may be grown at one time or after the seed grains were grown. The processes of preparing such seed grains and the processes of growning them may be the same or the different.

In such silver halide emulsions, a halide ion and a silver ion may be mixed up at the same time, or one may be mixed in the other. Further, silver halide crystals may be grown by adding halide ions and silver ions little by little at the same time by taking a critical crystal-growth rate of silver halide crystals into consideradtion and with controlling a pH value and a pAg value in a mixing furnace. It is also allowed to change the halogen composition of grains thereof in a conversion process, after the growth thereof.

If required, the sizes, configurations, size distributions and growth rates of silver halide grains may be controlled by making use of a silver halide solvent in the course of preparing a silver halide emulsion.

In the course of forming and/or growing the silver halide grins to be used in a silver halide emulsion, metal ions are added therein by making use of a cadmium salt, a zinc salt, a lead salt, a thallium salt, an iridium salt or the complex salts thereof, a rhodium salt or the complex salts thereof, or an iron salt or the complex salts thereof, so that they may be held in the grains and/or on the surfaces of the grains. When they are put in a suitable reducible atmosphere, reduction sensitization nuclei may be provided into such grains and/or onto the surfaces thereof.

After completing the growth of silver halide grains, unnecessary soluble salts may be removed from such silver halide emulsions, or may remain contained therein. If such salts should be removed, it may be carried out in accordance with the method described in Research Disclosure No. 17643.

The silver halide grains to be used in such silver halide emulsions may comprise a layer of which the inside and the surface are uniform, or a layer of which the inside and the surface are different from each other.

The silver halide grains to be used in such silver halide emulsions may be those capable of forming a latent image on the surface thereof, or those capable of forming a latent image mainly inside thereof.

The silver halide grains to be used in such silver halide emulsions may be those each having a regular crystal form, or those each having such an irregular form as a spherical form or a plate form. In these grains, it is allowed to use those each having any ratio of a {100} face to a {111} face and, in addition, it is also allowed to use the grains each having a compound crystal form, or a mixture of variously crystallized grains.

It is also allowed to use a mixture of not less than two kinds of silver halide emulsions each prepared separately.

Such silver halide emulsions are chemically sensitized in an ordinary process. Namely, a sulfur sensitization process using a compound containing sulfur capable of reacting with silver ions, and an active gelating; a selenium sensitization process using a selium compound; a reduction sensitization process using a reducible substance; a noble metal sensitization process using a gold compound or other noble metal compounds; and the like processes. These processes may be used independently or in combination.

The silver halide emulsions may be optically sensitized to a desired wavelength region by making use of such a dye as has been well-known as a spectral sensiting dye in the photographic industry. Such spectral sensitizing dyes may be used independently or in combination. The emulsions are also allowed to contain, as well as the above-mentioned spectral sensitizing dyes, such a dye as is intrinsically incapable of sensitizing the emulsions or a supersensitizer which is a compound not substantially absorbing any visible rays of light and strengthening the sensitizing characteristics of the spectral sensitizing dyes.

In the silver halide emulsion, there may be added with a compound which has been well-known as an antifoggant or a stabilizer in the photographic inductry, with the purposes of preventing a fog caused in the course of manufacturing, preserving or processing a light-sensitive material and/or stabilizing the photographic characteristics of the emulsions, during, when and/or after completing a chemical sensitization before coating the silver halide emulsions on the light-sensitive material.

As for the binders (or the protective colloids) in a silver halide emulsion, a gelating may advantageously be used, however, besides the gelatin, such a hydrophilic colloid as a synthetic hydrophilic macromolecular substance and the like including, for example, a gelatin derivative, a graft polymer of gelatin and other macromolecular substance, protein, a sugar derivative and a cellulose derivative or the mono- or co-polymers thereof.

The photographic emulsion layers and other hydrophilic colloidal layers of the silver halide photographic light-sensitive materials of the invention are hardened with a hardener which is capable of cross-linking the binder molecules to each other so as to increase the strength of the layer surfaces. Such hardeners may be used independently or in combination. It is desired to add the hardeners in such an amount as is not necessary to further add them in a processing liquid but capable of hardening a light-sensitive material, however, such hardeners may also be added to the processing liquid.

A plasticizer may further be added in the silver halide emulsion layers and/or the other hydrophilic colloidal layers of the silver halide photographic light-sensitive materials of the invention, with the purpose of increasing the softness of the above-mentioned layers.

The photographic emulsion layers and the other hydrophilic colloidal layers of the silver halide photographic light-sensitive materials of the invention are also allowed to contain a water-insoluble or hardly soluble synthetic polymer dispersed matter (i.e., the so-called latex), with the purpose of improving the dimensional stability and the like.

In the emulsion layers of the silver halide photographic light-sensitive materials of the invention, a dye-forming coupler for forming a dye through the coupling reaction thereof with the oxidation products of an aromatic primary amine developing agent such as a p-phenylenediamine derivative, an aminophenol derivative or the like, in the course of a color development process. Ordinarily, the dye-forming couplers are so selected as to form the respective dyes capable of absorbing the spectra with respect to each emulsion layer. Namely, a yellow dye-forming coupler is used in a blue light-sensitive emulsion layer, a magenta dye-forming coupler in a green light-sensitive emulsion layer and a cyan dye-forming coupler in a red light-sensitive emulsion layer, respectively. It is, however, allowed to prepare a silver halide photographic light-sensitive material in a different way from the above-mentioned coupler-and-layer combination, according to the purposes.

The silver halide photographic light-sensitive materials of the invention may be provided with such an auxiliary layer as a filter layer, an antihalation layer, an antiirradiation layer and/or the like layers. The above-mentioned layers and/or an emulsion layer are also allowed to contain a dyestuff capable of being discharged from a color light-sensitive material or being bleached in the course of the development process of the light-sensitive material.

The silver halide photographic light-sensitive materials of the invention may also be added with a sliding aid in order to reduce the sliding friction of the light-sensitive material.

The silver halide photographic light-sensitive materials of the invention may further be added with an antistatic agent with the purpose of preventing an electrostatic phenomenon. Such antistatic agent is sometimes used in an antistatic layer provided to the side of a support where no emulsion is laminated on, or it may also be used in an emulsion layer and/or other protective layer than the emulsion layer, which is provided to the side of the support where the emulsion layer is laminated on.

With the purposes of improving the properties of coating, antistatic, slidability, emulsification-dispersion, antiadhesion and photographic characteristics such as a development acceleration, hardening, sensitization and the like, various kinds of surface active agents may be used in the photographic emulsion layers and/or other hydrophilic colloidal layers of the silver halide photographic light-sensitive materials of the invention.

The supports, which are to be coated with the photographic emulsion layers and/or other layers of the silver halide photographic light-sensitive materials of the invention, include, for example, such a flexible reflection type support as a baryta- or α-olefin polymer-laminated paper and the like, such a film as those made of a semi-synthetic or synthetic macromolecules including, for example, a cellulose acetate, a cellulose nitrate, a polystyrene, a polyvinyl chloride, a polyethyleneterephthalate, a polycarbonate, a polyamide and the like, and such a solid material as a glass, a metal, an earthenware and the like.

If required, the surface of a support may be corona discharged, irradiated with UV rays, flame treated or applied with the like treatments and then the silver halide photographic light-sensitive materials of the invention may be coated onto the support directly or through one or not less than two subbing layers which are to improve the properties of the support surface such as the adhesion, antistatic, dimensional stability, abrasion resistance, hardness, antihalation, friction and/or other characteristics.

When coating the silver halide photographic light-sensitive materials, a thickening agent may be used for improving the coating properties. The particularly useful coating methods thereof include, for example, an extrusion coating method and a curtain coating method, in which two or more layers can be coated on at the same time.

The silver halide photographic light-sensitive materials of the invention may be exposed by making use of an electro-magnetic wave having a spectral region to which the emulsion layers which form the light-sensitive material are sensitive. The useful light sources include any well-known ones such as natural light (daylight), a tungsten lamp, a fluorescent lamp, a mercury lamp, a xenon arc lamp, a carbon arc lamp, a xenon flash lamp, a CRT flying spot, various laser beams, a LED, a light emitted from a phosphor excited by an X-rays, γ-rays, α-rays or the like.

It is allowed to apply not only an exposure time from one millisecond to one second that is for the normal shutter speeds of a popular type camera, but also such an exposure time faster than one microsecond as those from 100 microseconds to one microsecond made with a CRT or a xenon flash lamp, and besides the above, a longer exposure not shorter than one second may also be made. Such exposures may further be made continuously or intermittently, either.

In the silver halide photographic materials of the invention, color images may be reproduced in any color development processes well-known to the skilled in the art.

In the invention, the aromatic primary amine color developing agents to be used in a color developer include any well-known ones being popularly used in various color photographic processes. These developers include, for example, an aminophenol derivative and a p-phenylenediamine derivative. These compounds are generally used in the form of the salts thereof, such as a chloride or sulfate, rather than in the free state, because the salts are more stable. Such compounds are generally used at a concentration of from about 0.1 g to about 30 g per liter of a color developer used and more preferably from about 1 g to about 15 g per liter of the color developer used.

In the processes of the invention, the color developers used contain the above-mentioned aromatic primary amine color developing chemicals and in addition they are further allowed to contain any various components which are normally added to color developers, including, for example, such an alkalizer as sodium hydroxide, sodium carbonate, potassium carbonate; an alkali metal sulfite, an alkali metal bisulfite, an alkali metal thiocyanate, an alkali metal halide, benzyl alcohol, a water softening agent, a thickening agent and the like. A pH value of the above-mentioned color developers is normally not lower than 7 and most popularly from about 10 to about 13.

In the invention, a silver halide photographic material is color-developed and is then processed with a processing liquid capable of fixing the light-sensitive material. When the processing liquid capable of fixing is a fixer, a bleaching step is to be taken before the fixing step. As for the bleaching agents to be used in such a bleaching step, the metallic complex salts of an organic acid are used. Such metallic complex salts have the function that a metallic silver produced by a development is oxidized and restored to the silver halide thereof and, at the same time, the undeveloped color portions of a color-developing chemical are color-developed. Such a metal complex salts is composed of an aminopolycarboxylic acid or such an organic acid as oxalic acid, citric acid or the like, with which such a metal ions as that of iron, cobalt, copper or the like are coordinated. The organic acids most preferably useful to form such a metal complex salt thereof as mentioned above include, for example, a polycarboxylic acid or aminocarboxylic acid. These polycarboxylic acid or aminocarboxylic acid may alternatively be an alkali metallic salt, an ammonium salt or a water-soluble amine salt.

The typical examples thereof may be given below:

[1] Ethylenediaminetetraacetic acid,
[2] Nitrilotriacetic acid,
[3] Iminodiacetic acid,
[4] Disodium ethylenediaminetetraacetate,
[5] Tetra(Tri)methylammonium ethylendiaminetetraacetate
[6] Tetrasodium ethylenediaminetetraacetate, and
[7] Sodium nitrilotriacetate.

The bleaching agents to be used therein contain various additives as well as the above-mentioned metallic complex salts of the organic acids to serve as the bleaching agents. It is desirable that such an additive contains an alkali halide or ammonium halide in particular including, for example, a rehalogenater such as potassium bromide, sodium bromide, sodium chloride, ammonium bromide or the like, a metallic salt and a chelating agent.

It is also allowed to suitably add such a pH buffer as a borate, oxalate, acetate, carbonate, phosphate or like salts and such a matter as an alkylamine, polyethylene oxide or the like which is well-known to be put into an ordinary type bleaching liquid.

In addition to the above, the fixers and the bleach-fixers are also allowed to contain a single or not less than two kinds of pH buffers comprising such a sulfite as ammonium sulfite, potassium sulfite, ammonium bisulfite, potassium bisulfite, sodium bisulfite, ammonium metabisulfite, potassium metabisulfite, sodium metabisulfite and the like, and various kinds of salts such as a boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide and the like.

When a process of the invention is carried out while adding a bleach-fix replenisher to a bleach-fix solution (bath), the bleach-fix solution (bath) may contain a thiosulfate, a thiocyanate, a sulfite or the like, or the bleach-fix replenisher may contain the above-mentioned salts to be replenished to a processing bath.

In the invention, for a further activation of a bleach-fixer, the air or oxygen may be blown, if desired, through the bleach-fixing bath and the reservoir of a bleach-fix replenisher, or such a suitable oxidizer as hydrogen peroxide, a bromate, a persulfate and the like may suitably be added thereto.

This invention will further be described in detail with reference to the preferred embodiment of the invention. It is, however, to be understood that the invention shall not be limited thereto.

[EXAMPLE 1]

A multilayered silver halide color photographic light-sensitive material with the layer arrangement shown in Table 1 was prepared by making use of a polyethylene coated paper about which will detailedly be described below:

TABLE 1

| Layer | Composition |
|---|---|
| 3rd layer (A green-sensitive layer) | Gelatin (1.5 g/m$^2$)<br>Silver clorobromide emulsion [containing AgBr of 70 mol %] (0.35 g/m$^2$)<br>Magenta coupler, MI-22 (0.4 g/m$^2$)<br>Antistaining agent, AS-1 (0.01 g/m$^2$)<br>Color image stabilizer, DS-1 (0.16 g/m$^2$)<br>High boiling solvent, S-2* (0.25 g/m$^2$) |
| 2nd layer (1st interlayer) | Gelatin (1.0 g/m$^2$)<br>Antistaining agent, AS-1 (0.07 g/m$^2$)<br>High boiling solvent, S-7* (0.04 g/m$^2$) |
| 1st layer (A blue-sensitive | Gelatin (2.0 g/m$^2$)<br>Silver chlorobromide emulsion [containing AgBr of 90 mol %] (0.3 g/m$^2$)<br>Yellow coupler, Y-7 (0.8 g/m$^2$)<br>Antistaining agent, AS-1 (0.02 g/m$^2$)<br>High boiling solvent, S-6* (0.3 g/m$^2$) |
| Support | Polyethylene coated paper |
| 7th layer (Protective layer) | Gelatin (1.0 g/m$^2$) |
| 6th layer (3rd interlayer) | Gelatin (1.0 g/m$^2$)<br>UV absorber, UV-I2S (0.3 g/m$^2$)<br>Antistaining agent, AS-1 (0.02 g/m$^2$)<br>High boiling solvent, S-6 (0.2 g/m$^2$) |
| 5th layer (Blue-sensitive layer) | Gelatin (1.0 g/m$^2$)<br>Silver chlorobromide emulsion [containing AgBr of 70 mol %] (0.25 g/m$^2$)<br>Cyan coupler, CI-48/CII-3 (0.3 g/m$^2$/0.1 g/m$^2$) (0.4 mol per mol of a silver halide used)<br>Antistaining agent, AS-1 (0.01 g/m$^2$)<br>High boiling solvent, S-2 (0.2 g/m$^2$) |
| 4th layer (2nd interlayer) | Gelatin (1.3 g/m$^2$)<br>UV absorber, UV-7S (0.7 g/m$^2$)<br>Antistaining agent, AS-1 (0.03 g/m$^2$)<br>High boiling solvent, S-6 (0.3 g/m$^2$) |

Note:
Amounts coated or added are given in parentheses.
*dielectric constant
S-2: 5.3
S-6: 4.7
S-7: 4.5

The AS-1 and the DS-1 used in the above-mentioned layers are the compounds having the following structures:

Antistaining agent, AS-1

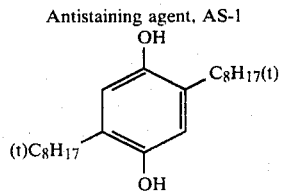

Antidiscoloring agent, DS-1

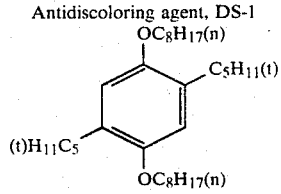

The sample prepared in the above-mentioned manner is called Sample 1. Next, Samples 2 through 24 were prepared by changing, in Sample 1, the UV absorbing agent added in the 6th layer, the yellow, magenta and cyan couplers added in the repspective layers and the compound represented by the Formula [A] added in the 1st layer into those shown in Table-2.

This obtained Samples 1 through 24 were processed as follows:

The Samples 1 through 24 were exposed to green light through an optical wedge by making use of a sensitometer (Model KS-7, manufactured by Konishiroku Photo Industry Co., Ltd., Japan) and were then processed, respectively, in the following steps:

| Standard processing steps | Temperature | Time |
|---|---|---|
| [1] Color developing | 38° C. | 3 min. 30 sec. |
| [2] Bleach-fixing | 33° C. | 1 min. 30 sec. |
| [3] Washing | 25~30° C. | 3 min. |
| [4] Drying | 75~80° C. | 2 min. approx. |

Composition of the processing liquid:

| | |
|---|---|
| (Color developer): | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N—ethyl-N—(β-methane-sulfonamidoethyl)-aniline sulfate | 5.5 g |
| Optical brightening agent (4,4'-diamino-stilbene sulfonic acid derivative) | 1.0 g |
| Potassium hydroxide | 2.0 g |
| Add water to make | 1.0 liter |
| Adjust the pH value to | 10.20 |
| (Bleach-fixer): | |
| Ferric ammonium ethylenediamine-tetraacetate, dihydrate | 60.0 g |
| Ethylenediamine tetraacetate | 3.0 g |
| Ammonium thiosulfate (a 70% solution) | 100.0 ml |
| Ammonium sulfite (a 40% solution) | 27.5 ml |
| Adjust the pH value with potassium carbonate or glacial acetic acid to | pH 7.1 |
| Add water to make | 1.0 liter |

With respect to the prepared neutral Samples (in mid-grey density), the light discoloration thereof were tested in the following manner:

(1) Light discoloration test

The samples were irradiated for 100 hours and for 200 hours, respectively, by making use of a xenon fade-o-meter (having 100,000 lux at 40° C. and 40%RH). A color fastness to light was expressed in terms of a ΔEa*b* specified in CIE 1976 (L* a* b*), a color difference in a color space, as the evaluation measure. The measurements thereof were made by a direct reading type colorimeter (a color computer, SM-3-CH, manufactured by Suga Testing Equipments Works).

(2) Stabilization tests in the emulsified-dispersed UV absorber

The emulsified-dispersed matters relating to the invention were prepared in the following manner:

(a) A mixture of 10 g of the UV absorber of which the composition is shown in Table-2, 10 g of dinonyl phthalate and 20 g of ethyl acetate was made and was then dissolved by heating up to about 60° C.

(b) A mixture of 15 g of gelatin photographic and 200 ml of pure water was made and was then swollen for 20 minutes. Next, the resulted mixture was dissolved by heating up to about 60° C. and was then added with 20 ml of 5% aqueous solution of Alkanol B (manufactured by DuPont) and uniformly stirred.

(c) The respective solutions obtained from (a) and (b) were mixed up and dispersed for 20 minutes by making use of an ultrasonic homogenizer, so that an emulsified-dispersed liquid was obtained. The resulted liquid was finished with 300 ml of pure water.

The resulted emulsified-dispersed matter was kept in a stopped vessel and was left for 36 hours at 40° C. The turbidity increasing ΔT before and after leaving it were checked up.

Herein, a tubidity means a value indicating the correlation to the sizes of dispersed grains. The smaller the value is, the smaller the grain size is under the same conditions. Namely, it indicates that the more a value of ΔT is small, the more dispersed grains are stable and not coarsened. Such turbidity degrees were measured by making use of a Poic type integral sphere type turbidimeter (Model SEP-PT-501D, manufactured by Nippon Seimitsu Kogaku K.K.).

The results obtained from the above-mentioned tests (1) and (2) are shown in Table-2 below.

TABLE 2

| Sample No. | 6th layer: Amt. of gelatin ctd. g/m² | 6th layer: UV absorber | Stability of dispersed liquid, Δ T | 1st layer: Yellow coupler | 1st layer: Compound (A) | 3rd layer magenta coupler | 5th layer Cyan coupler | Discoloration: color balance, ΔEa*b* 100 H | Discoloration: 200 H | |
|---|---|---|---|---|---|---|---|---|---|---|
| 1 | 1.0 | UV-12S | 206 | Y-7 | — | MI-22 | CI-48:CII-3 = 3:1 | 14.0 | 30.2 | C |
| 2 | " | UV-4S:UV-7S = 1:3 | 52 | " | — | " | " | 10.7 | 20.1 | C |
| 3 | " | UV-3S:4S:6S = 6:3:1 | 76 | " | — | " | " | 10.6 | 22.3 | C |
| 4 | " | UV-3S:6S:12S = 3:1:6 | 69 | " | — | " | " | 10.8 | 22.7 | C |
| 5 | " | UV-3S:6S:15L = 4:0:8 | 63 | Y-38 | — | MII-44 | " | 10.7 | 22.8 | C |
| 6 | " | " | " | " | (18) | " | " | 10.6 | 22.6 | C |
| 7 | " | UV-3S:6S:15L = 3:1:8 | 53 | " | — | " | " | 10.8 | 22.9 | C |
| 8 | " | " | " | " | (18) | " | " | 10.6 | 22.5 | C |
| 9 | " | UV-3S:6S:15L = 2:2:8 | 37 | " | — | " | " | 10.3 | 22.6 | C |
| 10 | " | " | " | " | (18) | " | " | 9.6 | 18.7 | I |
| 11 | " | UV-3S:6S:15L = 1:3:8 | 30 | " | — | " | " | 10.0 | 22.2 | C |
| 12 | " | " | " | " | (18) | " | " | 9.0 | 17.6 | I |
| 13 | " | UV-3S:6S:15L = 0:4:8 | 79 | " | — | " | " | 9.6 | 21.8 | C |
| 14 | " | " | " | " | (18) | " | " | 9.7 | 20.3 | C |
| 15 | " | UV-7S:12S:15L = 1:1:2 | 32 | Y-40 | — | MI-33 | CI-51 | 9.3 | 21.1 | C |
| 16 | " | " | " | " | (29) | " | " | 8.8 | 17.5 | I |
| 17 | " | UV-3S:6S:12S:15L = 2:1:3:6 | 28 | Y-58 | — | MI-46 | CI-49:CII-3 = 2:1 | 9.2 | 20.8 | C |
| 18 | " | " | " | " | (29) | " | " | 8.4 | 17.0 | I |
| 19 | " | " | " | " | " | " | CII-23 | 8.6 | 17.6 | I |

TABLE 2-continued

| Sample No. | 6th layer Amt. of gelatin ctd. g/m² | 6th layer UV absorber | Stability of dispersed liquid, Δ T | 1st layer Yellow coupler | 1st layer Compound (A) | 3rd layer magenta coupler | 5th layer Cyan coupler | Discoloration color balance, ΔEa*b* 100 H | 200 H | |
|---|---|---|---|---|---|---|---|---|---|---|
| 20 | " | " | " | " | " | " | CII-25 | 8.5 | 17.5 | I |
| 21 | " | " | " | " | " | " | CI-48:CII-23 = 1:1 | 8.7 | 17.2 | I |
| 22 | " | " | " | " | " | " | CI-48:CII-25 = 2:1 | 8.8 | 17.3 | I |
| 23 | " | " | " | " | " | " | CI-49:CII-25 = 2:1 | 8.6 | 17.2 | I |
| 24 | " | " | " | " | " | " | CI-35:CII-23 = 1:1 | 8.7 | 17.4 | I |

note:
C = Comparative
I = Invention

Note 1:

The compounds represented by the Formula [A] was added in the 1st layer in a proportion of 30% by weight to the yellow couplers added.

Note 2:

The total amount of the UV absorbers added in the 6th layer was 0.3 g/m², and a ratio applied to the case of containing two or more kinds thereof was the ratio by weight.

As proved in the results shown in Table 2, the samples 10, 12, 16 and 18 through 24 prepared in accordance with this invention are superior to the other comparative samples, in every respect of the stability of a UV absorbing agent used therein as well as the effects on substantial reduction of unbalance in color resulted from a discoloration. The compounds represented by the Formula [A] may be able to display remarkable effects on the improvements of the above-mentioned unbalance in color when they are used in combination with the UV absorbing agents each having the composition relating to the invention (for example, the comparison of sample 11 to sample 12) however, they are almost unable to display any of the effect when they are used with a UV absorbing agent having the other composition than those of the invention (for example, (the comparison of sample 5 to sample 6) and, accordingly, such peculiarly excellent results can be enjoyed only in the case of using the composition of the UV absorbing agents relating to the invention.

In the Samples 1, 2, 3 and 4 each not containing a UV absorbing agent which is in liquid state at 30° C.; the Samples 5 and 6 lacking in a UV absorbing agent (UV-6S) which contains the groups represented by $R_1$ and $R_2$ in the Formula [UV-1] having not less than 8 carbon atoms in total; the Samples 7 and 8 each containing the UV absorbing agent having not less than 8 carbon atoms in total in the groups represented by $R_1$ and $R_2$ in the Formula [UV-1] in a proportion of not more than 35% to to the total amount of the UV absorbing agents which are in solid state at 30° C.; and the Samples 13 and 14 each not containing a UV absorbing agent being in solid state at 30° C. and having not more than 8 carbon atoms in total in the groups in the groups represented by the $R_1$ and $R_2$; every one of the above-mentioned samples indicate that the values of ΔT are high and the UV dispersion liquids are poor in stability.

In marked contrast to the above, each of the dispersibility of the Samples 9, 12 and 15 through 24 is excellently stable as shown by the ΔT values thereof, because the UV absorbing agents thereof have the composition relating to the invention.

[EXAMPLE 2]

Samples 25 through 29 were prepared similarly to the Sample 18, except that the kinds of the compounds represented by the Formula [A] and the layers added therewith were changed as indicated in Table 3; and the color balance in discoloration and the haze thereof were checked up, respectively.

Samples 25 and 26 are the comparative samples in which the compounds represented by the Formula [A] were added into the layers other than the emulsion layers each containing yellow couplers; and the Samples 28 and 29 are those in which the matting agents were added into the Sample 27 of this invention.

The evaluation of the haze on the samples were made as follows and the results of the tests are shown in Table 3 below:

Observation of surface state:

With respect to the samples irradiated for 200 hours and particularly to the color developed areas, the observation and evaluation were made with the naked eye mainly from the viewpoint of the physical properties of the samples. How the hazes or clouds were causes were ranked in accordance with the following evaluation criteria:

TABLE 3

| Ranking | Details of state |
|---|---|
| o | Very close approximation to the sample before it was irradiated. |
| Δ | There found a little opaque tint. |
| x | There found an apparent whitish haze visually the naked eye. |
| xx | There found a further haze and the surface gloss was affected. |

| Sample No. | 7th layer Matting agent | 7th layer Amount coated g/m² | Amount of compound represented by Formula [A] (Refer to Note) | | Haze (Visual sensation | ΔEa*b* 100H | 200H | |
|---|---|---|---|---|---|---|---|---|
| 25 | — | — | (29) | 3rd layer | Δ | 9.3 | 20.9 | Comp. |
| 26 | — | — | (29) | 5th layer | Δ | 9.0 | 20.2 | " |
| 27 | — | — | (29) | 1st layer | Δ | 8.1 | 16.7 | Inv. |
| 28 | MAT-1 | 0.003 | (18) | 1st layer | o | 8.0 | 16.5 | " |

TABLE 3-continued

| | | | | | | | | |
|---|---|---|---|---|---|---|---|---|
| 29 | " | 0.003 | (29) | 1st layer | o | 8.0 | 16.6 | " |

Note:
The compounds represented by the Formula [A] were added to a layer in an amount of 30% by weight to the amount of couplers to be contained in the same layer.

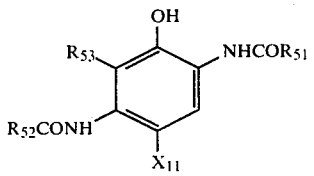

As is obvious from the results shown in the Table 3, in the Samples 25 and 26 in which the compounds represented by the Formula [A] were added into other layers than the layers each containing yellow couplers, the color balance thereof were seriously worsened by a discoloration, as compared with the Sample 27 of this invention. It is, therefore, obviously essential to add the compounds represented by the Formula [A] into at least the yellow coupler-containing layers; and it can also be recognized that the addition of a matting agent is effective to reduce hazes.

What is claimed is:

1. A silver halide photographic light-sensitive material comprising a reflective support end, provided thereon, a light-sensitive silver halide emulsion layer containing a yellow coupler, a light-sensitive silver halide emulsion layer containing a magenta coupler, a light-sensitive silver halide emulsion layer containing a cyan coupler, and a non-light-sensitive layer being provided at a further side of the light-sensitive emulsion layer being provided at the furthest position from said support, wherein said non-light-sensitive layer contains at least three kinds of UV absorbers represented by the general formula

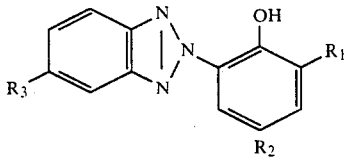

wherein $R_1$, $R_2$ and $R_3$ are independently selected from the group consisting of a hydrogen atom, a halogen atom, an alkyl group, an aryl group, an alkoxy group, an aryloxy group, an alkenyl group, a nitro group and a hydroxy group, provided that one of said UV absorbers is selected from a first class of UV absorbers which are in a liquid state at 30° C. and two of said UV absorbers are selected from a second class UV absorbers which are in a solid state at the same temperature, that said first class UV absorber is present in a proportion of 30% to 99% by weight based on total amount of said UV absorbers and that at least one of said second class UV absorbers has a total of at least 8 carbon atoms in the groups represented by $R_1$ and $R_2$ of said general formula [UV-I] and constitutes 35% to 100% by weight of the total amount of said second class UV absorbers, and said emulsion layer containing the yellow coupler contains a compound represented by the general formula [A]:

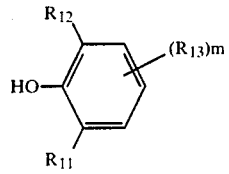

wherein $R_{11}$ and $R_{12}$ are independently an alkyl group, and $R_{13}$ is an alkyl group, —NR'R" group, —SR', or —COOR" group, wherein R' is a monovalent organic group and R" is a hydrogen atom or a monovalent organic group, and m is an integer 0 to 3.

2. The material of claim 1 wherein said first class of UV absorbers is 30% to 80% by weight of said UV absorbers.

3. The silver halide photographic light-sensitive material of claim 1 wherein said first class UV absorber is 30% to 95% by weight of the total amount of said UV absorbers.

4. The silver halide photographic light-sensitive material of claim 1 wherein said second class UV absorber(s) having a total of at least 8 carbon atoms in the groups represented by $R_1$ and $R_2$ of the general formula [UV-I] in all is 50% to 100% by weight of the total amount of said solid UV absorbers.

5. The silver halide photographic light-sensitive material of claim 1 wherein the total amount of the UV absorbers contained in the non-light-sensitive layer is 0.1 to 300% by weight of an amount of a binder contained thereon.

6. The silver halide photographic light-sensitive material of claim 5 wherein the ratio of the total amount of the UV absorbers to the binder is 1 to 200% by weight.

7. The silver halide photographic light-sensitive material of claim 5 wherein the ratio of the total amount of the UV absorbers to the binder is 5 to 100%.

8. The silver halide photographic light-sensitive material of claim 1 wherein said UV absorbers are dispersed in the non-light-sensitive layer together with the high-boiling organic solvent of which dielectric constant is not more than 6.0.

9. The silver halide photographic light-sensitive material of claim 1 wherein formula [A] is selected from a compound of the general formula [A']:

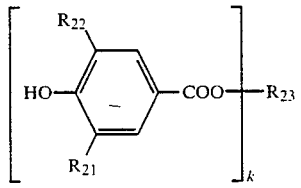

wherein $R_{21}$ and $R_{22}$ are independently selected from alkyl groups containing 3 to 8 carbon atoms, $R_{23}$ is a k-valent organic group, and k is an integer of 1 to 6.

10. The silver halide photographic light-sensitive material of claim 1 wherein formula [A] is selected from a compound of the general formula [A]:

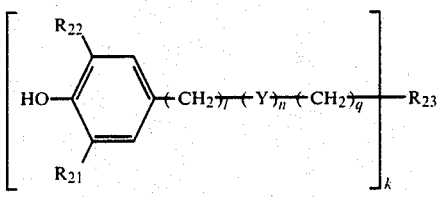

wherein $R_{21}$ and $R_{22}$ are independently selected from alkyl groups containing 3 to 8 carbon atoms, $R_{23}$ is a k-valent organic group, and k is an integer of 1 to 6, Y is a divalent organic group, l is a positive integer and n and q are 0 or a positive integer.

11. The silver halide photographic light-sensitive material of claim 1 wherein formula [A] is selected from a compound of the general formula [A'''']:

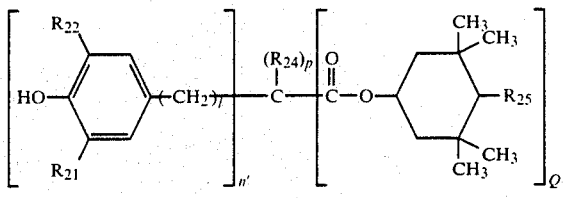

wherein $R_{21}$ and $R_{22}$ are independently selected from alkyl groups having 3 to 8 carbon atoms, $R_{24}$ and $R_{25}$ are independently selected from the group consisting of a hydrogen atom, an alkyl group, an alkenyl group, an alkynyl group and an acyl group, n' and Q are an integer of 1 to 3, p is an integer 0 to 2, and $n'+Q+p=4$.

12. The silver halide photographic light-sensitive material of claim 1 wherein an amount of formula [A] in the emulsion layer is 5 to 300 weight parts per 100 parts weight parts of the yellow coupler.

13. The silver halide photographic llght-sensitive material of claim 12 wherein an amount of formula [A] in the emulsion layer is 10 to 100 weight parts per 100 weight parts of the yellow coupler contained therein.

14. The silver halide photographic light-sensitive material of claim 1 wherein said yellow coupler is represented by the general formula [B]:

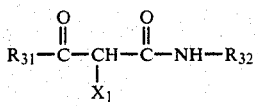

wherein $R_{31}$ s alkyl or aryl, $R_{32}$ is aryl, and $X_1$ is a hydrogen atom or a substituent capable of being released upon reaction with an oxidation product of a color developing agent.

15. The silver halide photographic light-sensitive material of claim 14 wherein said yellow coupler is of the general formula [B']:

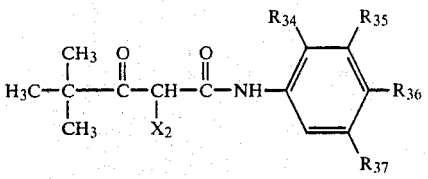

wherein $R_{34}$ is a hydrogen atom, a halogen atom, or an alkoxy group, $R_{35}$, $R_{36}$, and $R_{37}$ are independently selected from the group consisting of a hydrogen, a halogen, alkyl, alkenyl, alkoxy, aryl, carboxy, alkoxycarbonyl, carbamoyl, sulfo, sulfamoyl, alkylsulfonamide, acylamide, ureido, and amino, and $X_2$ is hydrogen atom or a substituent capable of being released upon reaction with an oxidation product of a color developing agent.

16. The silver halide photographic light-sensitive material of claim 1 wherein said cyan coupler is of the general formula [E]:

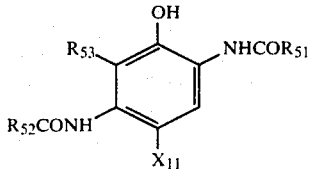

wherein $R_{51}$ is aryl, cycloalkyl, or a heterocyclic group, $R_{52}$ is alkyl or phenyl, $R_{53}$ is selected from the group consisting of hydrogen, halogen, alkyl, and alkoxy, and $X_{11}$ is a hydrogen atom or a substituent capable of being released upon reaction with an oxidation product of a color developing agent.

17. The silver hailde photographic light-sensitive material of claim 1 wherein said cyan coupler is represented by the general formula [F]:

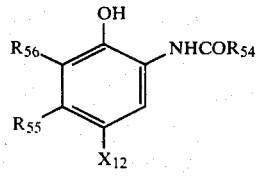

wherein $R_{54}$ and $R_{55}$ are each an alkyl group, $R_{56}$ is hydrogen, halogen, or alkyl, and $X_{12}$ is a hydrogen atom or a substituent capable of being released upon reaction with an oxidation product of a color developing agent.

18. The silver halide photographic light-sensitive material of claim 1 wherein said magenta coupler is represented by the general formula [G]:

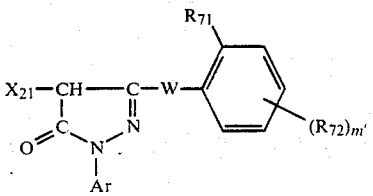

wherein Ar is an aryl group, $R_{71}$ is hydrogen or a substituent, $R_{72}$ is a substituent, $X_{21}$ is a hydrogen atom or a substituent capable of being released upon reaction with an oxidation product of a color developing agent, W is —NH—NHCO— or —NYCONH—, and m' is 1 or 2.

19. The silver halide photographic light-sensitive material of claim 1 wherein said magenta coupler is represented by the general formula [H-I]:

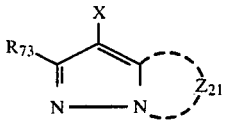

wherein $Z_{21}$ is a nonmetallic group necessary to complete a nitrogen-containing heterocyclic ring, $X_{31}$ is a hydrogen atom or a substituent capable of being released upon reaction with an oxidation product of a color developing agent, and $R_{73}$ is a hydrogen atom or a substituent.

* * * * *

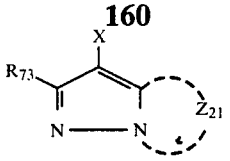

wherein $Z_{21}$ is a nonmetallic group necessary to complete a nitrogen-containing heterocyclic ring, $X_{31}$ is a hydrogen atom or a substituent capable of being released upon reaction with an oxidation product of a color developing agent, and $R_{73}$ is a hydrogen atom or a substituent.

* * * * *